US011661719B2

(12) United States Patent
Jaecklin et al.

(10) Patent No.: US 11,661,719 B2
(45) **Date of Patent: *May 30, 2023**

(54) BUILDING ELEMENTS FOR MAKING RETAINING WALLS, AND SYSTEMS AND METHODS OF USING SAME

(71) Applicant: Evergreen Walls, Inc., Norcross, GA (US)

(72) Inventors: Felix P. Jaecklin, Norcross, GA (US); Clayton E. Warner, Norcross, GA (US); John Koutitsas, Athens (GR)

(73) Assignee: EVERGREEN WALLS, INC., Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/482,541

(22) Filed: Sep. 23, 2021

(65) Prior Publication Data

US 2022/0081868 A1 Mar. 17, 2022

Related U.S. Application Data

(63) Continuation of application No. 16/172,001, filed on Oct. 26, 2018, now Pat. No. 11,149,402, which is a continuation-in-part of application No. 15/448,134, filed on Mar. 2, 2017, now Pat. No. 10,273,648.

(60) Provisional application No. 62/577,451, filed on Oct. 26, 2017, provisional application No. 62/302,793, filed on Mar. 2, 2016.

(51) Int. Cl.
*E02D 29/02* (2006.01)

(52) U.S. Cl.
CPC ..... *E02D 29/0266* (2013.01); *E02D 29/025* (2013.01); *E02D 29/0233* (2013.01); *E02D 2300/002* (2013.01); *E02D 2300/0006* (2013.01); *E02D 2300/0026* (2013.01); *E02D 2300/0029* (2013.01);

(Continued)

(58) Field of Classification Search
CPC ... E02D 29/02; E02D 29/0225; E02D 29/025; E02D 29/0258; E02D 29/0266; E02D 29/0233
See application file for complete search history.

(56) References Cited

U.S. PATENT DOCUMENTS 4,655,646 A * 4/1987 Babcock ..... E02D 29/0266 405/262
4,684,294 A * 8/1987 O'Neill ..... E02D 29/0266 405/286

(Continued)

FOREIGN PATENT DOCUMENTS

DE 3042762 A1 * 2/1982
EP 0429379 A1 * 5/1991

(Continued)

*Primary Examiner* — Frederick L Lagman
(74) *Attorney, Agent, or Firm* — Ballard Spahr LLP

(57) ABSTRACT

A budding element for coupling with other budding elements to erect a retaining wall. Exemplary building elements have receiving spaces for receiving increased weight of fill material to provide increased stability. Optionally, each building element can have an enlarged face profile that provides efficiency in the shipping and assembly process. Optionally, each building element can define alignment voids that receive portions of alignment posts for ensuring vertical alignment between adjacent building elements or portions of building elements.

20 Claims, 45 Drawing Sheets

(52) U.S. Cl.
CPC ..... *E02D 2300/0032* (2013.01); *E02D 2300/0034* (2013.01); *E02D 2600/20* (2013.01); *E02D 2600/30* (2013.01)

(56) References Cited

U.S. PATENT DOCUMENTS 4,884,921 A * 12/1989 Smith ..... E02D 29/0266 405/262
5,066,169 A * 11/1991 Gavin ..... E02D 29/0241 405/262
5,131,791 A * 7/1992 Kitziller ..... E02D 29/0241 405/262
5,163,261 A * 11/1992 O'Neill ..... E02D 29/0225 52/592.6
6,994,495 B1 * 2/2006 Carey ..... E02D 29/025 405/286
7,044,687 B1 * 5/2006 Carey ..... E02D 29/0266 405/262
10,273,648 B2 * 4/2019 Jaecklin ..... E02D 29/025
11,149,402 B2 * 10/2021 Jaecklin ..... E02D 29/0233
2006/0177278 A1 * 8/2006 Carey ..... E02D 29/025 405/285
2007/0110524 A1 * 5/2007 MacDonald ..... E02D 29/0266 405/262
2008/0317557 A1 * 12/2008 Jaecklin ..... E04C 1/395 405/284
2009/0148242 A1 * 6/2009 Collet ..... B28B 7/0064 249/34
2009/0162147 A1 * 6/2009 Klenert ..... E02D 29/025 52/578
2011/0318100 A1 * 12/2011 Rainey ..... E02D 29/02 405/262
2012/0177450 A1 * 7/2012 Phillips ..... E02D 29/0216 405/284
2014/0234025 A1 * 8/2014 Rainey ..... E02D 29/025 404/6
2019/0093306 A1 * 3/2019 Babcock ..... E02D 29/0266

FOREIGN PATENT DOCUMENTS

KR 2007020911 A * 2/2007 ..... E02D 29/025
WO WO-2007122485 A2 * 11/2007 ..... E02D 29/025

* cited by examiner

BUILDING ELEMENTS FOR MAKING RETAINING WALLS, AND SYSTEMS AND METHODS OF USING SAME

CROSS-REFERENCE TO RELATED APPLICATION

This application is a continuation of U.S. patent application Ser. No. 16/172,001, filed Oct. 26, 2018, now U.S. Pat. No. 11,149,402, which claims priority to and the benefit of the filing date of U.S. Provisional Patent Application No. 62/577,451, filed on Oct. 26, 2017. U.S. patent application Ser. No. 16/172,001 is also a continuation-in-part of co-pending U.S. patent application Ser. No. 15/448,134, filed Mar. 2, 2017, now U.S. Pat. No. 10,273,648, which claims priority to and the benefit of the filing date of U.S. Provisional Patent Application No. 62/302,793, filed on Mar. 2, 2016. Each of the above-identified applications is incorporated herein by reference in its entirety.

FIELD

The present disclosure relates generally to building elements for wall structures. More particularly, the present disclosure relates to a plurality of building elements that are operably coupled to each other to erect a retaining wall.

BACKGROUND

It is common practice to use. prefabricated building elements and particular masonry works such as walls for retaining slopes and slopes along roads, motorways, railways or the like, or for retaining walls for creating drops between urban levels, especially by various types of prefabricated building elements. Such elements usually consist of concrete elements, placed one at the top of the other, and then filled with material such as earth, sand, gravel, and the like. Previous approaches have been developed to building elements for a retaining wall. One example of such an approach is described in U.S. Pat. No. 7,845,885 which is incorporated herein by reference in its entirety.

Currently, building elements require expensive molds and a minimum of one night to rest in the mold to allow time for the material to harden. In addition, the process used to generate a building element results in a building mold with limited variability. Thus, the resulting building element limits the structural variability of the retaining walls that can be constructed using the building element. There is a need in the pertinent art for building elements with increased variability in structure, thereby allowing for increased variability in the structures of retaining walls produced using the building elements.

There is a further need for building elements that provide increased stability and integrity compared to existing building elements. There is still a further need for building elements that provide for increased efficiency in the construction of wall structures.

SUMMARY

The disclosure relates to the building of large and heavily loaded retaining walls by a set of prefabricated building elements. Optionally, the prefabricated building elements can include at least two different types of prefabricated building elements. During installation, the building elements can be operably engaged to build a retaining wall. To solidify the retaining wall, earth fillers such as dirt and the like can be used to support the wall.

Disclosed herein are building elements and systems and methods of using building elements to erect a retaining wall. In some aspects, the disclosed building elements can have a modular construction that simplifies production of the building elements and the retaining walls formed by the building elements. In these aspects, it is contemplated that the modular construction increases the ease in which the dimensions and characteristics of a building element can be selectively varied at a particular location within the wall construction to achieve a particular structural need. It is further contemplated that the modular construction can lower production costs, lower investment costs for molds, and ease transport of building elements.

In other aspects, a building element can be configured to be coupled to at least one other building element to form a retaining wall. The building element can comprise a face panel that defines a front surface and a rear surface positioned on an opposing side of the face panel from the front surface. The face panel can comprise a length dimension that is oriented along a first axis, a width/thickness dimension that is oriented along a second axis that is perpendicular to the first axis, and a height dimension that is oriented along a third axis that is perpendicular to the first and second axes. The building element can also comprise at least one beam member coupled to the rear surface of the face panel. The beam member can comprise an upper surface and a lower surface, and at least one surface of the upper surface and the lower surface can define an alignment void that is configured to receive a complementary portion of an adjacent building element. The beam member can also comprise a height dimension oriented along the third axis and a length dimension oriented along the second axis (such that the beam member is substantially perpendicular to the rear surface of the face panel and extends away from the rear surface of the face panel relative to the second axis).

Optionally, in various aspects, the building elements can be engaged to one another using at least one alignment post. The alignment post can comprise a stern and a cap. The stem can have a longitudinal axis and a length dimension. along the longitudinal axis. In use, it is contemplated that the longitudinal axis of the stem can be parallel or substantially parallel to the third axis disclosed herein. The cap can comprise a top surface and a bottom surface, wherein the top surface comprises a first cross sectional area and the bottom surface comprises a second cross sectional area. The stem can be coupled to the cap through the bottom surface. In exemplary aspects, a first portion of the stem can be embedded within the cap, with a second portion of the stem extending downwardly and away from the bottom surface.

In other aspects, a plurality of building elements as disclosed herein can be operably engaged to erect a retaining wall system. The retaining wall system can comprise a plurality of building elements, wherein each building element can comprise a face panel and at least one beam member. The face panel can comprise a front surface and a rear surface positioned on an opposite side of the face panel from the front surface. At least one beam member can be coupled to the rear surface of the face panel. The beam member can comprise an upper surface and a lower surface, and at least one surface of the upper surface and lower surface can define an alignment void. The retaining wall system can further comprise an alignment post, and at least a portion of a stem of the alignment post can be configured for receipt within an alignment void of a first building element. Depending upon the orientation of the alignment post, the stem of the alignment post can be received within an alignment void that extends upwardly from the lower surface of the beam member or an alignment void that extends downwardly from the upper surface of the beam member, and a cap portion of the alignment post can be configured to extend either (a) above the upper surface or (b) below the lower surface. A second building element can define an alignment void that is configured to receive the cap of the alignment post when beam members of the first and second building elements are positioned in vertical alignment with one another.

Also disclosed, in further aspects, is a building element for forming a portion of a retaining wall, the building element comprising: a face panel comprising a top surface, a bottom surface, a front surface, and a rear surface positioned on an opposing side of the face panel from the front surface, wherein the face panel comprises a length dimension oriented along a first axis, a width dimension oriented along a second axis that is perpendicular to the first axis, and a height dimension oriented along a third axis that is perpendicular to the first and second axes; and a beam member coupled to the rear surface of the face panel, the beam member comprising a main body and first and second foot portions, the main body having an upper surface and first and second side surfaces that are substantially parallel to the second axis, wherein the first and second foot portions project, respectively, from the first and second side surfaces relative to the first axis, and wherein the first and second foot portions have respective lower surfaces that are substantially co-planar with the bottom surface of the face panel and respective upper surfaces that are positioned between the bottom and top surfaces of the face panel relative to the third axis, wherein the beam member has a distal end portion spaced from the front panel relative to the second axis, wherein the distal end portion comprises first and second projections that project, respectively, from the first and second side surfaces of the main body of the beam member, and wherein the first and second projections cooperate with respective portions of the first and second foot portions, the first and second side surfaces of the main body, and the rear surface of the face panel to define first and second receiving spaces on opposing sides of the beam member. Systems and methods of using and making the disclosed building element are also disclosed.

Further disclosed, in other aspects, is building element for forming a portion of a retaining wall, the building clement comprising: a panel comprising a top surface, a bottom surface, a front surface, and a rear surface positioned on an opposing side of the face panel from the front surface, wherein the face panel comprises a length dimension oriented along a first axis, a width dimension oriented along a second axis that is perpendicular to the first axis, and a height dimension oriented along a third axis that is perpendicular to the first and second axes, wherein the panel has opposed first and second side surfaces extending between the front surface and the rear surface, wherein the panel comprises: a plurality of mortar beds defined within the panel, wherein the plurality of mortar beds are spaced apart relative to the first axis; a reinforcing mesh embedded within the panel; and a plurality of projections extending upwardly from the top surface and a plurality of receptacles defined within the bottom surface, wherein the receptacles are configured to receive the projections of a second building element. Systems and methods of using and making the disclosed building element are also disclosed.

Additional advantages of the invention will be set forth in part in the description which follows, and in part will be obvious from the description, or may be learned by practice of the invention. The advantages of the Invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

These and other features of the disclosure will become more apparent in the detailed description in which reference is made to the appended drawings wherein:

FIG. 4 depicts two building elements having reinforcement wings with straight profiles. FIG. 5 depicts two building elements having reinforcement wings with curved or arcuate profiles. FIG. 6 depicts two building elements having reinforcement wings with different profiles, with the reinforcement wings of one building element having curved or arcuate profiles and the reinforcement wings of another building element having straight profiles.

FIG. 23F shows a gap between the side and rear elbows, while FIG. 23G shows the side and rear elbows as a continuous structure that extends along outer surfaces of the beam member.

FIG. 30 is a perspective view, while FIGS. 31A, 31B, and 31C respectively show front, side, and top views of the enlarged panel.

DETAILED DESCRIPTION

Figure 1:
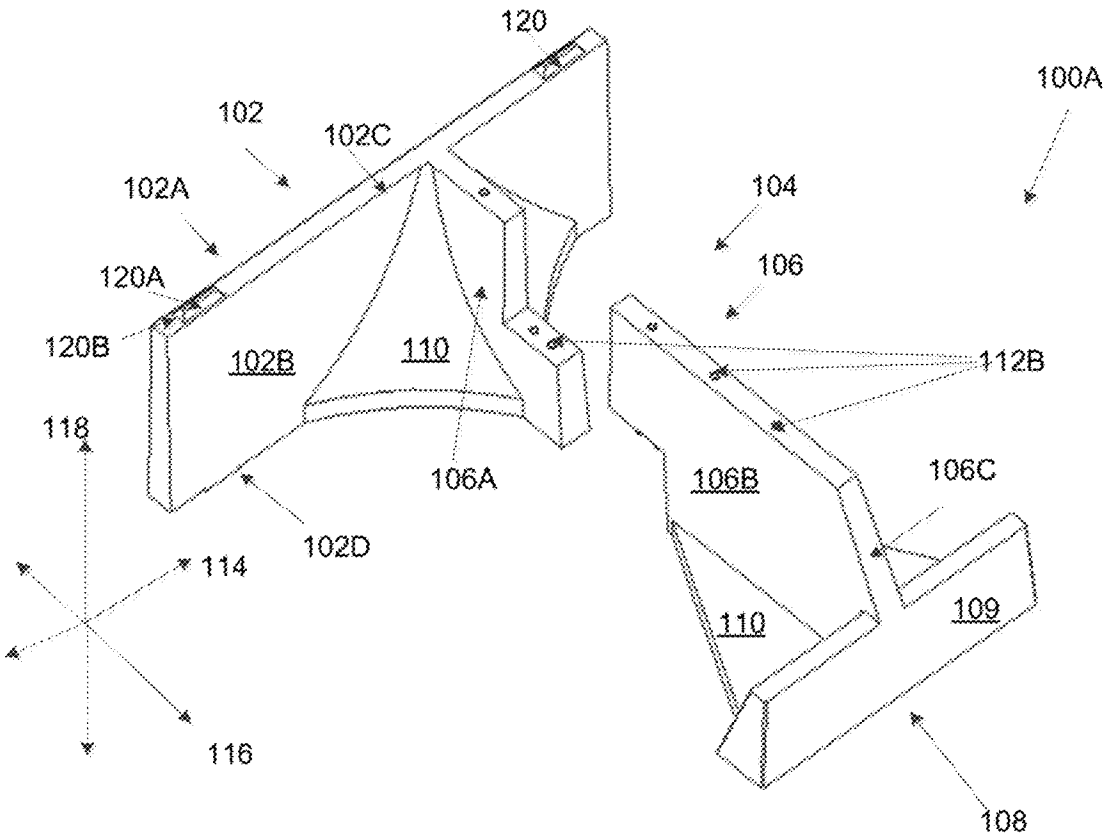
FIG. 1 is a rear perspective view of an exemplary modular building element having a single beam member as disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a beam member" can include two or more such beam members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The word "substantially" as used herein can be used to define an angular tolerance of +/−15 degrees with respect to a disclosed (e.g., desired) angular relationship between two geometric entities. For example, "substantially vertical" can indicate that a reference surface or body is oriented vertically or within +/−15 degrees of absolute vertical alignment.

Similarly, "substantially collinear" can indicate that two bodies can are collinear or positioned within an alignment divergence of +/−15 degrees of a collinear orientation (with the second body having an angular orientation relative to the first body that is less than or equal to 15 degrees and greater than or equal to −15 degrees).

In the following description, the orientation of the components of the disclosed building elements, retaining walls, and wall systems can be described with reference to a series of axes, including a first axis 114, a second axis 116 that is perpendicular to the first axis, and a third axis 118 that is perpendicular to the first and second axes. A primary plane can be defined by and contain the first axis and the second axis. A secondary plane can be defined by and contain the second axis and the third axis. A tertiary plane can defined by and contain the first axis and the third axis.

In various aspects, described herein with reference to FIGS. 1-22 are building elements 100, 100A, 100B, 100C, 100C, 100E that are configured to be assembled together with at least one other building element to form a retaining wall 300. In these aspects, the building elements can comprise a face panel defining a front surface and a rear surface oriented on an opposing side of the face panel from the front surface. It is contemplated that the face panel can comprise a length dimension oriented along the first axis 114 and a height dimension oriented along the third axis 118. In additional aspects, and as further disclosed herein, the building elements can further comprise at least one beam member coupled to the rear surface of the face panel. Each beam member can have an upper surface and a lower surface. The beam member can comprise a height dimension oriented along the third axis 118 and a length dimension oriented along the second axis 116. Optionally, in exemplary aspects, at least one surface of the upper surface and the lower surface of at least one beam member can define an alignment void as further disclosed herein.

FIGS. 1-6 depict examples of a building element 100A that can be used to form at least a portion of a retaining wall 300. In an aspect, building element 100A can comprise a face panel 102 and at least one beam member 104. To provide a framing structure for a retaining wall, the face panel 102 can be coupled or secured to the beam member 104. Optionally, in exemplary aspects, a portion of each beam member 104 can be permanently secured to or integrally formed with a corresponding tare panel 102. In an aspect, the face panel 102 can comprise a front surface 102A and a rear surface 102B. The front surface 102A and the rear surface 102B can be defined on opposing sides of the face panel 102.

As depicted in FIG. 1, the face panel 102 can comprise a rectangular surface comprising a length dimension, which can extend along the first axis 114. The face panel 102 can further comprise a width/thickness dimension, which can extend along the second axis 116. The face panel 102 can still further comprise a height dimension, which can extend along the third axis 118. In a further aspect, the face panel can be oriented at an angle with respect to the primary plane, which contains and is defined by the first axis 114 and the second axis 116. Optionally, in this aspect, the face panel 102 can be perpendicular or substantially perpendicular to the primary plane (and the second axis 116). That is, the face panel 102 can be oriented vertically or substantially vertically (approximately 90 degrees) with respect to the primary plane defined by the first and second axes 114, 116 (and parallel or substantially parallel with respect to the third axis 118). In general, the primary plane will be approximately level and can be parallel or substantially parallel to a ground surface on which the retaining wall is erected. In a further aspect, at least a portion of the rectangular surface of the face panel 102 can be coplanar or substantially coplanar with the secondary plane, which contains and is defined by the first axis 114 and the third axis 118.

Although generally described herein as having a flat, rectangular constriction, it is contemplated that at least a portion of the face panel 102 can have a radius of curvature that defines an arcuate profile (e.g., a convex or concave profile). For example, the face panel can bow with respect to an arcuate path determined by the associated radius.

Figure 12:
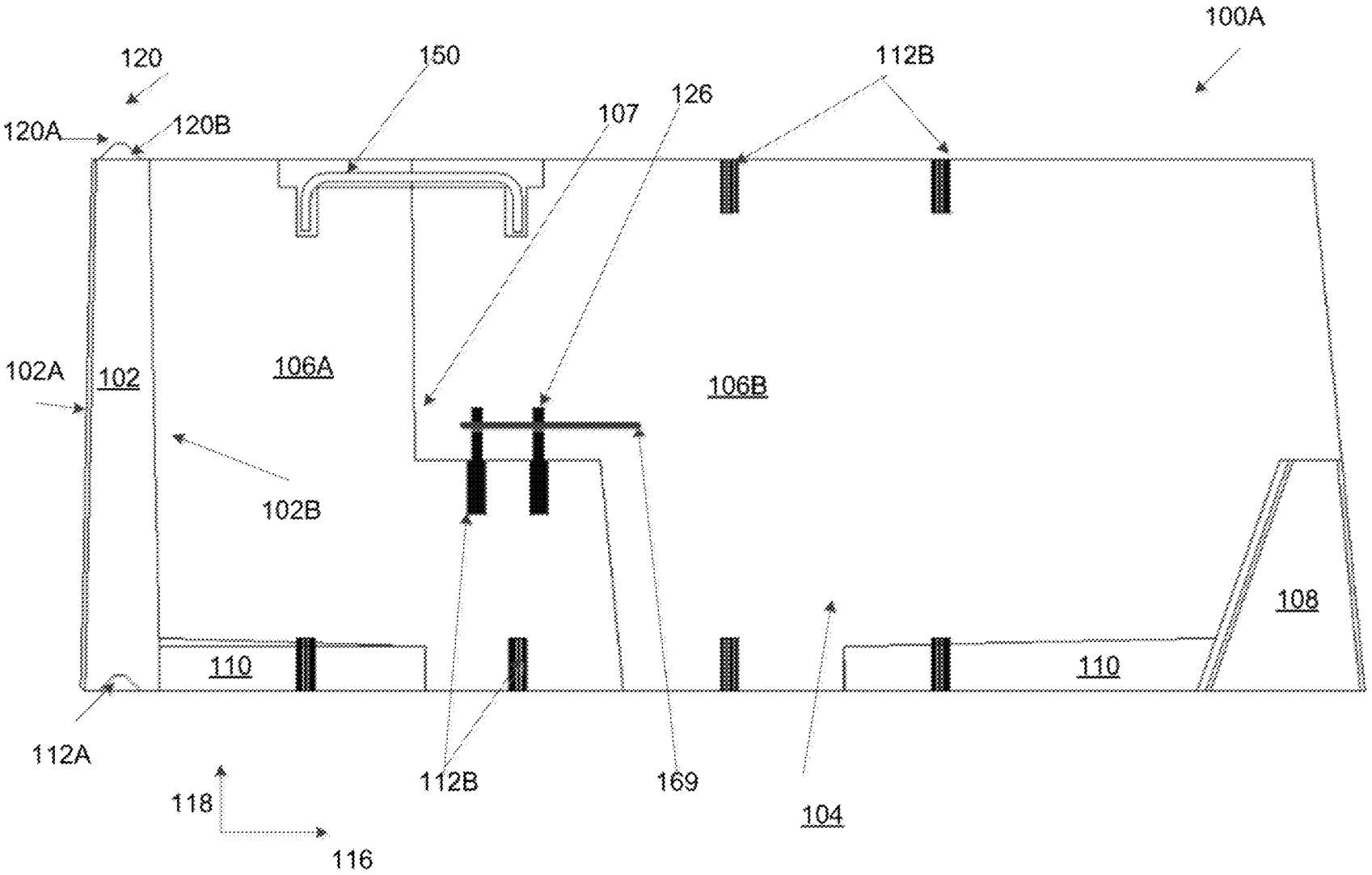
FIG. 12 is a cross-sectional side view of the modular building element of FIG. 1, following assembly of the building element.

In another optional configuration, and as shown in FIGS. 1-6, the face panel 102 can also comprise at least one projection 120 extending outwardly from one of a top surface 102C or a bottom surface 102D of the face panel. Additionally, or alternatively, as shown in FIG. 12, the face panel 102 can define at least one inwardly recessed notch or slot 112A. In exemplary aspects, the face panel can comprise a plurality of projections 120 extending outwardly from the top surface 102C and a plurality of notches or slots 112A defined within the bottom surface 102D of the face panel 102. Additionally, or alternatively, the face panel can comprise a plurality of projections 120 extending outwardly from the bottom surface 102D and a plurality of notches or slots 112A defined within the top surface 102C of the face panel 102. In use, each notch or slot 112A can be configured to receive a corresponding projection of an adjacent face panel (upper or lower) when a retaining wall 300 is constructed as disclosed herein. Optionally, when the top or bottom surfaces 102C, 102D of the face panel 102 comprise both projections 120 and notches or slots 112A, it is contemplated that each slot of the face panel can be axially spaced from each projection of the face panel relative to the first axis 114.

Figure 13:
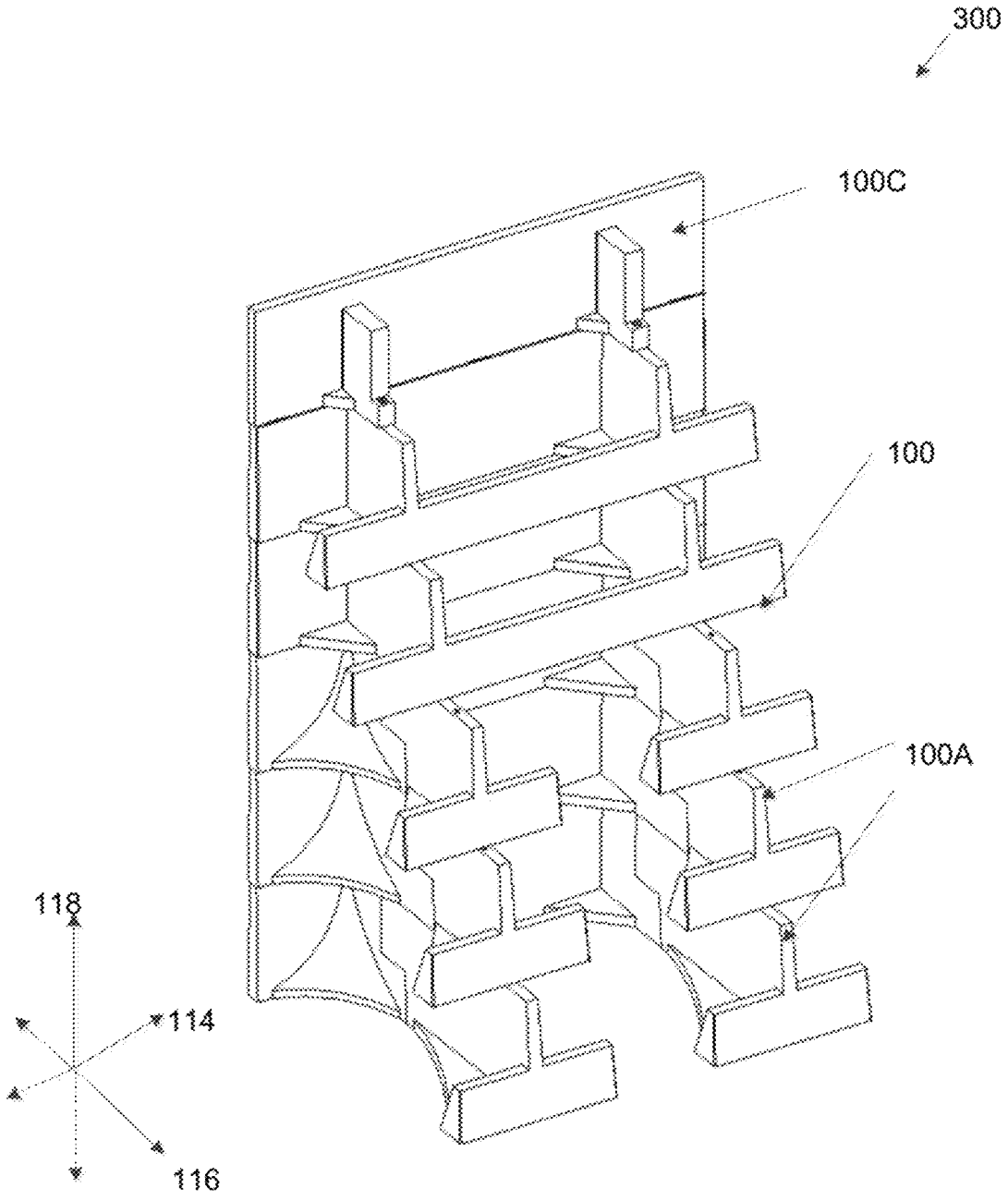
FIG. 13 is a rear perspective view of a retaining wall constructed of exemplary building elements as disclosed herein. As shown, a portion of the building elements have reinforcement wings with curved or arcuate profiles, while a second portion of the building elements have reinforcement wings with straight profiles. Additionally, the building elements have back sections of various constructions.

In use, it is contemplated that the projections 120 and notches or slots 112A can be used as engagement features to further stabilize the face panel 102. For example, engaging the face panels 102 of respective panels during retaining wall construction can reduce movement of the face panels along the second axis 116. Optionally, it is contemplated that the projections 120 can be oriented perpendicularly or substantially perpendicularly to the first plane (and extend parallel or substantially parallel relative to the third axis 118). In a further aspect, a portion of the top or bottom surface of the face panel can be coplanar of the first plane comprising the first axis 114 and the second axis 116. Optionally, in exemplary aspects, and as shown in FIG. 1, the projections 120 can comprise a base surface 120B coupled to the top surface 102C or bottom surface 102D of the panel 102 and an apex or apex surface 120A that is spaced outwardly from the base surface 120B relative to the third axis 118. For example, it is contemplated that the projection 120 can optionally comprise a pyramid or dome type structure, with the apex 120A corresponding to the minimal diameter portion of the projection and the base surface 120B corresponding to the maximal diameter portion of the projection. In yet another example, the projection 120 can define an apex surface 120A as opposed to a true apex, such as a tip. In this example, it is contemplated that a variety of shapes for the projection are possible, including, for example and without limitation, a rhomboid shape, a conical frustum, a rectangular prism, a cylinder, and the like. During the construction of a face panel 102 comprising a projection 120 or a notch or slot that is configured to receive a projection, a mold can be formed to have a corresponding indentation that defines a projection 120 in one or more surfaces of a face panel as disclosed herein. Similarly, it is contemplated that the mold can define a projection or protrusion that is configured to form a notch a slot in one or more surfaces of a face panel as disclosed herein. In use, the projection 120 can be configured to increase the stability of the retaining wall when building elements 100 are stacked upon each other. For example, in another aspect, as shown in FIG. 13, a notch, slot, or other alignment void 112 can be defined by a top surface 102C or bottom surface 102D of the face panel 102, and each alignment void 112 can be configured to receive a corresponding projection 120 as disclosed herein.

As discussed earlier, the building element 100 can comprise a beam member 104, which can comprise a length dimension oriented along the second axis 116, a width dimension oriented along the first axis 114, and a height dimension oriented along the third axis 118. In exemplary aspects, the beam member 104 can comprise a brace section 106 that is mechanically coupled or secured to the rear surface 102B of the face panel 102. Optionally, it is contemplated that at least a portion of the beam member can be integrally formed with the face panel 102. In further aspects, the beam member 104 can comprise a back section 108 that has a length dimension along the first axis 114 such that it is perpendicular or substantially perpendicular to the brace section 106. Optionally, it is contemplated that the back section 108 can be integrally formed with a rear portion of the brace section 106. Alternatively, it is contemplated that the brace section 106 and the back section 108 can be formed separately and mechanically coupled or attached.

Figure 2:
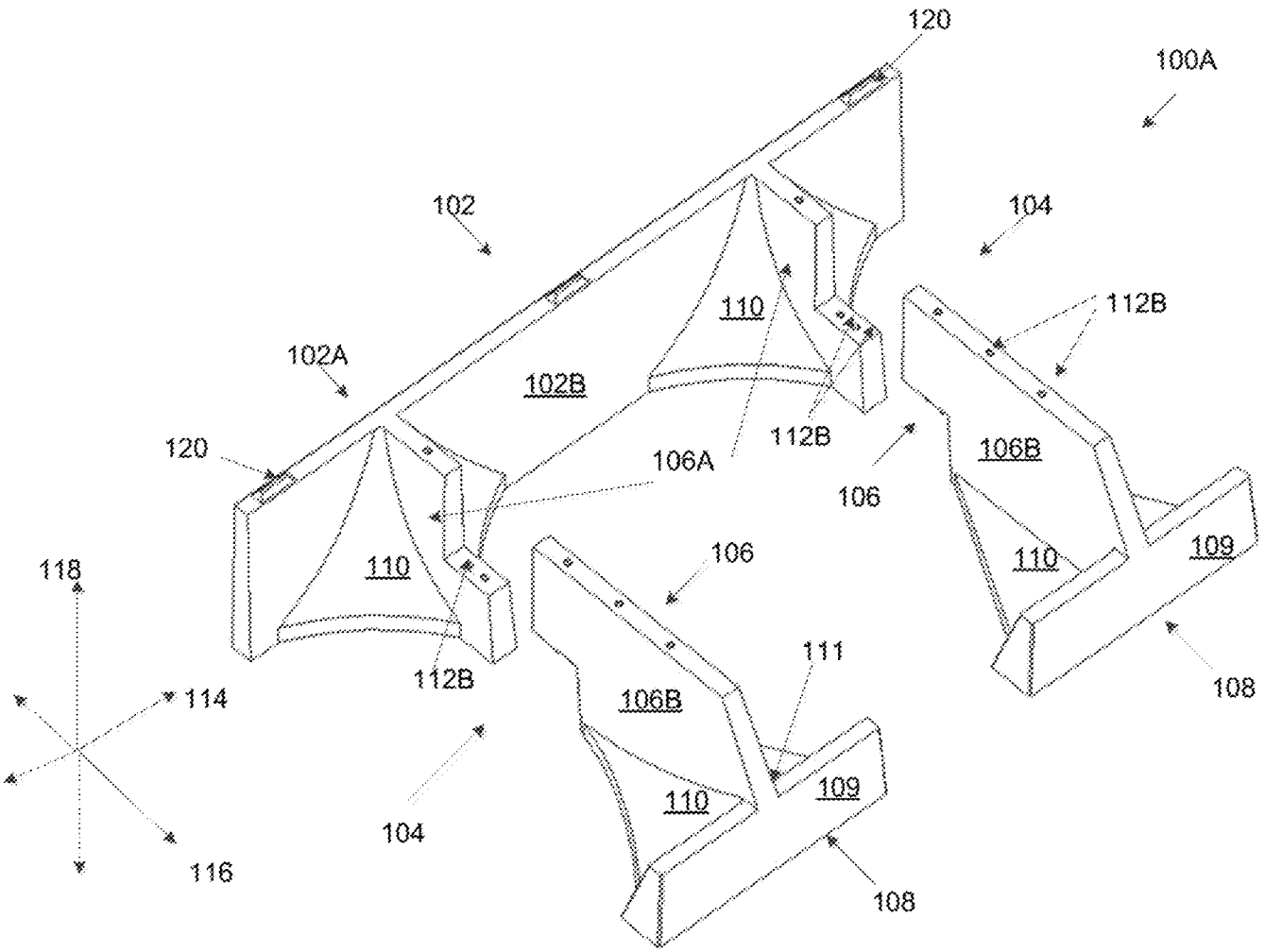
FIG. 2 is a rear perspective view of an exemplary modular building element having a plurality of beam members as disclosed herein.
Figure 3:
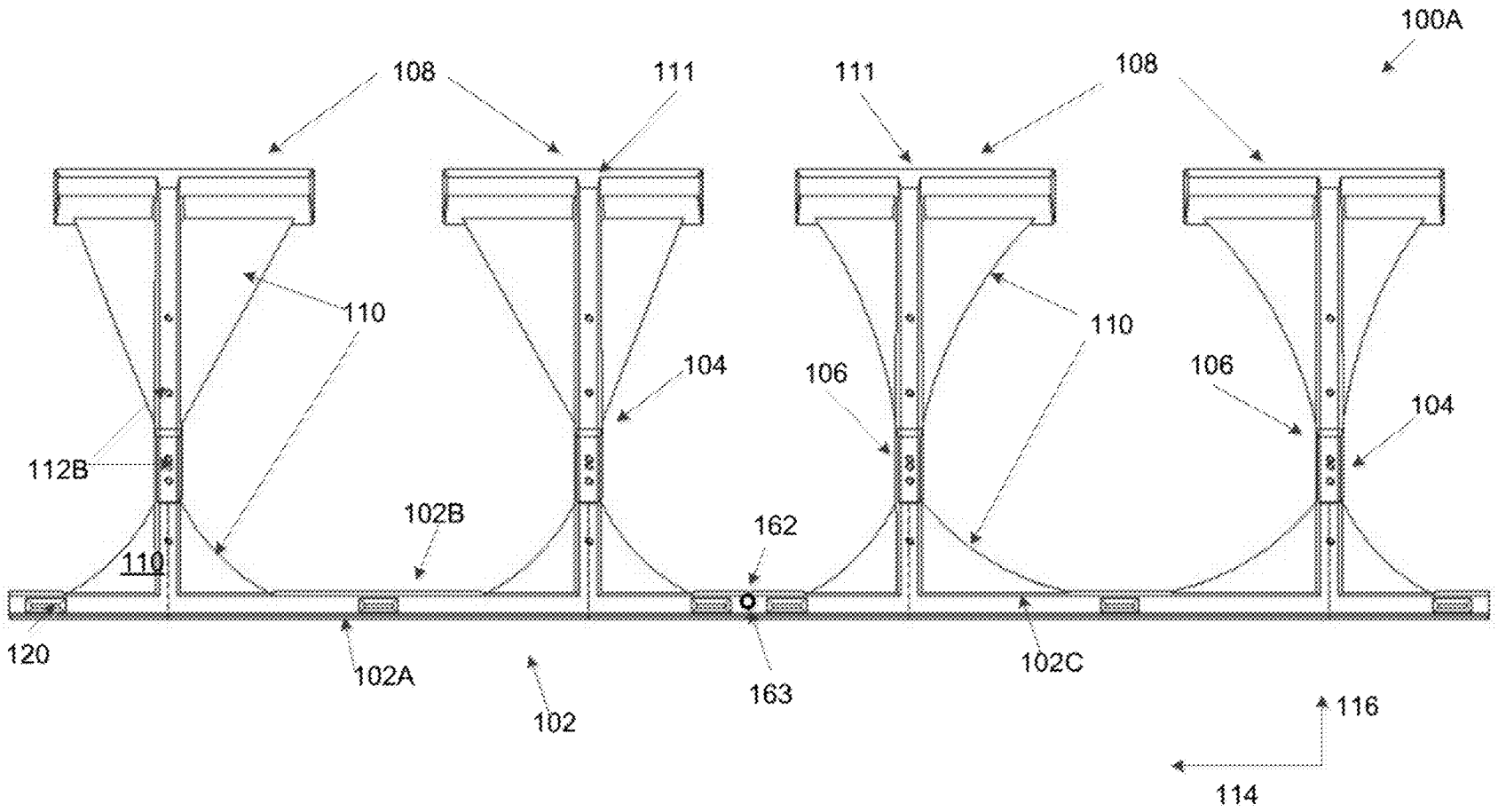
FIG. 3 is a top view of a plurality of building elements with reinforcer en wings of varying dimensions and varying cross sectional areas.

Optionally, as shown in FIGS. 1-2, it is contemplated that the back section 108 can have a trapezoidal cross-sectional shape, although alternative shapes are possible. In general, the length dimension of the brace section 106 and length dimension of the back section 108 are perpendicular with respect to one another to provide stability and balance. In an aspect, the back section 108 can have a length dimension ranging from about 4 ft. to about 30 ft., from about 6 ft. to about 20 ft., or from about 7 ft. to about 10 ft. Optionally, the back section can have a length dimension of about 8 ft. It is further contemplated that the dimensions of the face panel 102, beam member 104 and back section 108 can further vary to accommodate the mode of transportation. More particularly, it is contemplated that the length dimensions of the face panel 102, beam member 104, and back section 108 can be selected to maximize efficiency in shipment or transport. For example, during shipment of building elements 100 on a tractor trailer with a towing bed length of 50 to 55 feet, it is contemplated that the length dimensions of the face panel 102, the beam member 104, and the back section 108 can be selected such that the length dimension of the beam member does not exceed the width of the towing bed and the length dimensions of the face panel 102 and the back section 108 are sufficiently small that the towing bed can accommodate at least two building elements along its length.

As depicted in FIG. 1, a top surface of the brace section 106 extends higher along the third axis 118 than the top surface of the back section 108. In addition, the trapezoidal cross section of the back section 108 can comprise a back surface 109 oriented at an angle relative to the third axis 118. In a further aspect, this back surface 109 can be coplanar or substantially coplanar with a rear surface 106C of the beam member. The angled orientation of surfaces 109 and 106C, in addition to the. top surface of the back section 108, can define an engagement surface for engagement with the extension element 200 depicted in FIG. 8 and further described herein.

Referring to FIGS. 3-6, the length dimension of the back section 108 can be divided at a coupling junction 111 positioned at the intersection of the back section and the brace section 106. As depicted, it is contemplated that the back portion 108 can be asymmetric relative to the coupling junction 111, with unequal lengths of the back portion positioned on opposing sides of the coupling junction. Alternatively, the back portion 108 can be symmetric relative to the coupling junction 111, with equal or substantially equal lengths of the back portion positioned on opposing sides of the coupling junction. The symmetry or asymmetry of the back section 108 relative to the coupling junction 111 can be adjusted to account for variations in the underlying earth. Similarly, it is contemplated that the front panel of each building element can either be symmetric or asymmetric relative to the junction between the beam member and the front panel.

In an aspect, the beam member 104 can have a length dimension ranging from about 3 ft. to about 14 ft., from about 4 ft. to about 12 ft., or from about 5 ft. to about 10 ft. Optionally, the beam member can have a length dimension of about 8 ft. In an aspect, the beam member 104 can have a height dimension ranging from about 3 ft. to about 9 ft., from about 4 ft. to about 8 ft., or from about 5 ft. to about 7 ft. Optionally, the beam member 104 can have a height dimension of about 6 ft. In a further aspect, the beam member 104 can have a width dimension ranging from about 3 in. to about 9 in., from about 4 in to about 8 in., or from about 5 in. to about 7 in. Optionally, the beam member 104 can have a width of about 6 in.

In various aspects, and with reference to FIGS. 3-6, each building element 100 can further comprise at least one reinforcement wing 110. In these aspects, each reinforcement wing 110 can comprise a member that strengthens the coupling between the beam member 104 and either the face panel 102 or the back portion 108. Functionally, the reinforcement wing 110 can increase structural integrity of the building element 100 by preventing the face panel 102 or the back portion 108 from being bent by internal earth load pressures. Structurally, a reinforcement wing 110 can be operably coupled or secured to the rear surface 102B of the face panel 102 and a side surface of the brace section 106 of the beam member 104. Similarly, it is contemplated that a reinforcement wing 110 can be operably coupled or secured to a front surface of back portion 108 and a side surface of the brace section 106 of the beam member. In exemplary aspects, reinforcement wings can be provided in pairs, with a first reinforcement wing 110 positioned on a first side of the beam 104 relative to first axis 114 and a second reinforcement wing 110 positioned on a second, opposite side of the beam relative to the first axis, thereby providing additional stability. For example, the at least one reinforcement wing can comprise a first pair of reinforcement wings that extend, respectively, from opposite sides of the beam 104 to contact portions of the face panel 102 or the back portion 108 that are positioned on opposing sides of the beam relative to the first axis 114. Optionally, it is contemplated that the at least one reinforcement wing 110 can comprise first and second pairs of reinforcement wings, with a first pair of reinforcement wings extending, respectively, from opposite sides of the beam 104 to contact portions of the face panel 102 that are positioned on opposing sides of the beam relative to the first axis 114, and with a second pair of reinforcement wings extending, respectively, from opposite sides of the beam 104 to contact portions of the back portion 108 that are positioned on opposing sides of the beam relative to the first axis 114.

In exemplary aspects, it is contemplated that the reinforcement wings of each pair of reinforcement wings can be symmetrical relative to the beam 104. However, in other exemplary aspects and as shown in FIGS. 3-6, it is contemplated that the reinforcement wings of each pair of reinforcement wings can be asymmetrical relative to the beam 104. In various aspects, it is contemplated that each reinforcement wing 110 can have a width dimension relative to the first axis 114 and a length dimension relative to the second axis 116. Optionally, in these aspects, the reinforcement wings of a pair of reinforcement wings can have different width dimensions while maintaining substantially equal length dimensions. In further exemplary aspects, when the reinforcement wings of a pair of reinforcement wings have curved or arcuate side surfaces that define a curve or arc within the primary plane, it is contemplated that each side surface can have a respective radius of curvature. Optionally, in these aspects, the side surfaces of the reinforcement wings of the pair of reinforcement wings can have an equal radius of curvature; alternatively, in asymmetrical configurations, it is contemplated that the side surfaces of the reinforcement wings can have different radii of curvature.

Figure 4:
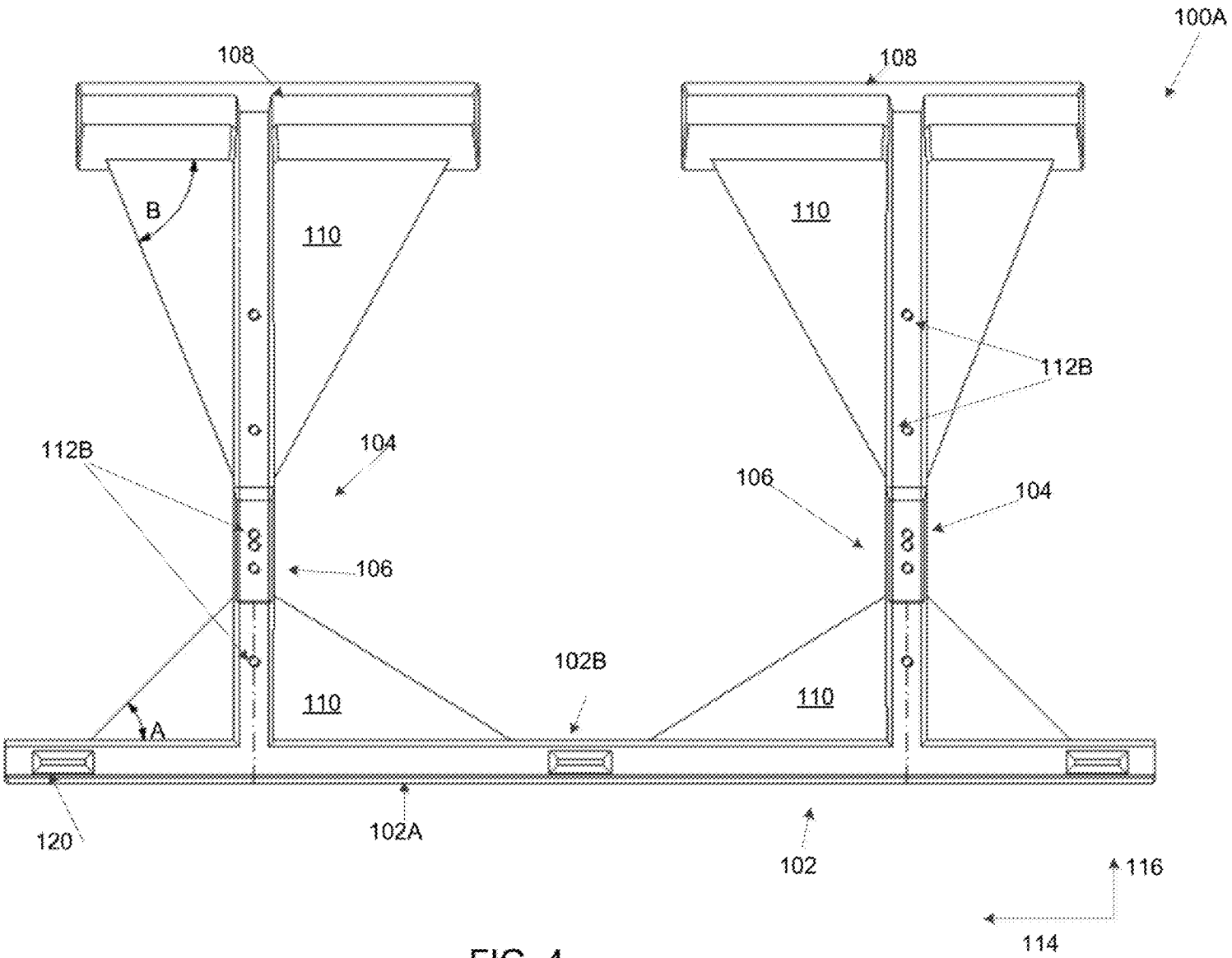
FIGS. 4-6 are close-up top views of a plurality of building elements with reinforcement wings of varying dimensions and varying cross sectional areas.
Figure 5:
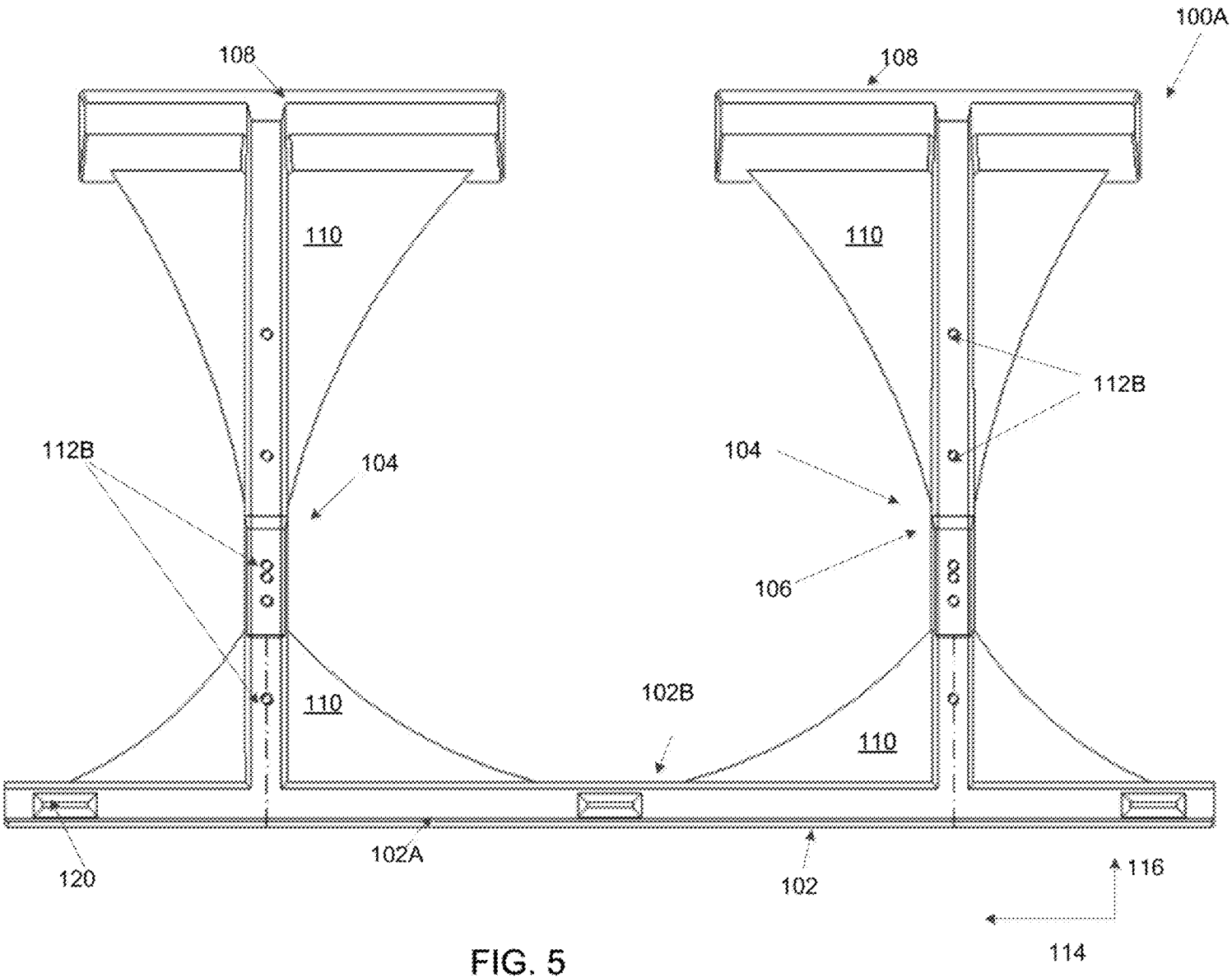
Figure 6:
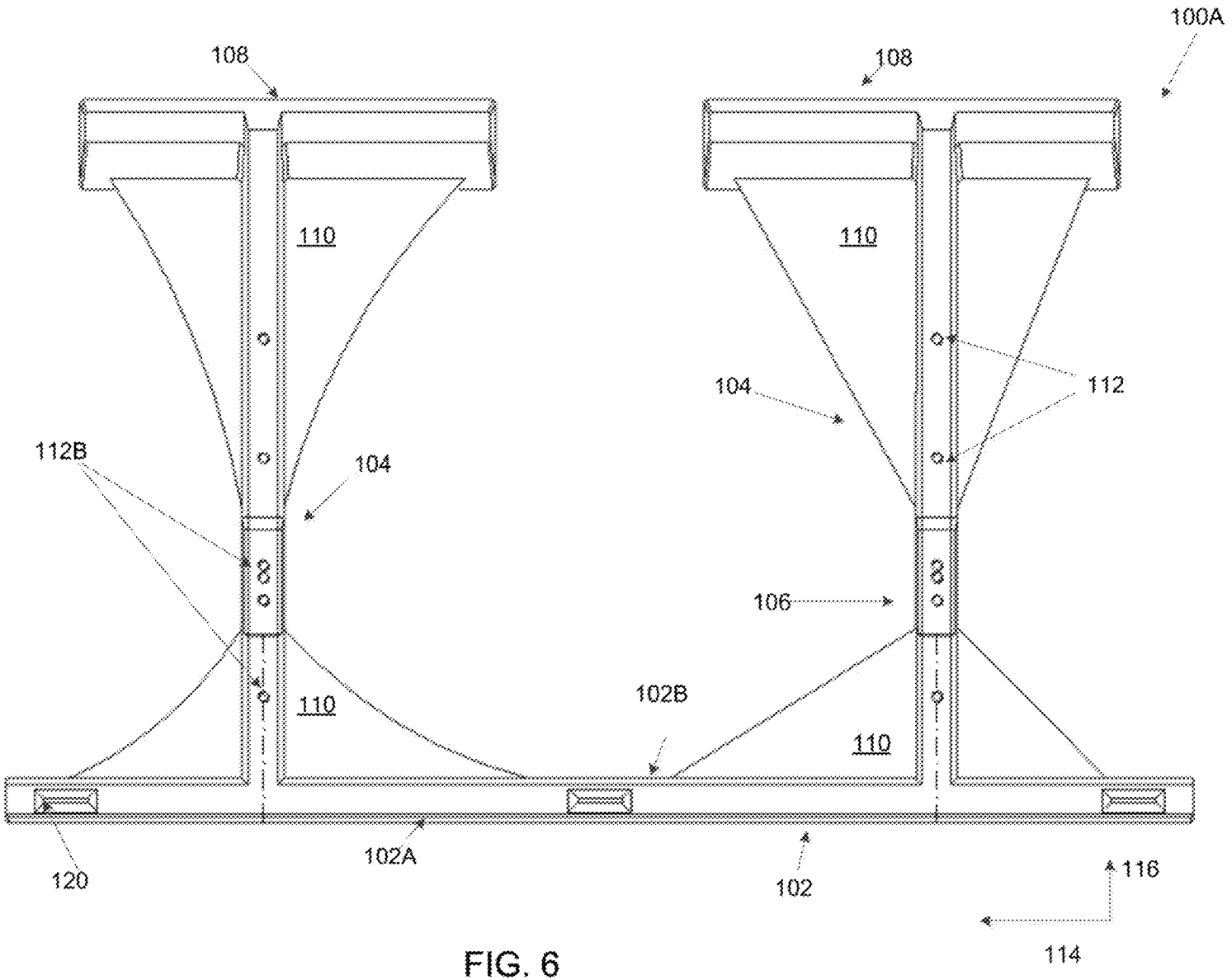
Figure 7:
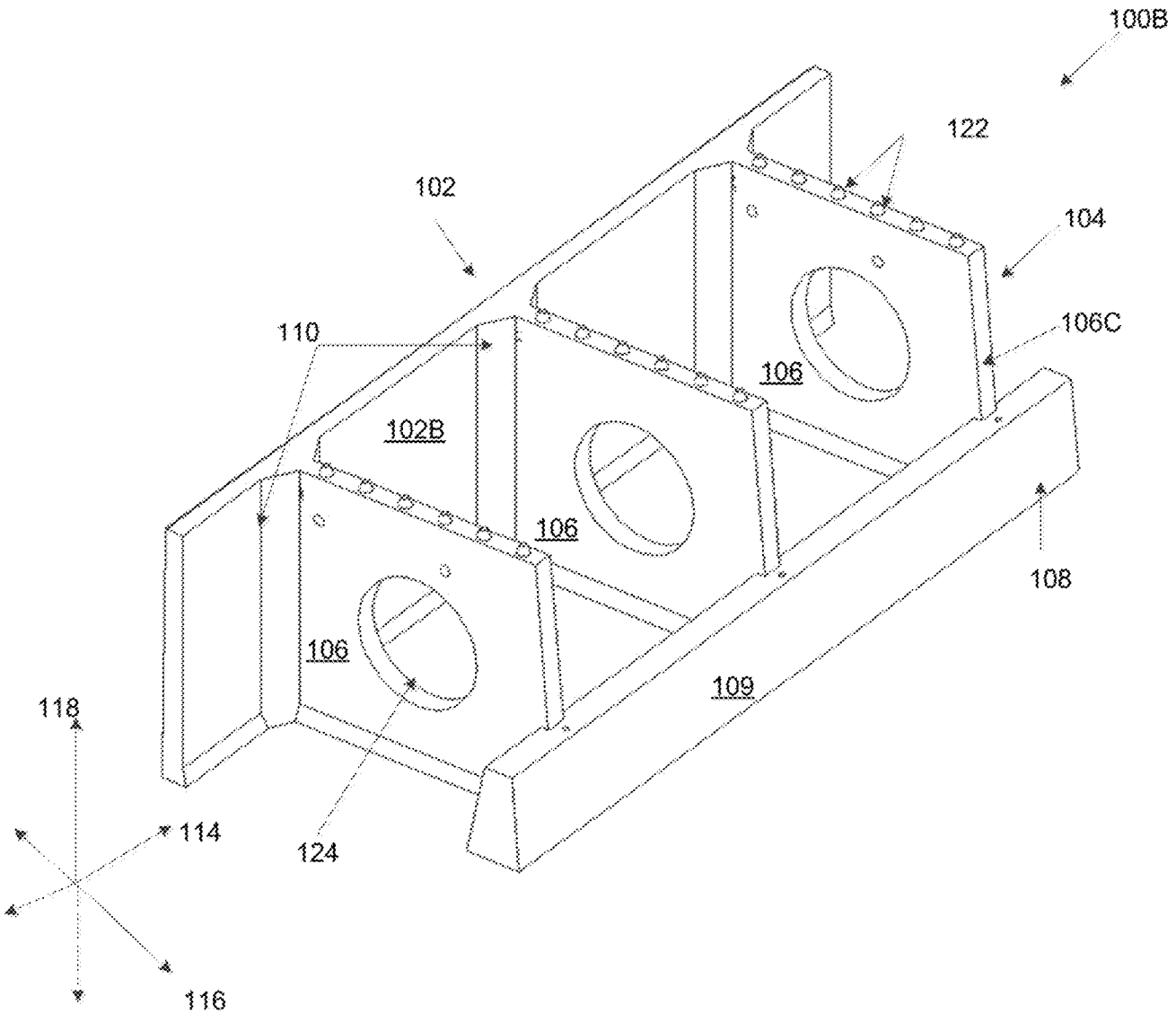
FIG. 7 is a rear perspective view of an exemplary building element having a plurality of beam elements that define apertures as disclosed herein.
Figure 9:
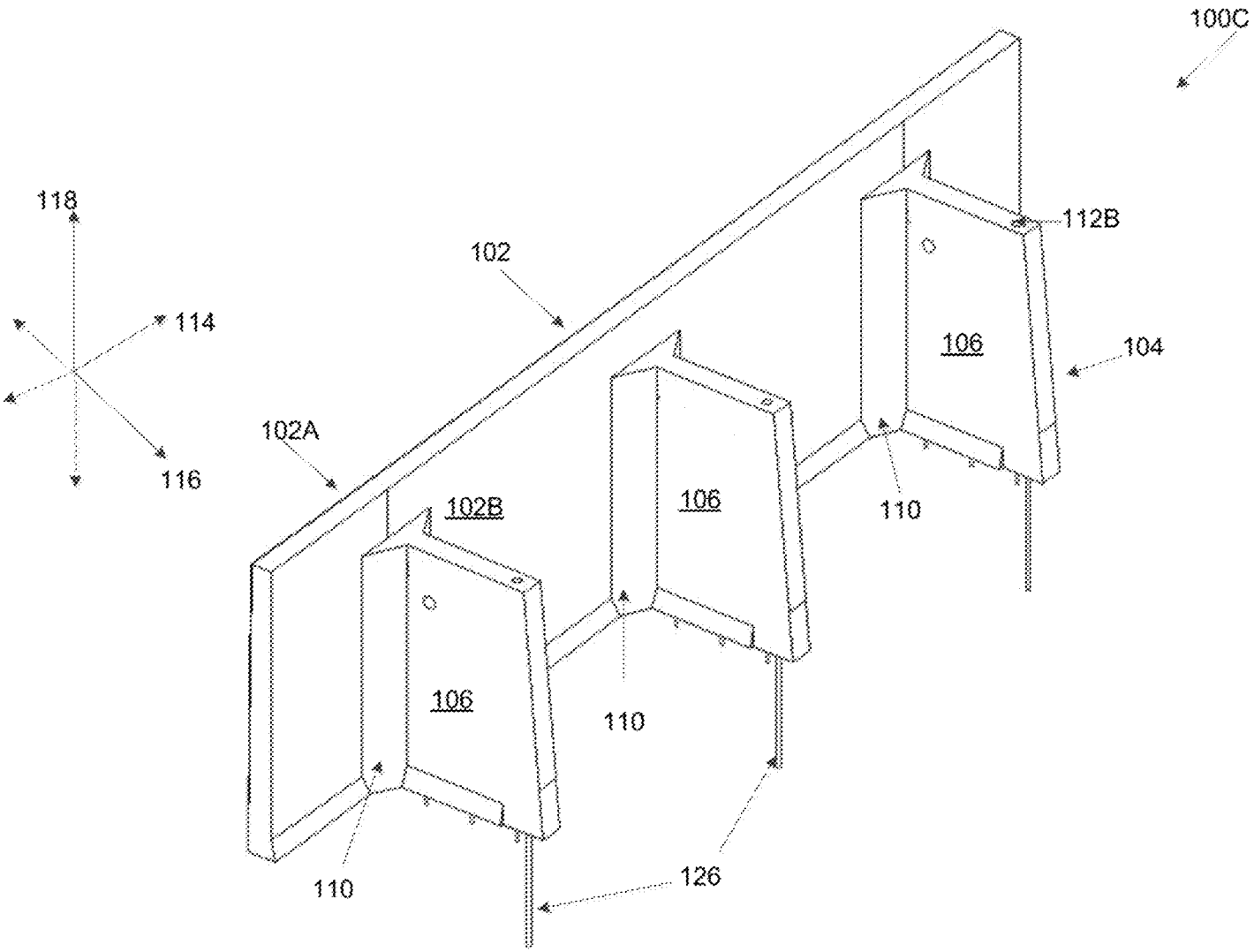
FIG. 9 is a rear perspective view of an exemplary building element having beam elements with securing rods as disclosed herein.

Optionally, each reinforcement wing can have a triangular shape; however, other geometric shapes are possible. For example, as shown in FIGS. 1 and 2, the reinforcement wings 110 extending between the beam 104 and the face panel 102 can have an arcuate profile with a variable cross-sectional area relative to the third axis 118, such as an arcuate profile including a curved or arcuate side surface (e.g., a concave side surface) and a curved or arcuate upper surface (e.g., a concave upper surface), which can optionally extend upwardly from the side surface and taper inwardly until reaching the top surfaces of the face panel and the beam at the junction between the face panel and the beam. In other examples, it is contemplated that the reinforcement wings 110 can define planar upper and lower surfaces and have a side surface that extends between the upper and lower surfaces and has either a straight orientation or a curved or arcuate orientation. In another aspect, as shown in FIGS. 7 and 9, each reinforcement wing can comprise a triangular prism that extends along the height dimension of the beam and has a uniform cross sectional area along the third axis 118. As shown in FIGS. 4-6, the respective top views of the reinforcement wings 110 demonstrate a variety of triangular or arcuate profiles that can be used. In a further aspect, when a side surface of a reinforcement member extending from the beam to the back portion has a straight orientation (defining a reinforcement member with a generally triangular shape), it is contemplated that the side surface can define an angle A relative to first axis 114. Similarly, when a side surface of a reinforcement member extending from the beam to the face panel has a straight orientation (defining a reinforcement member with a generally triangular shape), it is contemplated that the side surface can define an angle B relative to first axis 114. For example, the angle A or B of reinforcement wings 110 can range between about 30 degrees and about 75 degrees, between about 45 degrees and about 60 degrees, or between about 50 degrees and about 55 degrees. Optionally, the angles A or B can be about 45 degrees.

Exemplary Building Element Dimensions

In an aspect, the face panel 102 can have a length dimension ranging from about 26 ft. to about 18 ft., from about 24 ft. to about 20 ft., or from about 23 ft. to about 21 ft. Optionally, the face panel can have a length dimension of about 22 ft. In an aspect, the face panel can have a height dimension ranging from about 9 ft. to about 3 ft., from about 8 ft. to about 4 ft., or from about 7 ft. to about 5 ft. Optionally, the face panel can have a height dimension of about 6 ft. In a further aspect, the face panel can have a width dimension ranging from about 9 in. to about 3 in., from about 8 in. to about 4 in. or from about 7 in. to about 5 in. Optionally, the face panel can have a width of about 6 in. In a further aspect, the face panel can have a surface area defined by the length and height dimension ranging from about 235 sq. ft to about 54 sq. ft, from about 192 sq. ft to about 80 sq. ft, or from about 161 sq. ft to about 105 sq. ft. Optionally, the face panel 102 can have a surface area of about 132 sq. ft. It is further contemplated that the size of the face panel in this disclosure can be about 3.3 to about 16 times larger than traditional building elements where the respective panels range from 8 sq. ft. to 40 sq. ft. It is also further contemplated that the size of the disclosed building elements 100A-C and 200 can increase the efficiency in building a retaining wall, by allowing for quicker wall construction and a reduction in the number of wall components needed to complete a wall assembly. The size of the building elements can also increase the structural integrity of a wall 300 as compared to traditional building elements.

Building Elements Having Beam Members with Detachable Brace Portions

In exemplary aspects, and with reference to FIGS. 1-6, 12, and 15, the brace section 106 of the beam 104 can comprise a first portion 106A and a second portion 106B that is selectively attachable and detachable from the first portion 106A. As shown in FIG. 1, the first portion 106A of the brace section 106 can be mechanically coupled or secured to the rear surface 102B of the face panel 102. Optionally, it is contemplated that the first portion 106A. can be integrally formed with the face panel 102, such as, for example and without limitation, in a single molding process. In use, it is contemplated that the first portion 106A can be used with a variety of second portions 1068 having different features, including, for example and without limitation, different lengths relative to the second axis 116, different constructions, different reinforcement wing arrangements, different back portion dimensions or structures, and the like. Similarly, it is contemplated that the second portion 106B can be used with a variety of first portions 106A having different features, including, for example and without limitation, different lengths relative to the second axis 116, different constructions, different reinforcement wing arrangements, different face panel dimensions or structures, and the like.

Figure 15:
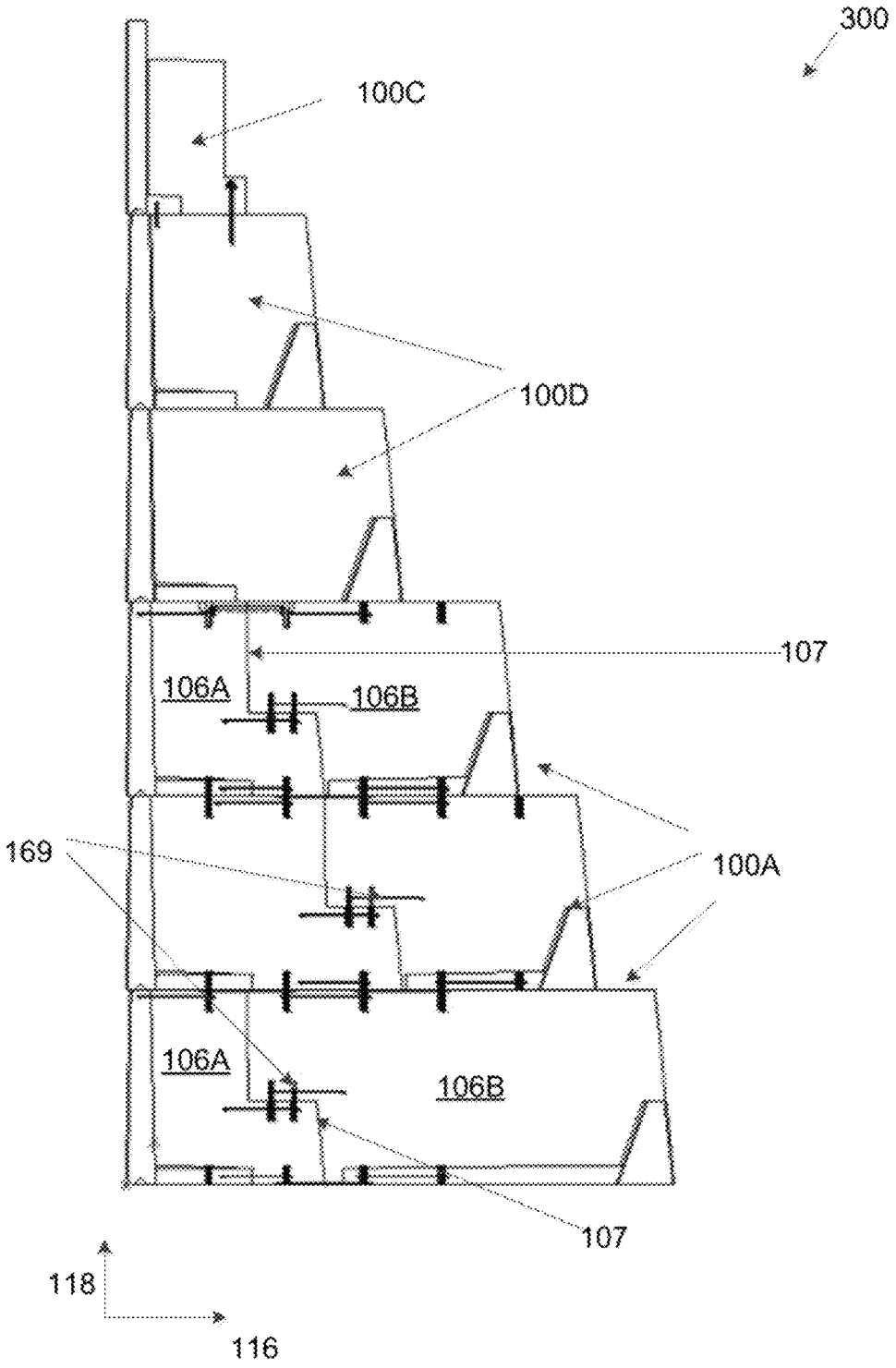
FIG. 15 is a cross-section pow of the retaining will depicted in FIG. 14.

In erecting a retaining wall, it is contemplated that the modularity provided by the detachable portions of the brace section can provide increased variability in the length dimension of the beam member 104 and provide a builder with additional flexibility in building element configurations to account for variations in the earth. In exemplary aspects, as shown in FIGS. 12 and 15, the first and second portions 106A, 106B of a brace section 106 can be securely attached to each other using at least one alignment post or securing rod 126 (optionally, a plurality of securing rods) as disclosed herein. Optionally, in these aspects, a front portion of the second portion 106B of the brace section 106 can be configured to overlie a rear portion of the first portion 106A of the brace section to permit attachment of the second portion to the first portion. For example, as shown in FIGS. 1-2 and 12, the first portion 106A can have a variable height moving along the second axis 116, with the first portion having a rear portion with a reduced height that defines a recess for receiving and engaging the front portion of the second portion 106B, which in turn can define a complementary recess that receives the rear portion of the first portion. When engaged together, the first and second portions 106A, 106B can cooperate to define a brace section 106 having a consistent height relative to the third axis 118. Optionally, an upper surface of the rear portion of the first portion 106A can define at least one alignment void 112B that is configured to receive a portion of an alignment post or securing rod 126 that extends downwardly from the front portion of the second portion 106B. In exemplary aspects, a plurality of securing rods 126 can span between the first and second portions 106A, 106B. In these aspects, it is contemplated that the securing rods 126 can be embedded within the second portion 106B. Alternatively, it is contemplated that the second portion 106B can define respective alignment voids that receive portions of the securing rods such that a portion of each securing rod is received within respective alignment voids of both the first and second portions 106A, 106B. In a further aspect, a reinforcement bar 169 can be embedded within the second portion 106B of the brace section 106 and coupled to the securing rods 126. The reinforcement bar 169 can increase the alignment and stability of the securing rods when the securing rods 126 are engaged to alignment voids 112B located at the joint 107 between the brace sections 106A, 106B.

Building Elements Having Beam Members that Define Horizontal Apertures

In another aspect, as depicted in FIG. 7, a surface of the brace section 106 can define an aperture 124 that surrounds an axis that is parallel to the first axis 114. The aperture 124 can be used as a conduit to allow backfill comprising filler materials to pass through the beam member and allow for more consistent filling during erection of the wall. In exemplary non-limiting aspects, the aperture can have a cross-sectional area ranging from about 1 sq. ft. to about 10 sq. ft., from about 2 sq. ft. to about 9 sq. ft. or from about 3 sq. ft. to about 8 sq. ft. Optionally, the cross sectional area can be about 5 sq. ft. The aperture 124 can also reduce cost and weight of the building element by reducing the amount of concrete needed to form the respective elements. The aperture can further provide additional engagement features to allow a crane or moving apparatus to grab the building element for transport. During erection of the wall, the apertures 124 can serve as conduits to pass utilities or communications lines and also allow for movement of workers among different sections of the wall assembly before filler materials have been delivered. The filler materials 166 can comprise earthen materials such as dirt, sand, gravel, rocks, sand, or the like. In use, the apertures 124 can help the building element maintain consistent contact with the filler material 166, thereby providing increased stability.

As shown in FIG. 7, the building element 100B can also comprise an alignment post 122, which can extend downwardly from the building element 100B and function in a similar manner to projections 120.

Extension Elements

Figure 8:
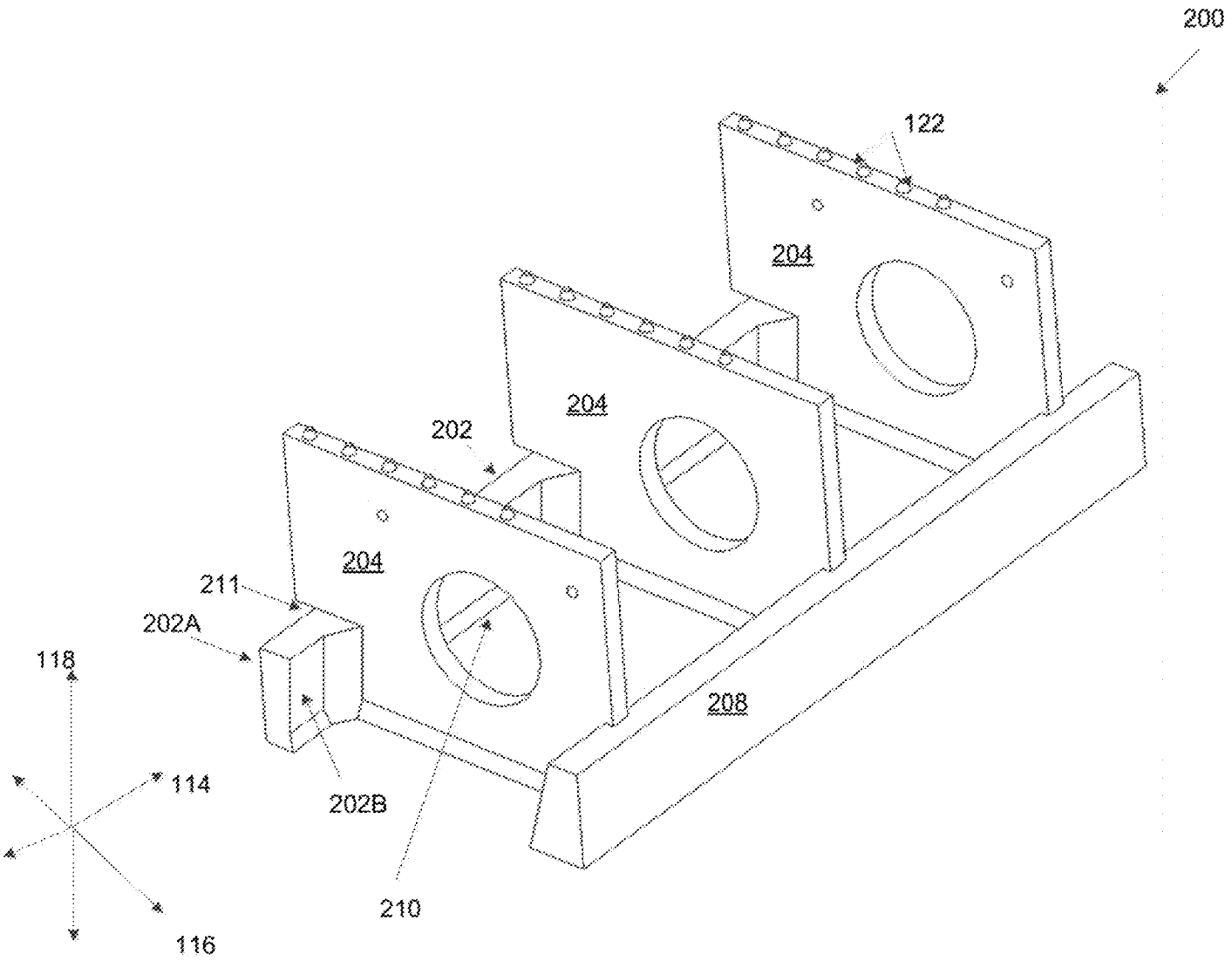
FIG. 8 is a rear perspective view of an exemplary extension element that is configured for connection to a building element as disclosed herein.

As shown in FIG. 8, an extension element 200 can be configured to be coupled to the exemplary building element 100B in FIG. 7. The extension element 200 can be configured to align and reinforce the stability of building element 100B. In particular, the beam members 204 can be aligned with the beam members 104 of the building element 100. In addition, a front surface 202A of the face panel 202 of the extension element 200 can serve as a mating panel to the rear surface 109 of building element 100B. Abutting the extension element 200 with the building element 100B can increase the stability of the resulting wall by increasing the distance from the face panel 102 along the second axis 116. In a further aspect, the beam member 204 can overlap the face panel 202 along the length dimension of the beam member 204 (relative to the second axis 116). The overlap portion 211 of the beam member 204 can rest on a top surface of the back member 108 of building element 100B while the front surface 202A can abut against the slanted surface defined by the rear surfaces 106C of the brace section and the rear surface 109 of the back section. In a further aspect, the beam member 104 and the beam member 204 can be collinear or substantially collinear along the length dimension along the second axis 114. In yet a further aspect, the extension element 200 can also have alignment posts 112 and corresponding alignment voids, which can be configured to extend along the third axis 118 when in use. In an aspect, the extension member 200 can have a length dimension relative to the second axis 116 ranging from about 2 ft. to about 8 ft., from about 3 ft. to about 7 ft., or from about 4 ft. to about 6 ft. Optionally, the extension member 200 can have a length dimension of about 4 ft.

In exemplary aspects, it is contemplated that the extension beam elements 204 can define apertures 210 that function in the same way as, and are similarly dimensioned to, the apertures 124 of the beam members 104 of building element 100B.

Alignment Posts

Figure 10:
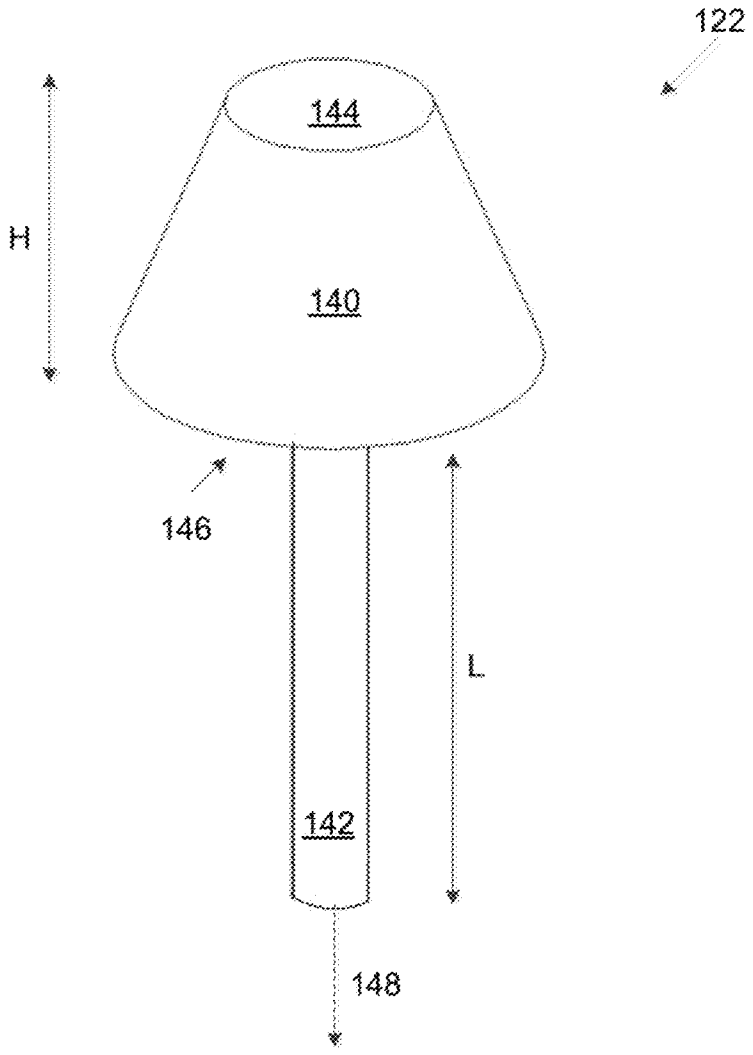
FIG. 10 is an isometric view of an exemplary alignment post as disclosed herein.
Figure 11:
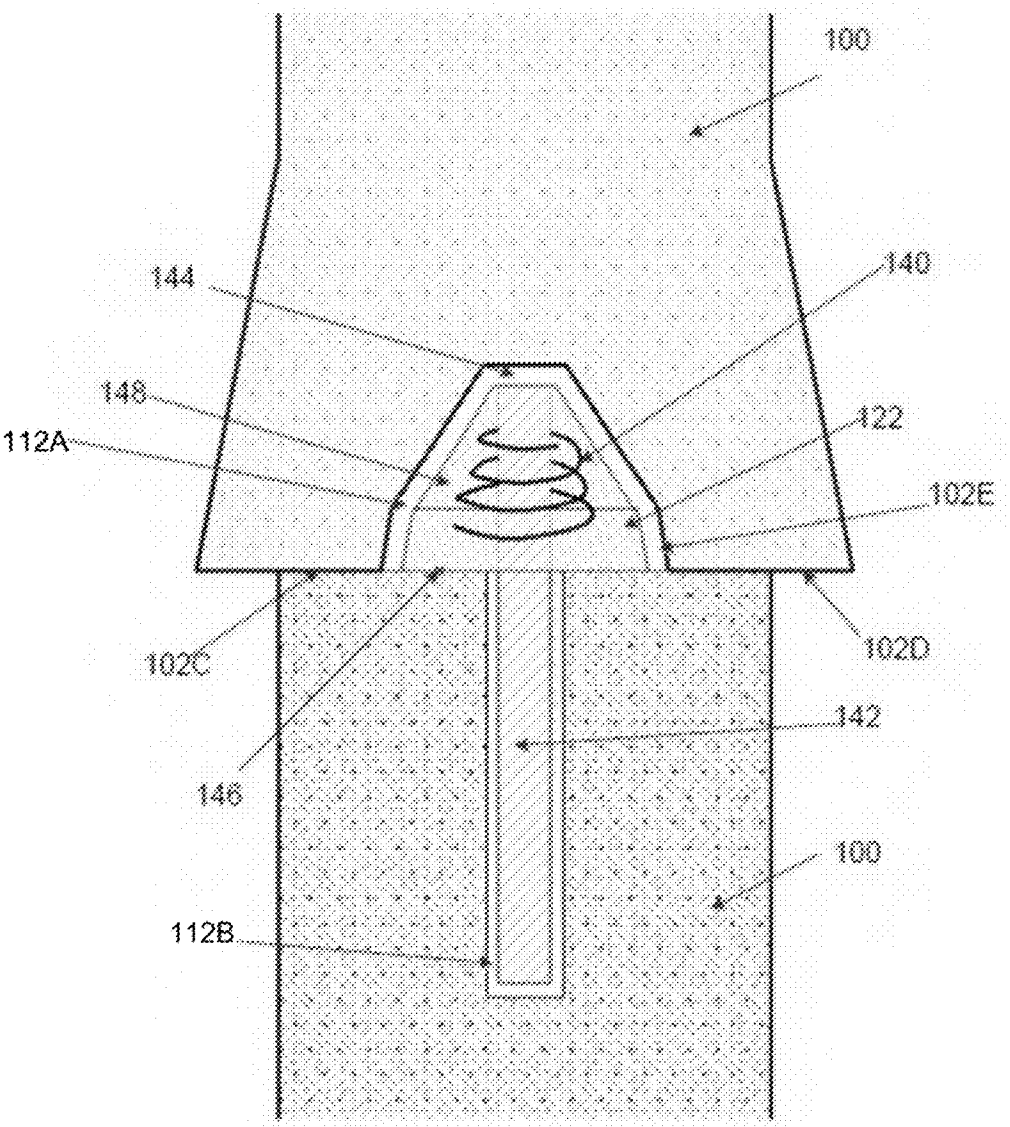
FIG. 11 is a cross-sectional end view of an exemplary engagement between the beam elements of two adjacent (vertically stacked) building elements with an alignment post as disclosed herein.

FIG. 10 depicts an exemplary aspect of an alignment post 122. The alignment post 122 can comprise two components, a stem 142 and a cap 140. During construction of the alignment post 122, the stem 142 can be inserted into a mold filled with a setting material to form the cap 140. The setting material can be concrete or the like. The cap 140 can comprise a height dimension H that is associated with the amount of the cap that will be received within an alignment void 112 of another building element 100 during erection of a retaining wall as disclosed herein.

In a further aspect, the cap 140 can be shaped like a frustum having a top surface 144 and a bottom surface 146. The stem 142 can comprise a stem axis 148 oriented along a length dimension L of the stem 142. In another aspect, the stem axis 148 can be perpendicular or substantially perpendicular to a portion of the bottom surface 141 of the cap 142. The bottom surface 146 of the cap 140 can abut the top surface of the beam. In a further aspect, the portion of the stem extending downardly from the bottom surface of the cap 140 can have a length L ranging from about 3 in. to about 10 in., from about 4 in. to about 8 in. or from about 5 in. to about 7 in. Optionally, the length (L) of the exposed stem portion can be about 5 in. In a further aspect, the width of the stem 142 can range from about 1 in. to about 3 in., from about 1.25 in. to about 2.75 in. or from about 1.5 in. to about 2.5 in. Optionally, the width of the stem can be 2.5 in. In a further aspect, the height H of the cap 140 can range from about 1.75 in. to about 3.25 in., from about 2.0 in. to about 3.0 in. or from about 2.25 in. to about 2.75 in. Optionally, the height of the cap can be about 2.5 in. In a further aspect, the width (outer diameter) of the base 146 of the cap 140 can range from about 1.75 in. to about 3.25 in., from about 2.0 in. to about 3.0 in. or from about 2.25 in. to about 2.75 in. Optionally, the width of the base of the cap can be about 2.8 in.

Optionally, when the alignment post 122 is engaged to the alignment void, there can be a clearance space of 0.25 in. between an inner surface 102E that defines the alignment void 112 and the outer surface of the cap 140.

As shown in FIG. 10, in a further aspect, the cap 142 can be strengthened using reinforcement material 149 such as a metal or plastic material embedded within the setting material. During erection of a retaining wall system, the alignment post 122 can be placed in the alignment void 112 defined by a surface of a respective beam member of a building element 100. As the stem 140 is set within the alignment void 112 of the respective beam member 104 the cap 142 will be the portion of the alignment post 122 protruding away from the surface of the beam 104.

In an alternative aspect, the stem 140 can comprise multiple materials. For example, an outer layer that circumscribes the stem axis 148 can comprise a plastic material such as polyethylene. An inner material for the stem 148 can be a metal bar that serves as a reinforcement of the plastic outer layer.

Securing Rods

Figure 16:
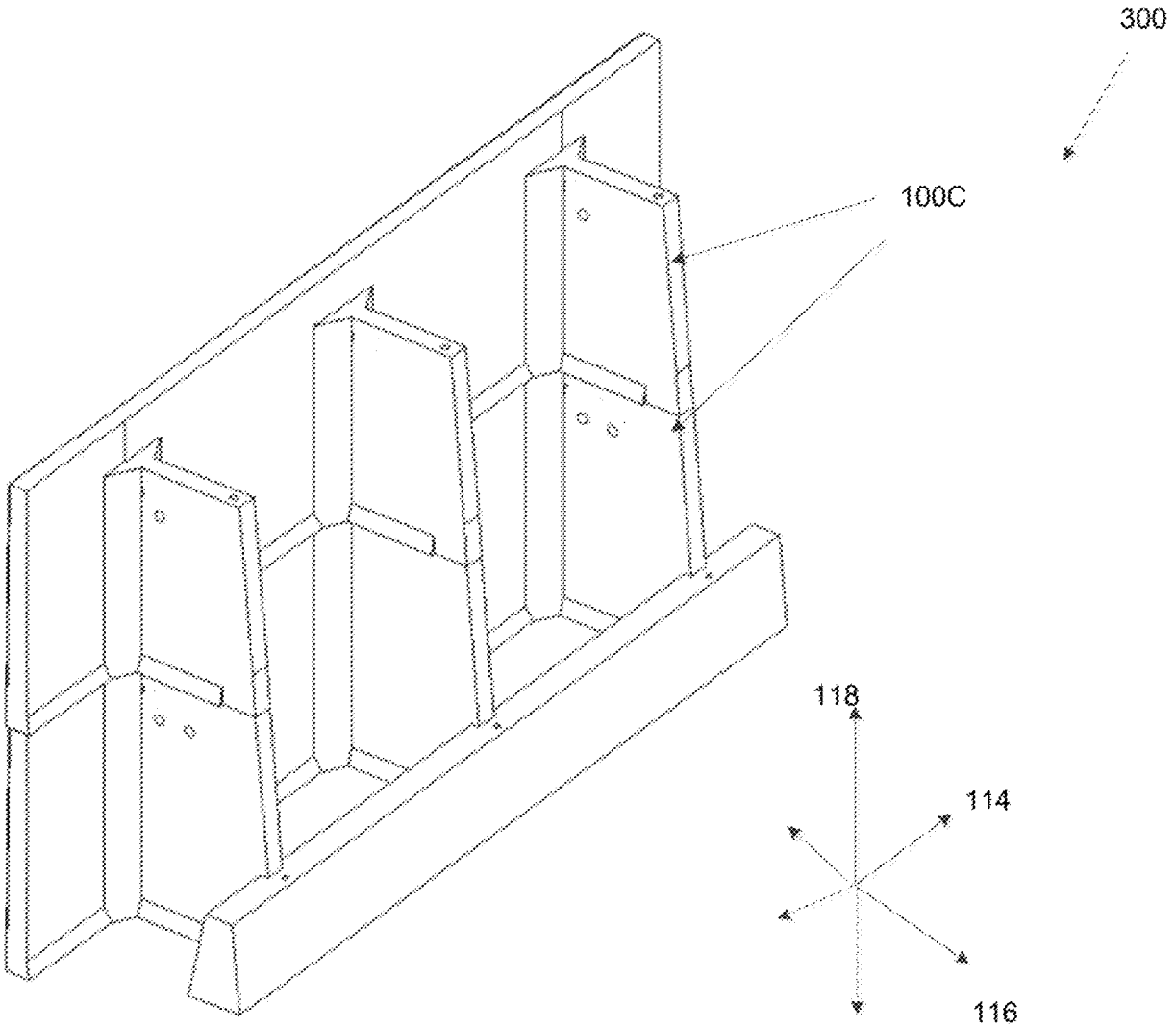
FIG. 16 is a rear perspective view of a retaining wall constructed of exemplary building elements as disclosed herein.

FIG. 9 depicts another exemplary embodiment of a building element 100C, which comprises a securing rod 126 extending away from a top or bottom surface 102C, 102D of the building element. The beam member can also comprise an alignment void 112. As shown in FIG. 16, the securing rod 126 as well as the alignment void 112 can be configured to be engaged as further disclosed herein such that a plurality of building elements 100C can be stacked upon each other. Again, the engagement between the securing rod 126 (and alignment posts) and their corresponding alignment voids 112 can allow the building element 100C to have increased stability by securing a connection between the two respective building elements. In a further aspect, building element 100C can serve as the top building element in a retaining wall as further disclosed herein. In a further aspect, the height dimension of the face panel 102 is less than the height dimension of the beam member 104.

Retaining Wall Systems

As shown in FIG. 12, depicts a side view of building element 100A. As further disclosed herein, the brace section can be detachable into first portion 106A and second portion 106B. In a further aspect, the first portion 106A can be coupled (e.g., secured) to the face panel 102 and the second portion 106B can be detachably coupled to the first portion at a joint 107. In a further aspect, as disclosed herein, the first portion 106A and the second portion 106B can be coupled using securing rods 126. For example, a securing rod 126 can be a dowel, pin, or piece of rebar that is inserted to properly align the first and second portions 106A, 106B of the brace section of the beam member 104. In another exemplary aspect, the upper surfaces of the first and second portions 106A, 106B can define respective slots or recesses (alignment voids) that are configured to receive opposing end portions of a U-bar 150 as shown in FIG. 12. In this aspect, the respective alignment voids can be axially spaced relative to the second axis 116.

Figure 14:
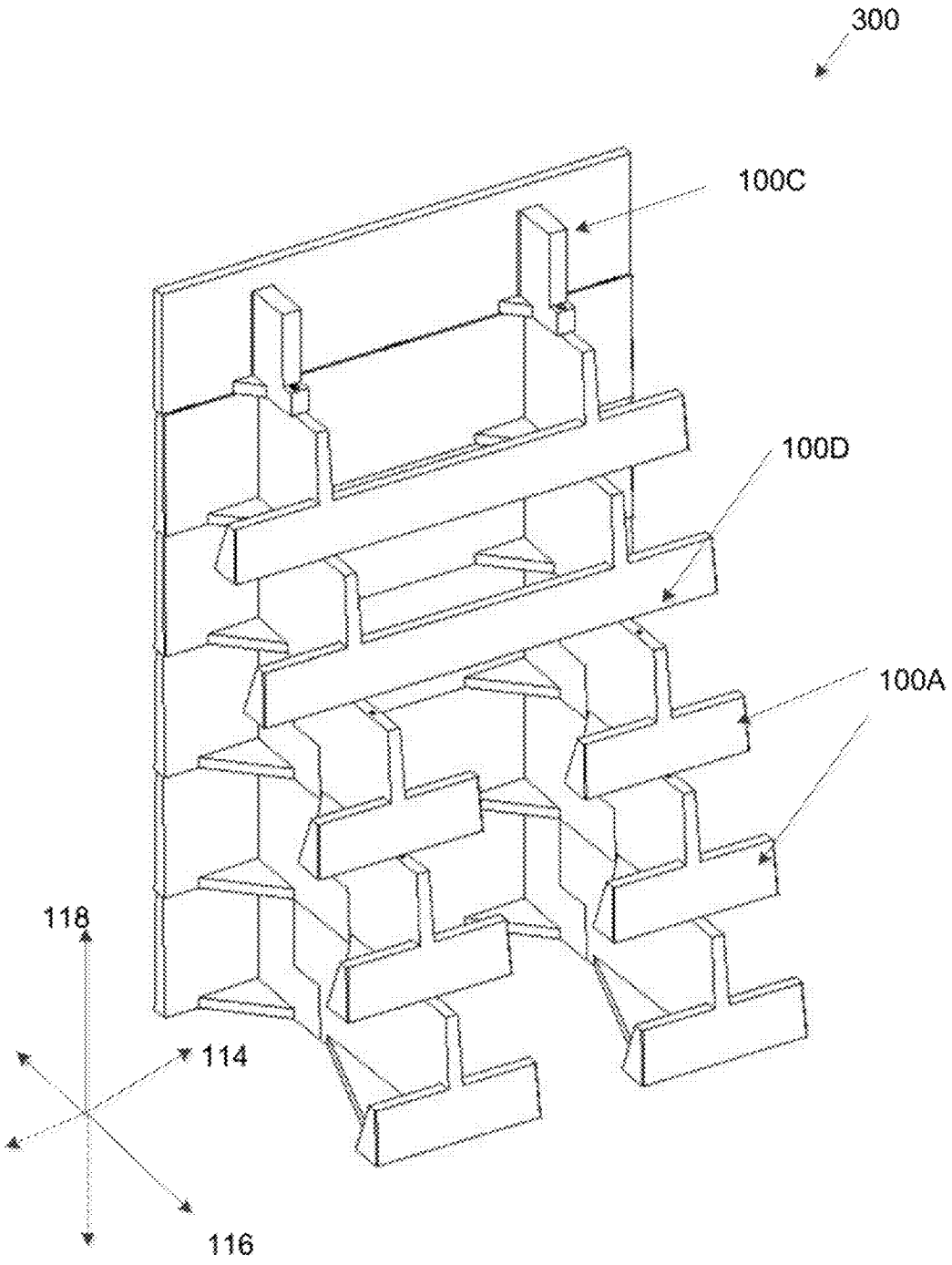
FIG. 14 is a rear perspective view of a retaining wall constructed of exemplary building elements.

FIGS. 13-15 depict an exemplary retaining wall 300 structure comprising a plurality of building elements. In an aspect, the retaining wall can comprise a combination of various types of building elements disclosed herein. It is contemplated that the retaining walls 300 can comprise a combination of one or more building elements 100A-E and/or an extension element 200 as disclosed herein. In a further aspect, as shown in FIG. 15, upon assembly of a plurality of building elements 100A as disclosed herein to form a retaining wall, it is contemplated that the joints 107 of adjacent building elements 100A are not vertically aligned. Optionally, in some exemplary aspects, it is contemplated that no joint 107 of any building element 100A will be vertically aligned with the joint 107 of any other building element 100A. For example, the joints 107 that occur at the intersection between the first and second portions 106A, 106B of the brace sections can be offset by at least 1 foot along the second axis 116. Offsetting the joint 107 across different layers of the wall can produce a staggered configuration that reduces the stress points in the wall. In a further aspect, staggering the joint 107 locations can reduce the potential of a fault line that runs through the layers of the wall. As also depicted, alignment voids can be located at different sections of the beam member 104 and face panel 102 to insure that the variable configurations of the building elements can still be secured together. As depicted, the top layer of a retaining wall can comprise a building element 100C.

As shown in FIG. 16, the securing rod 126 as well as the alignment void 112 can be configured to be engaged such that a plurality of building elements 100C can be stacked upon each other. Again, the combination of engagement between the securing rod 126 and alignment notches 120 with the alignment void 112 allows the building elements 100 to have increased stability by securing a connection between the two respective building elements. In a further aspect, building element 100C can serve as the top building element in a retaining wall. In a further aspect, the height dimension of the face panel 102 is less than the height dimension of the beam member 104.

An additional aspect adding to the versatility of building elements 100A-E is that they can be produced from a single mold. During the casting of a building element, a manufacturer can transition between respective building elements by adjusting the internal molding structure (e.g., by filling in receptacles or emptying receptacles to modify the shape to be created by the mold). The adjustments to the internal molding structure allow alternate components of a building element to be formed with a differing shape or orientation.

Although generally described herein as having a substantially vertical orientation, it is contemplated that the retaining walls produced as disclosed herein can have any desired orientation relative to the a horizontal plane, including for example and without limitation, a wall batter producing an angular orientation ranging from about 70 degrees to about 90 degrees relative to the horizontal plane.

Securing Devices

Figure 17:
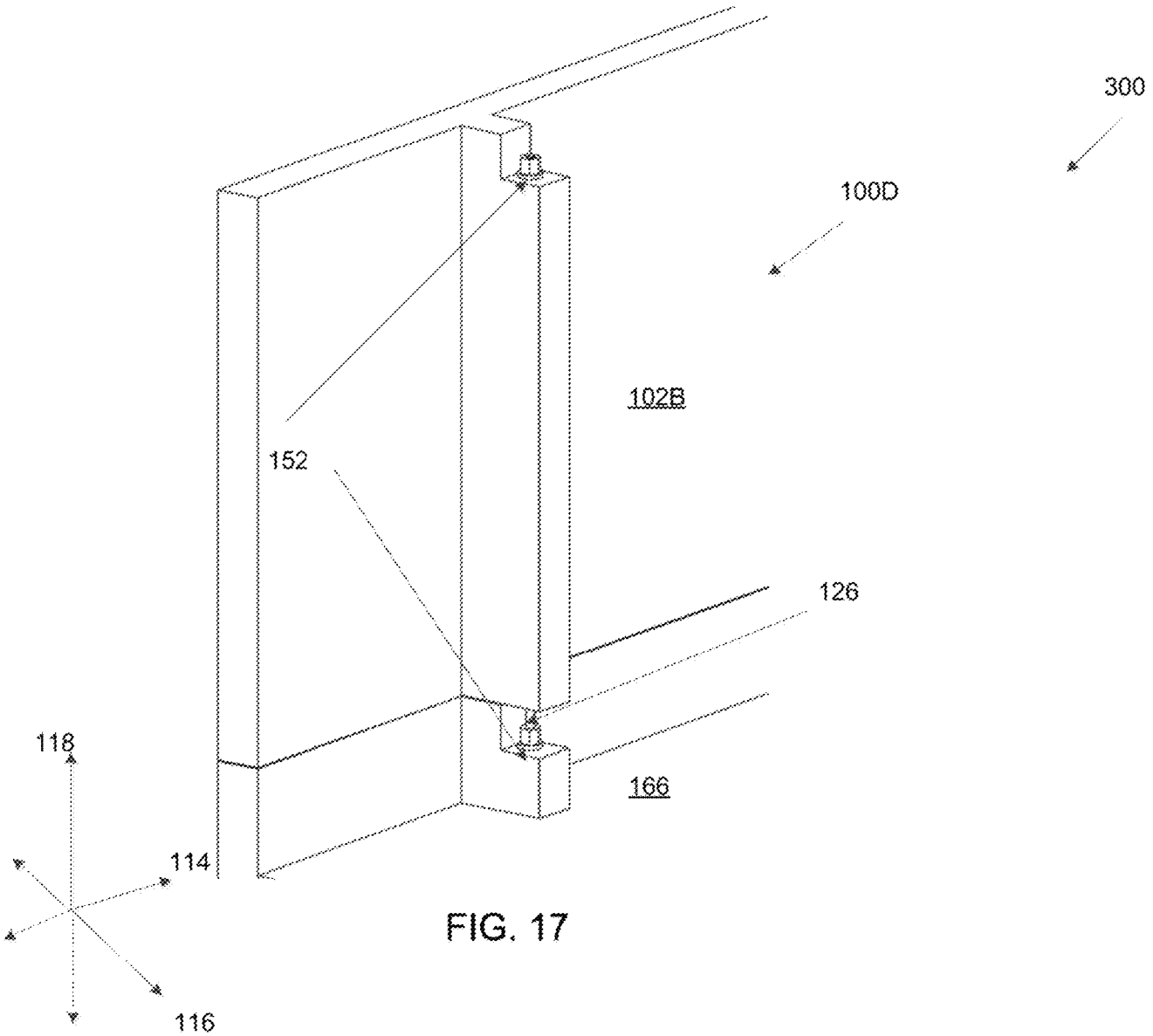
FIG. 17 is a rear perspective view of a retaining wall constructed of exemplary building elements as disclosed herein. As shown, each building element can include a securing device as disclosed herein.

FIG. 17 depicts another exemplary building element 100E comprising a face panel 102, a beam member 104, and a back section 108. In a further aspect, the building element 100D can comprise a securing device 152 for coupling two building elements 100D. The securing device 152 can comprise fixtures that can lock two respective building elements 100D to each other. For example, the securing device 152 can comprise securing rod 126 and securing bracket 154. In a further aspect, the securing rod 126 can be affixed to the bracket 154 by a nut/washer 156 combination. The securing rod 126 and the securing bracket 154 can be oriented such that the securing rod 126 can pass through a void in the alignment bracket 154.

Figure 18:
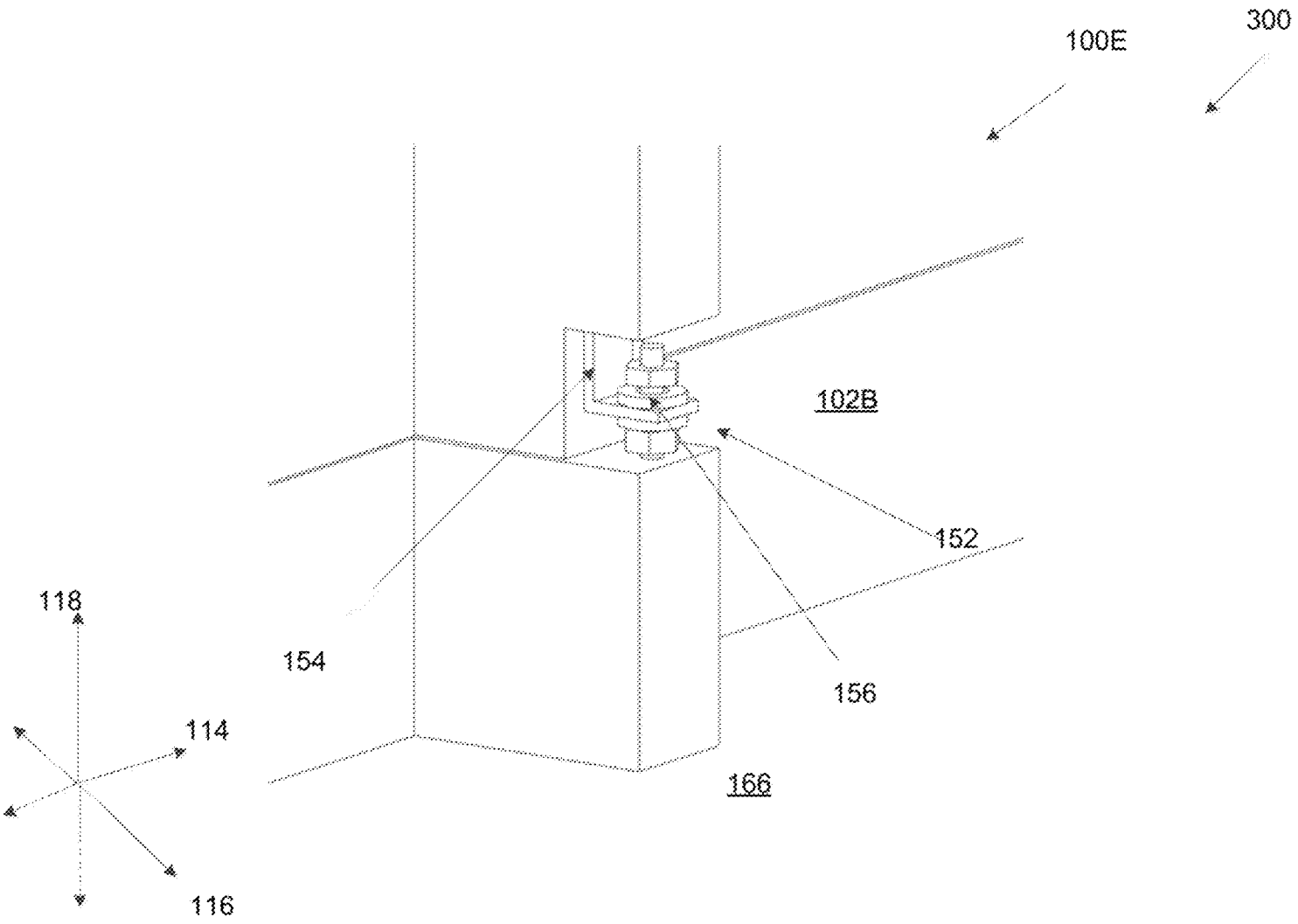
FIG. 18 is a close-up rear perspective view of the lower securing device depicted in FIG. 17.
Figure 19:
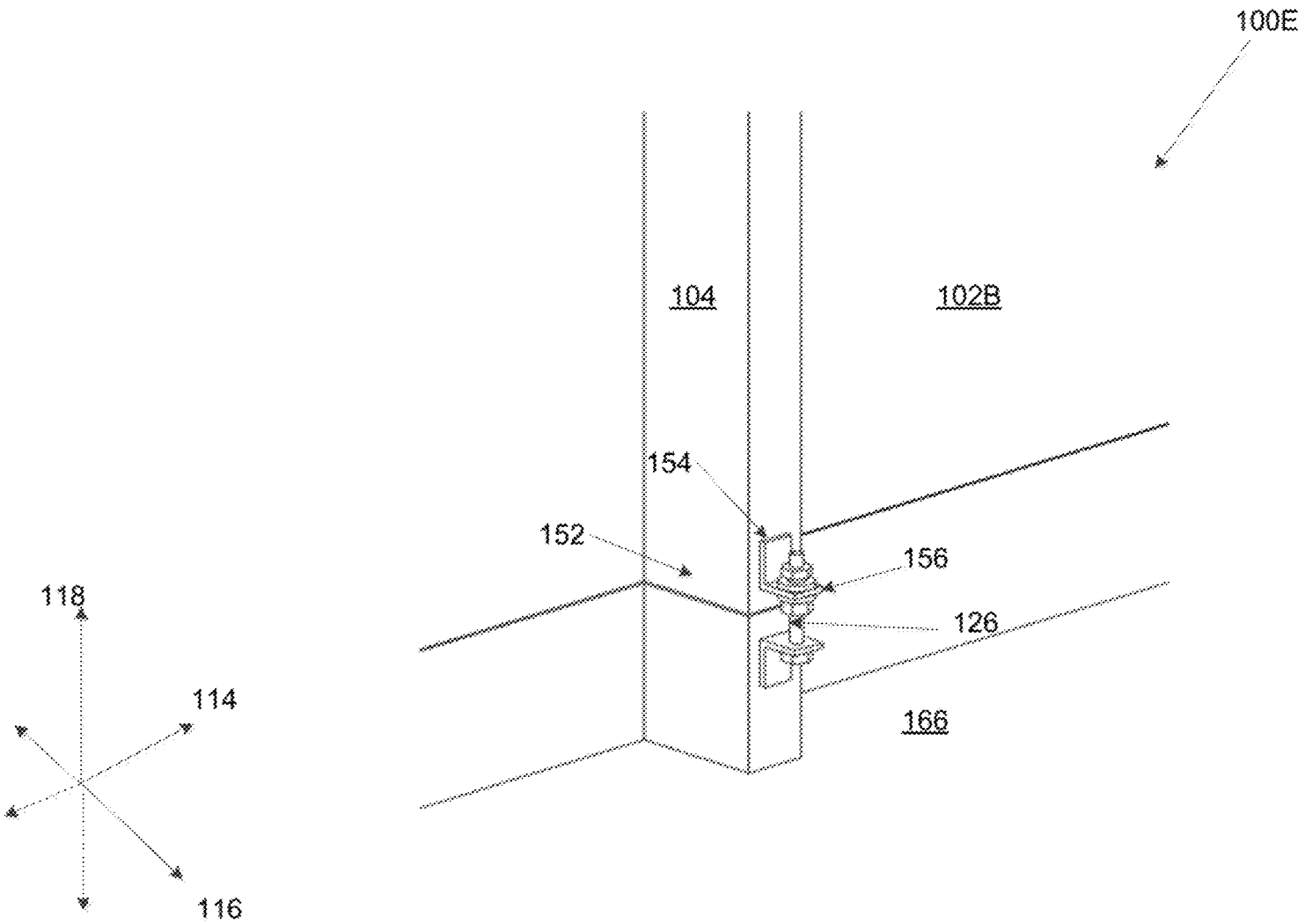
FIG. 19 is a rear perspective view of a retaining wall having an exemplary securing device located at the juncture of two exemplary building elements as disclosed herein.
Figure 20:
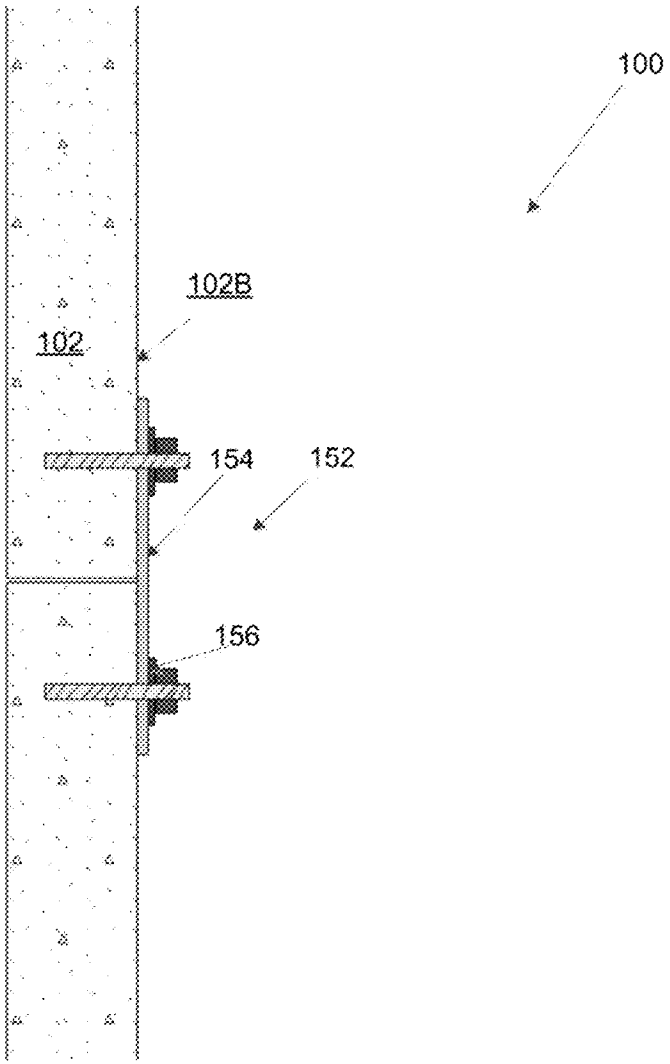
FIG. 20 is a side cross sectional view of an exemplary securing device located at the juncture of two exemplary building elements as disclosed herein.

FIG. 17 depicts another exemplary building element 100E comprising a face panel 102 and a beam member 104. In a further aspect, the building element 100D can comprise a securing device 152 for coupling two building elements 100D. The securing device 152 can comprise fixtures that can lock two respective building elements 100D to each other. The securing device 152 can prevent an upper building element from leaning over during the erection of the retaining wall. For example, the securing device 152 can comprise securing rod 126 and securing bracket 154. In a further aspect, the securing rod 126 can be affixed to the bracket 154 by a nut/washer 156 combination. The securing rod 126 and the securing bracket 154 can be oriented such that the securing rod 126 can pass through a void in the alignment bracket 154. FIGS. 18 and 19 depict alternative configurations of the securing device 152 and their respective attachment to a building element 100E. FIG. 20 depicts another embodiment of the securing device, wherein the securing bracket 154 is not oriented at an angle and only lies in a single plane. In further aspect, the securing bracket 154 can be attached to the rear surface 102B.

Spacers

Figure 21:
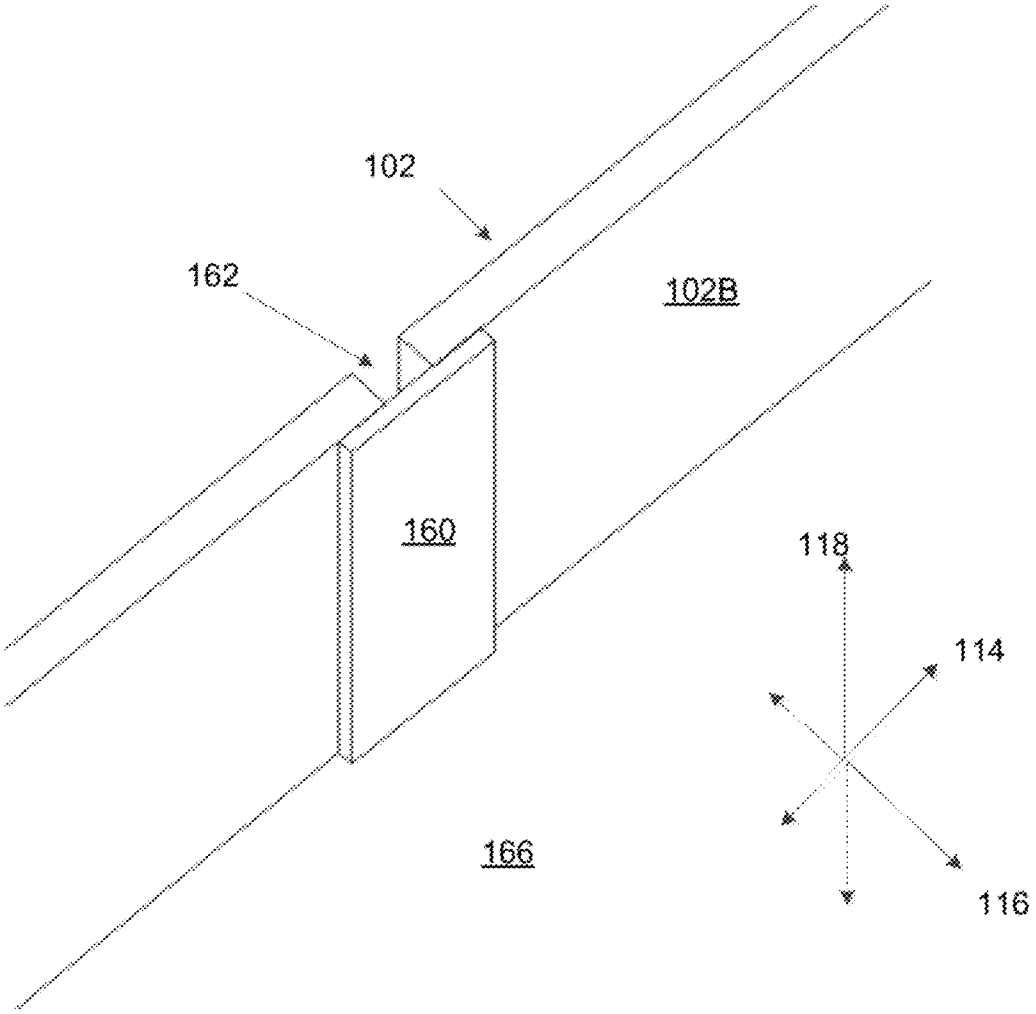
FIG. 21 is a rear perspective view of an exemplary panel spacer located at the juncture of two exemplary building elements as disclosed herein.

In an alternative aspect, as depicted in FIG. 21, two building elements can be oriented in a wall without being physically coupled (i.e., the spacers are not mechanically fixed in any way to the building elements). For example, a spacer 160 can be used to maintain a space 162 between two respective face panels 102. For example, the space 162 allows building elements 100 to settle independently in a vertical or substantially vertical orientation without touching each other. The size of the space may be evaluated based on any determined irregularities in the settlement of backfill. During erection, the spacer 160 can be covered with a geotextile fabric to prevent erosion. In as aspect, the spacer 160 can comprise weather resisting materials such as roof shingles, slate rocks, galvanized stretch metal pieces covered with geotextile fabric. The spacer can also be placed on the rear surface 102B that faces the earth (filler material) 166. In a further aspect, the space 162 can range from about 0.25 in. to about 4 in., from about 1.5 in. to about 3.0 in. or from about 2.0 in. to about 2.5 in. Optionally, the space 162 can be about 2.5 in. In exemplary aspects, the spacer can have a dimension relative to the first axis 114 that is at least 2 to 3 times the size of space 162. In operation, the spacer 160 can provide a cantilevering function to the front panels toward the open joint, with the spacer cooperating with the common fill behind the panels to provide tolerance and stability in case of an earthquake or irregular settlement.

It is contemplated that the spacer 160 can work with any combination of building elements disclosed herein.

Joint Stiffeners

Figure 22:
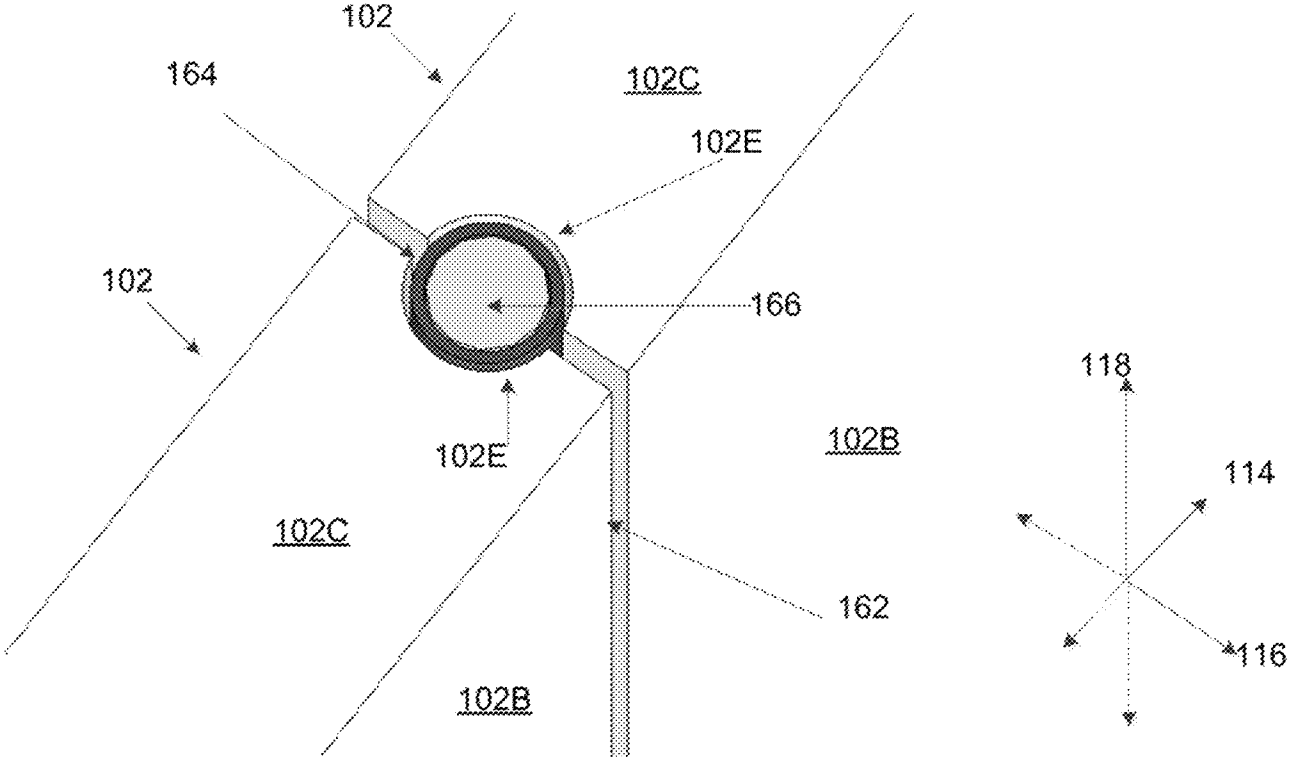
FIG. 22 is a close-up rear perspective view of an exemplary panel reinforcement located at the juncture of two exemplary building elements as disclosed herein.

In an aspect of the retaining wall, a joint 163 between face panels 102 can be strengthened using a joint stiffener 164 as depicted in FIG. 22. In a further aspect, the joint stiffener 164 can be oriented along the height dimension of the face panel 102 along the third axis 118. To facilitate the insert of the circular joint stiffener 164, the surfaces along the third axis 118 of the face panel 102 can define a semicircular channel 102E. It also further contemplates that the joint stiffener can have another geometric cross sectional shape. Similarly, the surface of the face panel can define a channel that mates with the alternative geometric cross sectional shape. In another aspect the joint stiffener 164 can be annular configuration wherein the joint stiffener is filled with a filler material 166. The filler material can comprise earthen material such as dirt, sand, or gravel. In a further aspect, the joint stiffener can comprise polyethylene which is flexible and UV resistant.

Building Elements Having Fill Receiving Spaces

Disclosed herein with reference to FIGS. 23A-28B is a building element 400 for forming a portion of a retaining wall. In exemplary aspects, the building element 400 can comprise a face panel 410 comprising a top surface 412, a bottom surface 414, a front surface 416, and a rear surface 418 positioned on an opposing side of the face panel from the front surface. In these aspects, the face panel 410 can comprise a length dimension oriented along a first axis 402, a width dimension oriented along a second axis 404 that is perpendicular to the first axis, and a height dimension oriented along a third axis 406 that is perpendicular to the first and second axes.

In additional aspects, the building element 400 can comprise a beam member 420 coupled to (e.g., secured to or integrally formed with) the rear surface 418 of the face panel 410. In these aspects, the beam member 420 can comprise a main body 422 and first and second foot portions 424, 426. In some aspects, the main body 422 can have an upper surface 428 and first and second side surfaces 430, 432 that are parallel or substantially parallel to the second axis 404. In further aspects, the first and second foot portions 424, 426 can project, respectively, from the first and second side surfaces 430, 432 relative to the first axis 402. In these aspects, the first and second toot portions 424, 426 can have respective lower surfaces 434 that are co-planar or substantially co-planar with the bottom surface 414 of the face panel 410 and respective upper surfaces 436 that are positioned between the bottom and top surfaces of the face panel relative to the third axis 406.

Optionally, the beam member 420 can be integrally formed with the face panel 410 as a monolithic structure.

In additional aspects, the beam member 420 can have a distal end portion 450 (e.g., a vertical pillar) spaced from the front panel 410 relative to the second axis 404. In these aspects, the distal end portion 450 can comprise first and second projections 452, 454 that project, respectively, from the first and second side surfaces 430, 432 of the main body 422 of the beam member 420. As shown in the figures, the first and second projections 452, 454 can cooperate with respective portions of the first and second foot portions 424, 426, the first and second side surfaces 430, 432 of the main body 422, and the rear surface 418 of the face panel 410 to define first and second receiving spaces 460, 462 on opposing sides of the beam member. As further disclosed herein, the receiving spaces 460, 462 can be configured to receive and at least partially enclose fill material. It is further contemplated that the structure of the disclosed building element 400 and, in particular, the structure of the disclosed beam member 420, can increase the internal arching effect of the till weight inside the receiving spaces, thereby wedging and holding the fill weight in place.

As depicted in the Figures, the distal end portion 450 of the beam member 420 can be widened to form a vertical pillar along the back of the building element for bracing against lateral earth pressures (like a soldier pile) to enhance the arching between such pillars, thereby increasing lateral earth pressure transfer directly from the backfill onto the building element (wall structure).

As further depicted in the Figures, the inner surfaces of the first and second projections 452, 454 of the distal end portion 450 (pillar) close the back of the inside backfill of the building element and thereby enhance the arching effect of internal fill material silo pressures directly onto the building element, which serves to enhance the gravity wall effect (a gravity wall resists against lateral earth pressures by the heavy weight of the wall (which is 20% concrete unit weight and 80% inside cell backfill earth weight).

In exemplary aspects, the distal end portion 450 of the beam member 420 can have a width that is significantly greater than is present in conventional retaining wall structures. For example, in some aspects, it is contemplated that the width of the distal end portion 450 can range from about 2.5 feet to about 5 feet and, optionally, be at least 3 feet. It is contemplated that this increased width can increase the internal arching effect of the fill weight inside the receiving spaces and against the distal end portion, thereby increasing the stability of the building element. In further exemplary aspects, it is contemplated that the face panel can have a width ranging from about 6 feet to about 12 feet and, optionally, be at least 7 feet or at least 8 feet. In these aspects, it is contemplated that an increased width of the face panel can further increase the arching effect of the cell fill along the front panel.

In further exemplary aspects, the face panel 410 can have opposed first and second side edges 470, 472 that are spaced apart relative to the first axis 402. In these aspects, the front surface 416 of the face panel 410 can comprise first and second portions 474, 476 that extend, respectively, from the first and second side edges 470, 472 to a center point 478 that is intersected by the vertical reference plane 408. It is contemplated that the first and second portions 474, 476 of the front surface 416 can be angularly oriented relative to each other. Optionally, the first and second portions 474, 476 of the front surface together define a V-shape.

Optionally, the face panel 410 can have a variable width relative to the second axis 404. In exemplary aspects, the face panel can have a maximum width within a vertical reference plane 408 that bisects the length dimension of the face panel 410. It is contemplated that this panel structure (with a maximum thickness at the center) can provide optimal moment resistance against cell-fill earth pressures at the center of the panel. Optionally, in these aspects, the face panel can have a minimum width at the opposing side. edges 470, 472, where there is no moment.

In addition to providing the disclosed performance advantage, it is contemplated that the variation in panel thickness and the V-shaped profile of the front surface 416 of the face panel 410 can provide a desired front-face appearance and visual effect, which can optionally produce variation in the appearance of shadows during the day.

In exemplary aspects, as the beam member 420 can define at least one pin hole 442 (optionally, a plurality of holes, such as two pin holes) that permit engagement between the building element and a pin and/or lifting cable of a crane or other handling/lifting apparatus. Such pin holes can be formed during the manufacturing process. In use, the pin holes can permit fast and safe installation of the building elements.

As one of skill in the art can appreciate, in some exemplary aspects, the disclosed building elements can be provided as one-piece "cribwall" units that can be cast with a large front panel and a beam member that forms a partially closed backfill cell and is dosed at the bottom for "wedging in" the fill such that the till cannot simply drop out. This "wedging in" of the fill occurs (in part) due to the arching effect (both horizontal and vertical) along the foundations of the face panel and the beam member, including the enlarged distal end portion (pillar), with the fill being wedged between the face panel and the widened portion of the pillar. In use, the fill cannot move out of the cell and must function together with the wall structure to form a cribwall (which is a concrete container structure containing a maximum amount of fill material for creating the weight needed to resist the enormous lateral earth pressures). In use, it is contemplated that such building elements can be easy to fill and compact, while providing easy access (from the back of the building element) to large excavators, vibratory rollers, and compactors, which perform far better than hand tools. Thus, in use, it is contemplated that the disclosed building elements can reduce or eliminate the need for expensive hand-labor work, which is typically unreliable and inefficient.

Figure 23A:
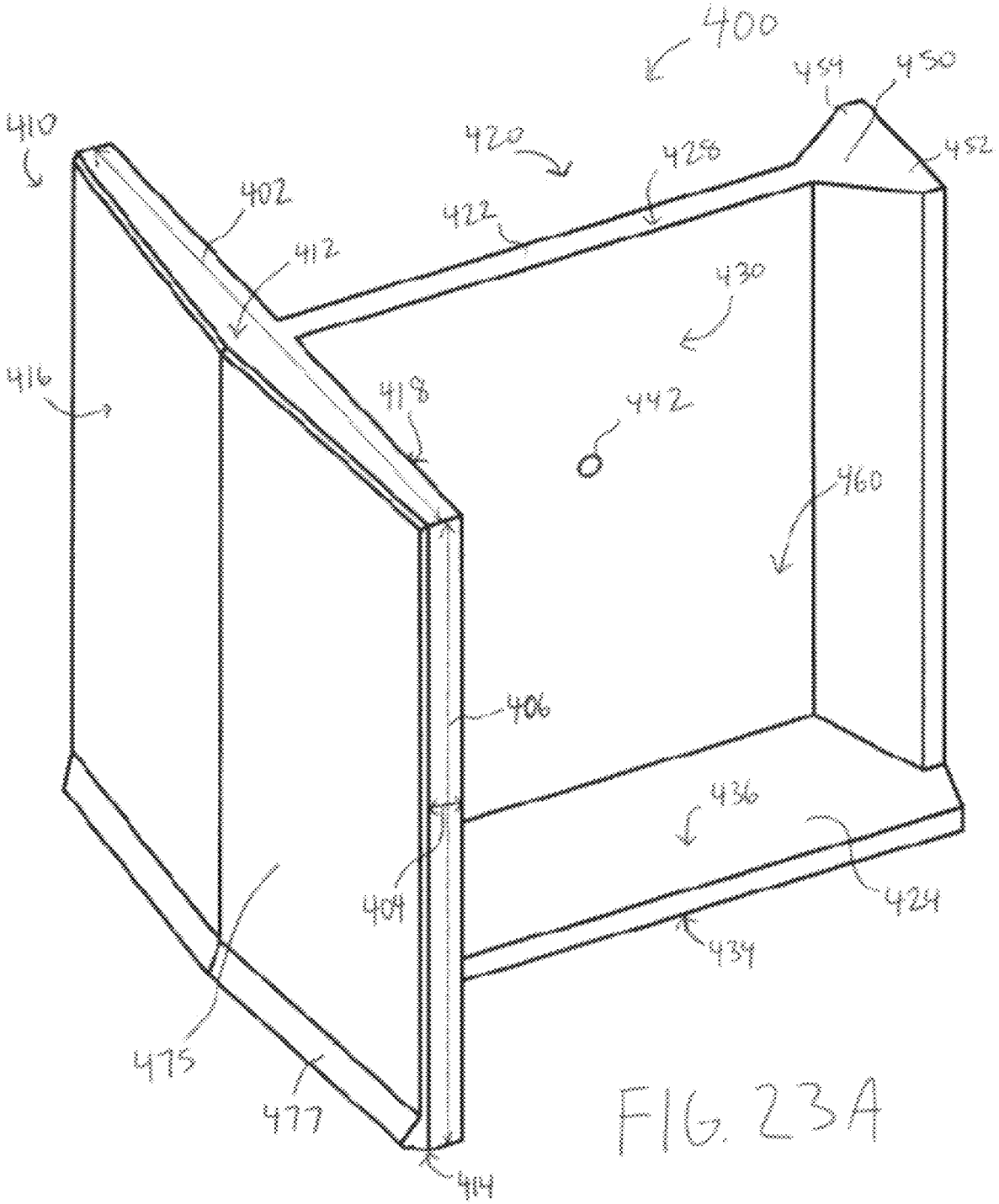
FIGS. 23A, 23B, and 23C are front perspective, rear perspective, and top plan views of an exemplary building element having fill receiving spaces as disclosed herein.
Figure 23B:
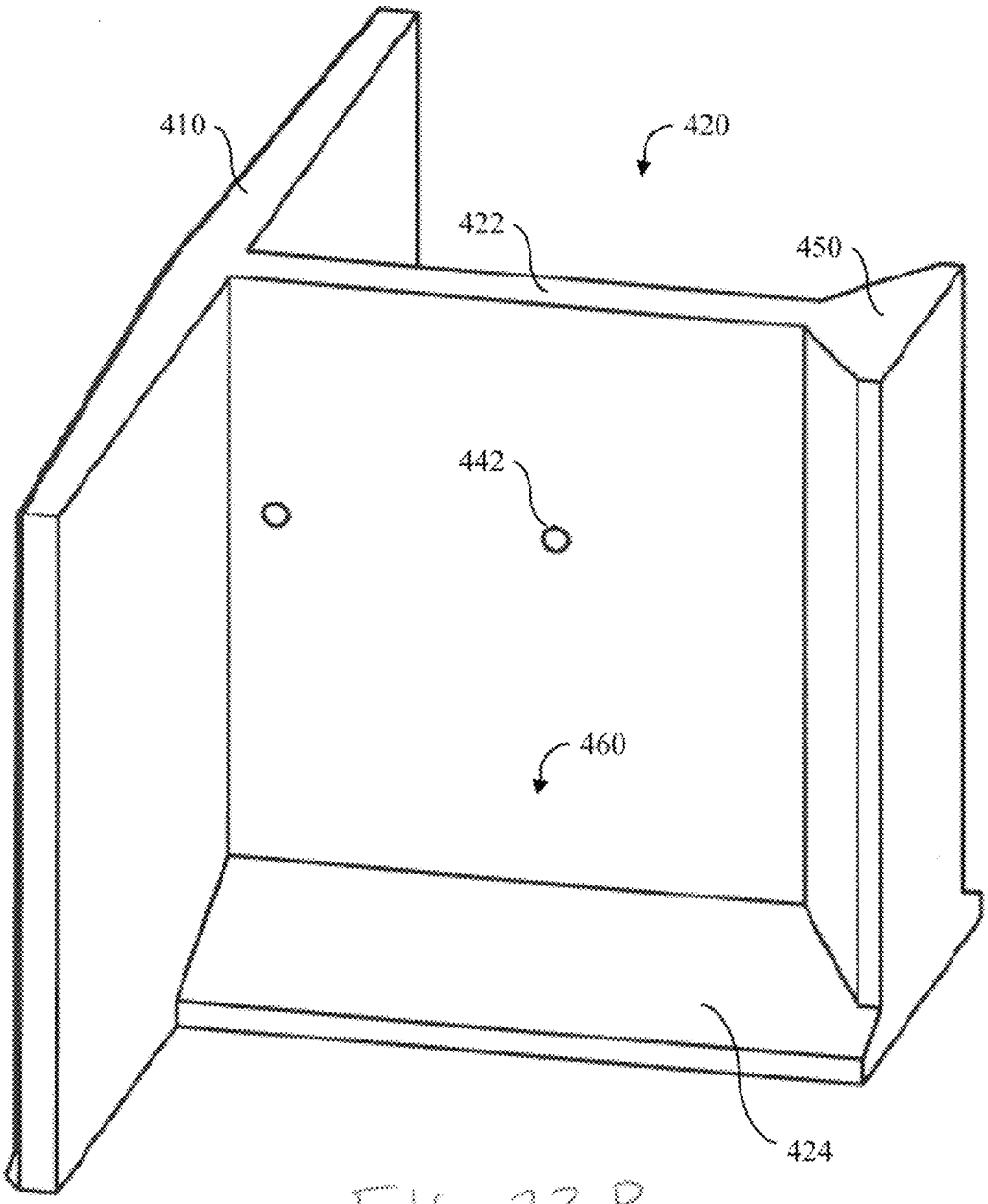
Figure 23C:
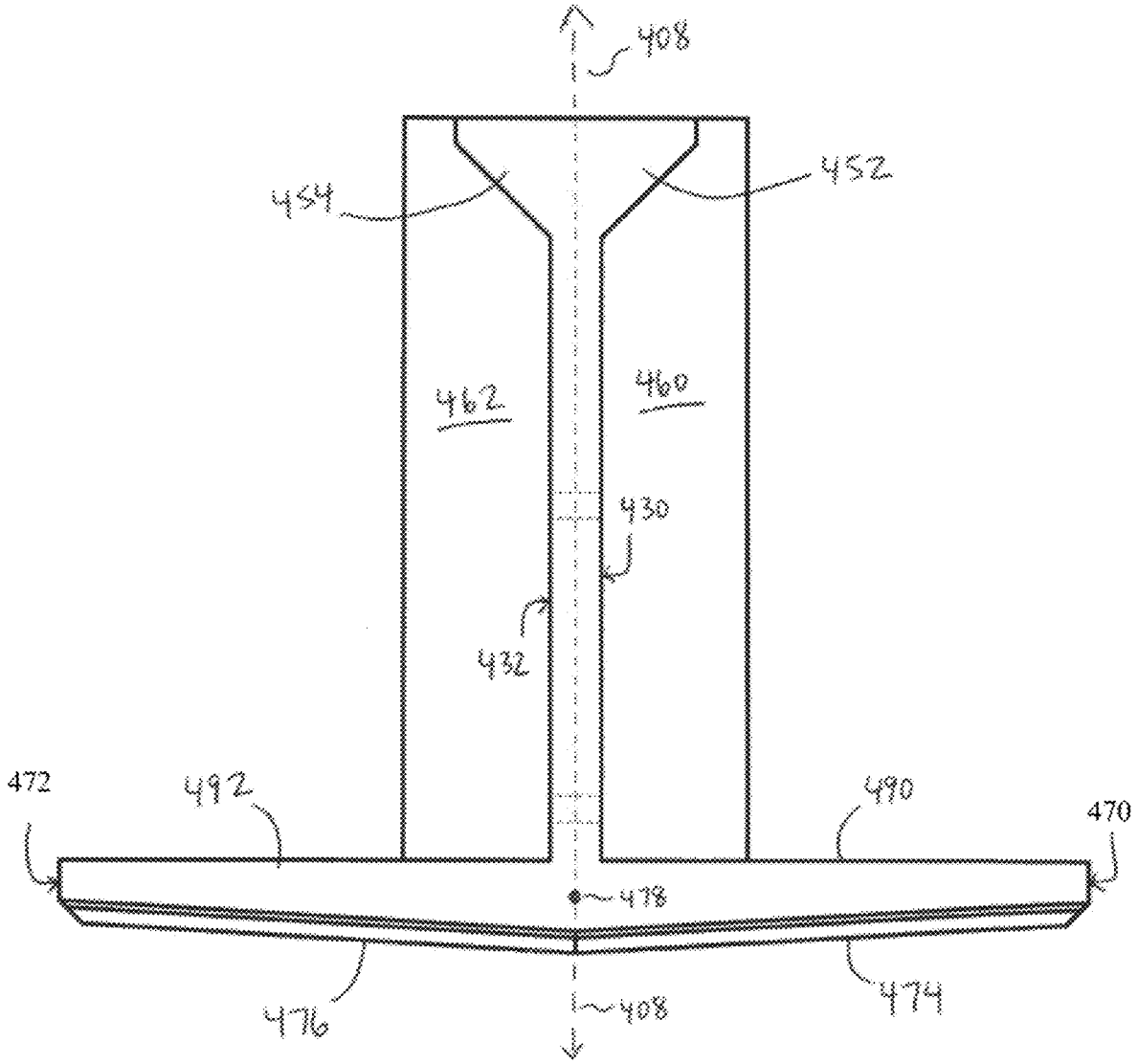
Figure 23D:
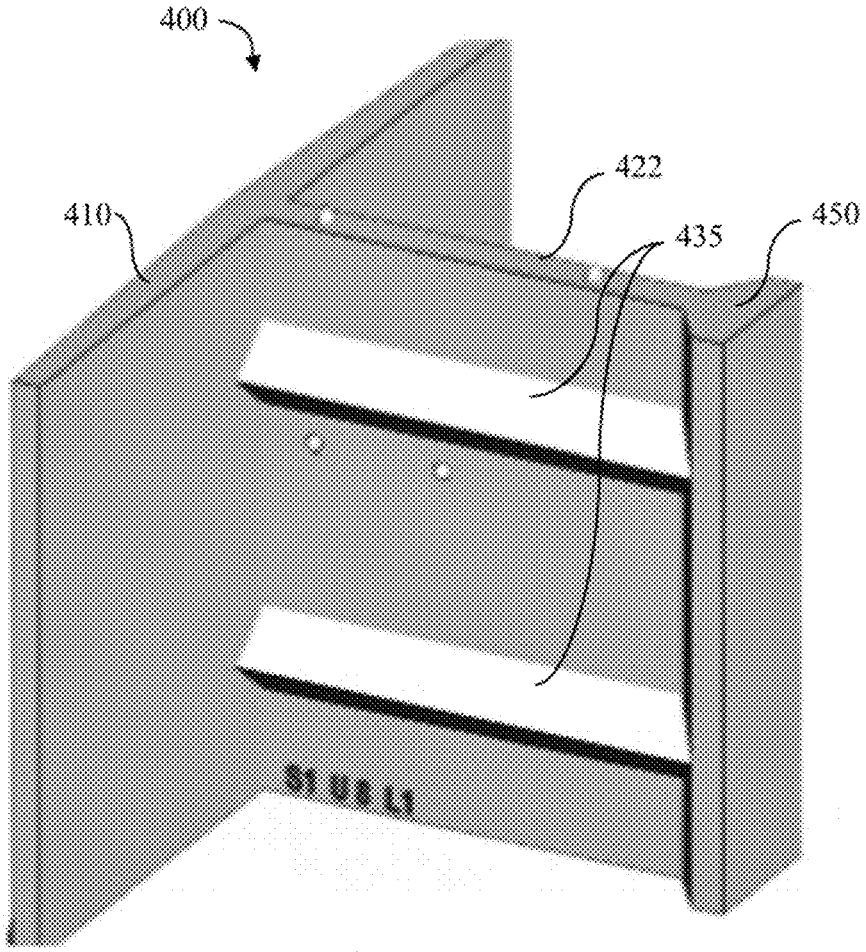
FIGS. 23D and 23E are back and front perspective views of an exemplary building element having a plurality of vertically spaced elbows that project outwardly from the main body of the beam member and extend between the face panel and the distal end portion of the beam member (also referred to herein as the "back pillar").
Figure 23E:
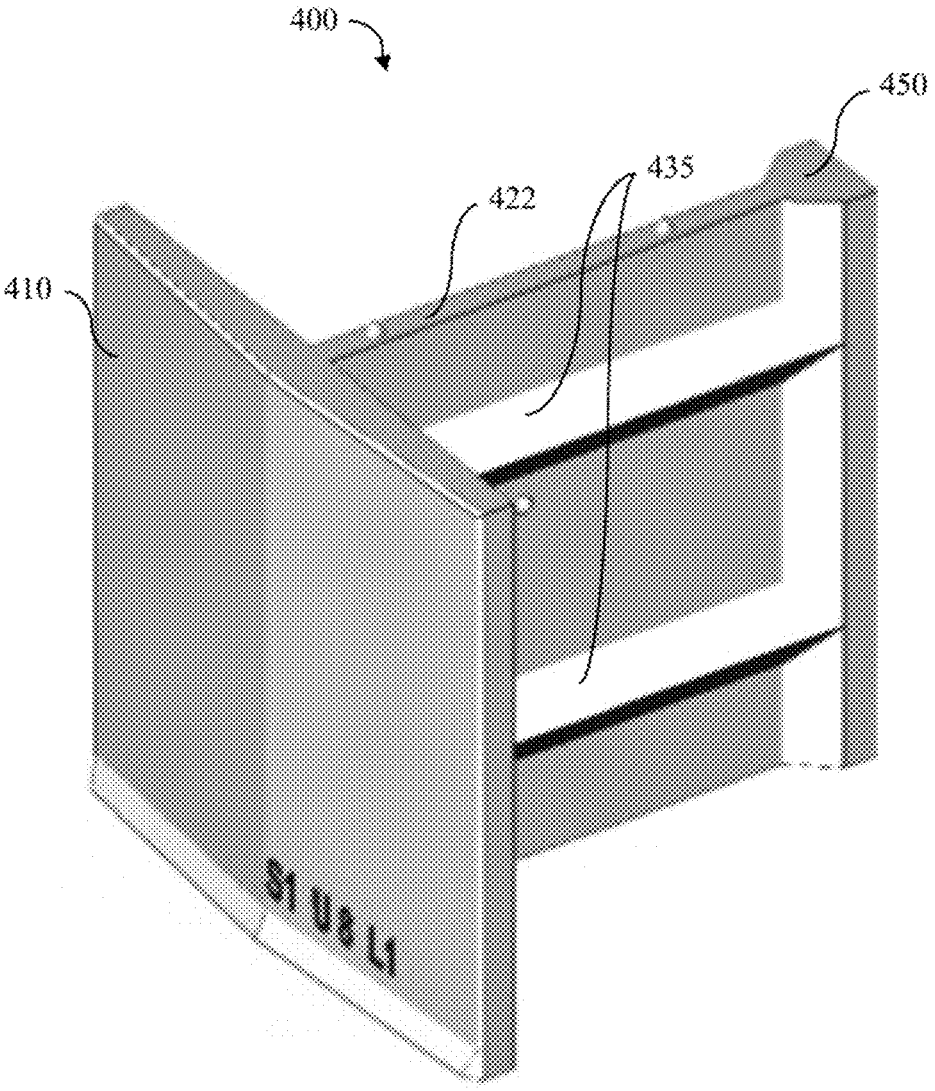
Figure 23F:
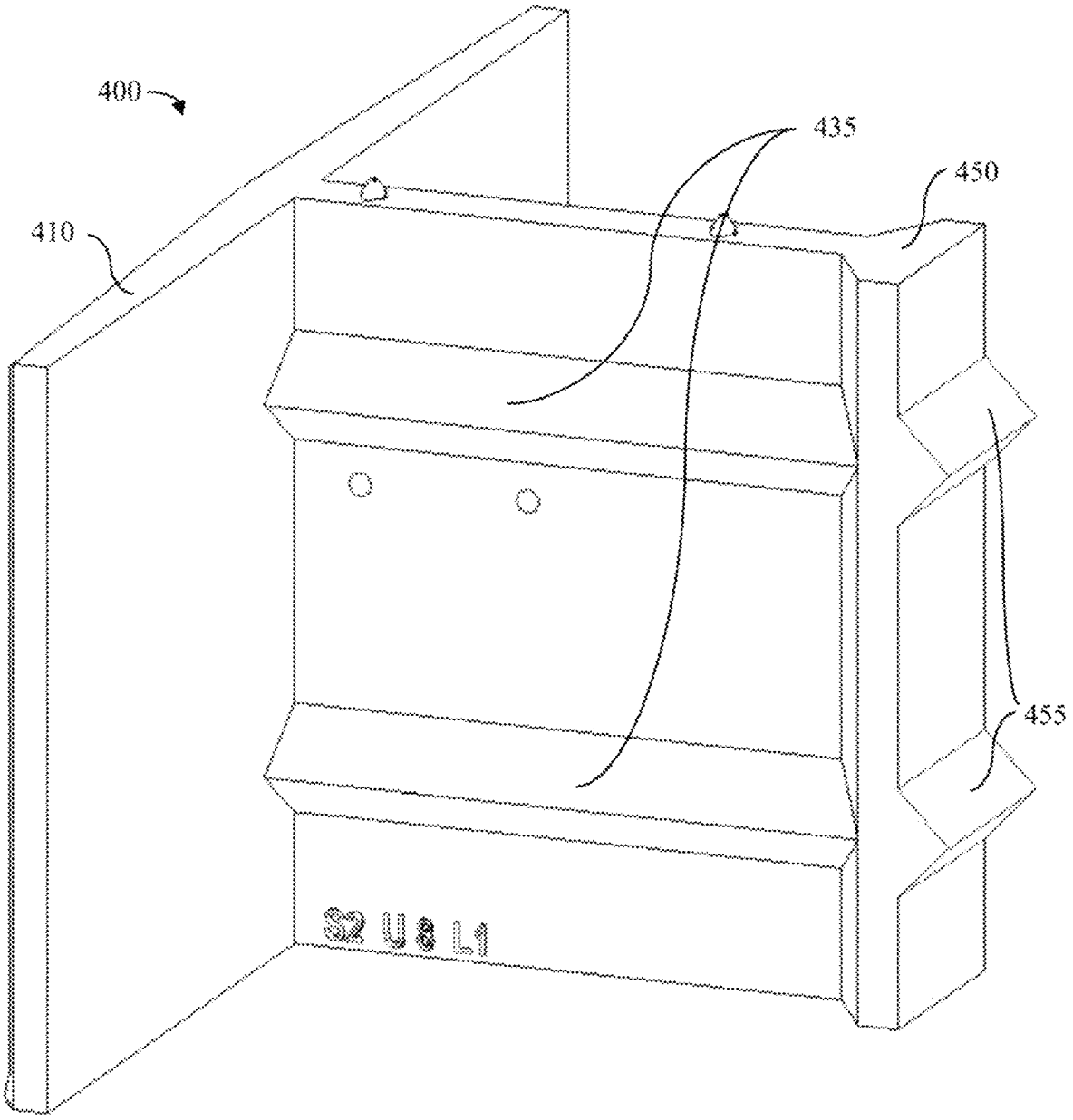
FIGS. 23F-23G are back perspective views of exemplary building elements having a plurality of vertically spaced elbows along the main body of the beam member and a plurality of vertically spaced elbows along a rear surface of the distal end portion of the beam member.
Figure 23G:
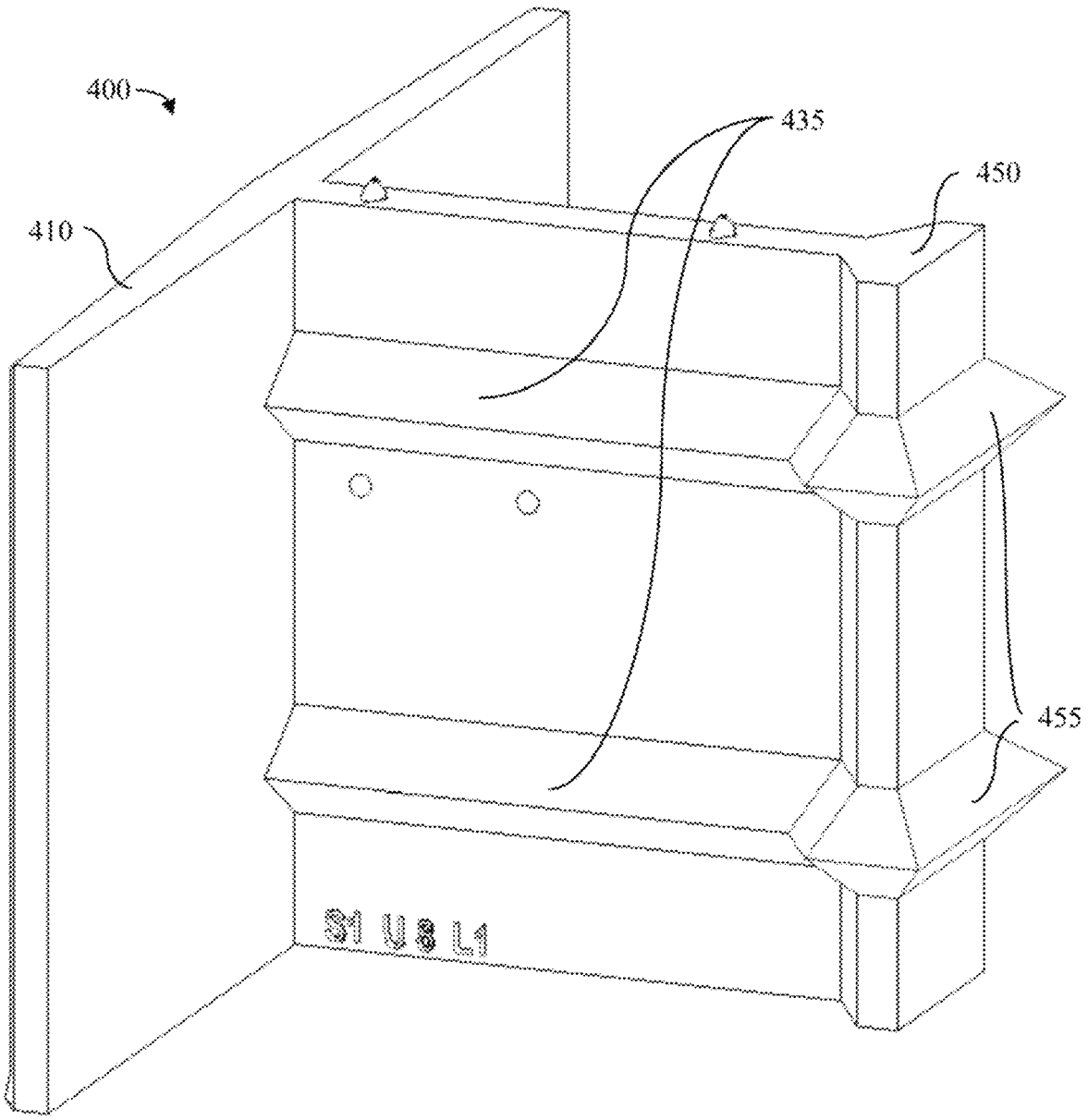

Optionally, as shown in FIGS. 23D-23G, the building element 400 can further comprise at least one longitudinal elbow 435 (optionally, a plurality of vertically spaced longitudinal elbows 435) that projects outwardly from the main body 422 of the beam member 420 and extends between the face panel 410 and the distal end portion 450 of the beam member. In exemplary aspects, it is contemplated that respective longitudinal elbows 435 can extend outwardly from both side surfaces 430, 432 of the main body 422 (preferably in a symmetrical or balanced arrangement with equal numbers of elbows extending from each side surface). Additionally, or alternatively, the building element 400 can comprise at least one transverse elbow 455 that projects outwardly from a rear surface of the distal end portion 450 of the beam member 420. Optionally, as shown in FIG. 23G, it is contemplated that respective longitudinal elbows 435 (on both sides of the main body) and a corresponding transverse elbow 455 can extend continuously along the side and rear surfaces of the beam member. Alternatively, a gap between the longitudinal and transverse elbows can be provided as shown in FIG. 23F. Optionally, in exemplary aspects, it is contemplated that each elbow 435, 455 can have a pointed or beveled shape. In exemplary aspects, it is contemplated that each elbow 435, 455 can be vertically spaced from the bottom and top surfaces of the beam member 420.

In use, it is contemplated that the elbows can be configured to provide horizontal stiffening of the beam member 420 and/or the distal end portion 450 of the beam member. This horizontal stiffening is particularly beneficial for longer building elements, which can have a length ranging anywhere from about 5 feet up to about 34 feet. Such stiffening of longer building elements can greatly help with manufacturing, loading, and transporting of the building elements.

It is further contemplated that the elbows can be configured to initiate and positively support and create substantial arching of the fill inside the building elements to Inaction as a real container for the fill. It is contemplated that arches inside the building elements can more effectively transfer the weight of the fill onto the building elements to greatly help stabilize the gravity wall effect.

Additionally, with respect to the transverse elbows 455 along the back of the building elements, these transverse elbows can greatly encourage the support of backfill material behind the wall by increasing the vertical fill weight effect to stabilize the wall against overturning. These transverse elbows can affect the backfill in a number of ways. In particular, the back fill cannot simply slide down along the pillars during compaction; rather, the backfill will at least partially "sit" or rest on the pillar, thereby stabilizing the retaining structure against overturning. Thus, the transverse elbows affect the way the backfill forces are distributed within the area directly behind the wall structure. Therefore, the transverse elbows 455 enlarge and affect the fill material beyond the actual back of the wall structure such that the retaining wall structural "effect" reaches beyond the actual wall footprint. in use, the transverse elbows 455 can increase the vertical loads onto the pillars from outside the wall "footprint."

Figure 24:
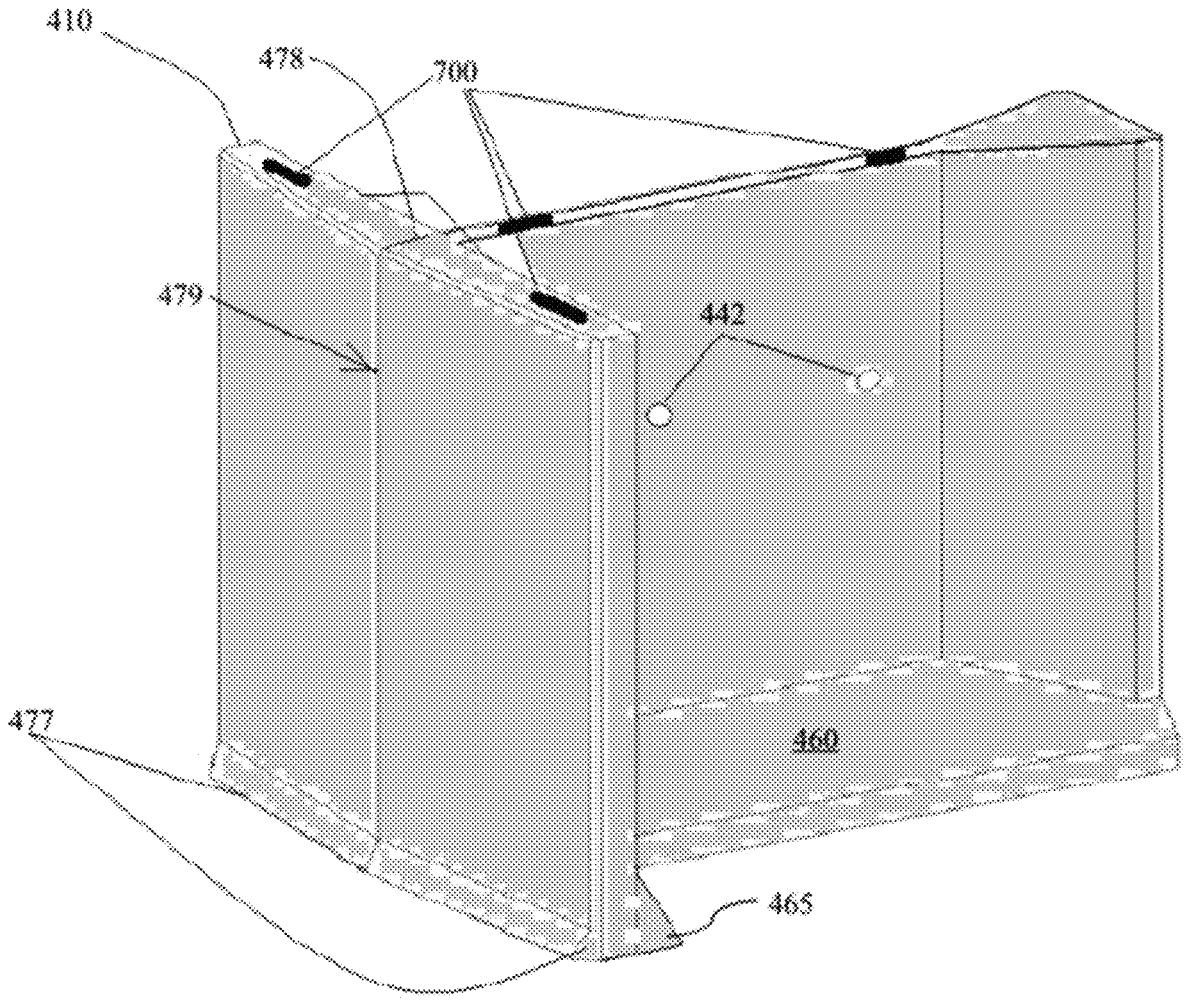
FIG. 24 is a perspective view of an exemplary building element having fill receiving spaces as disclosed herein.
Figure 25A:
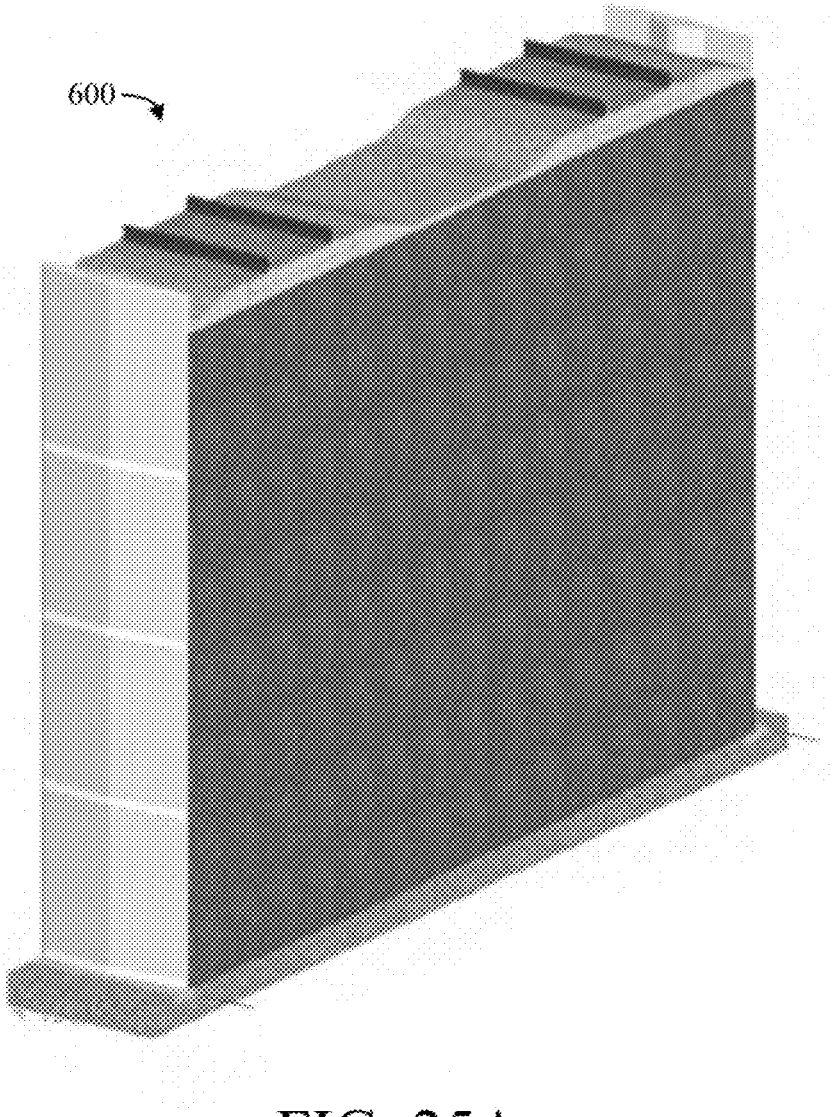
FIGS. 25A and 25B are front perspective and side elevational views of an exemplary column of building elements having fill receiving spaces as disclosed herein.
Figure 25B:
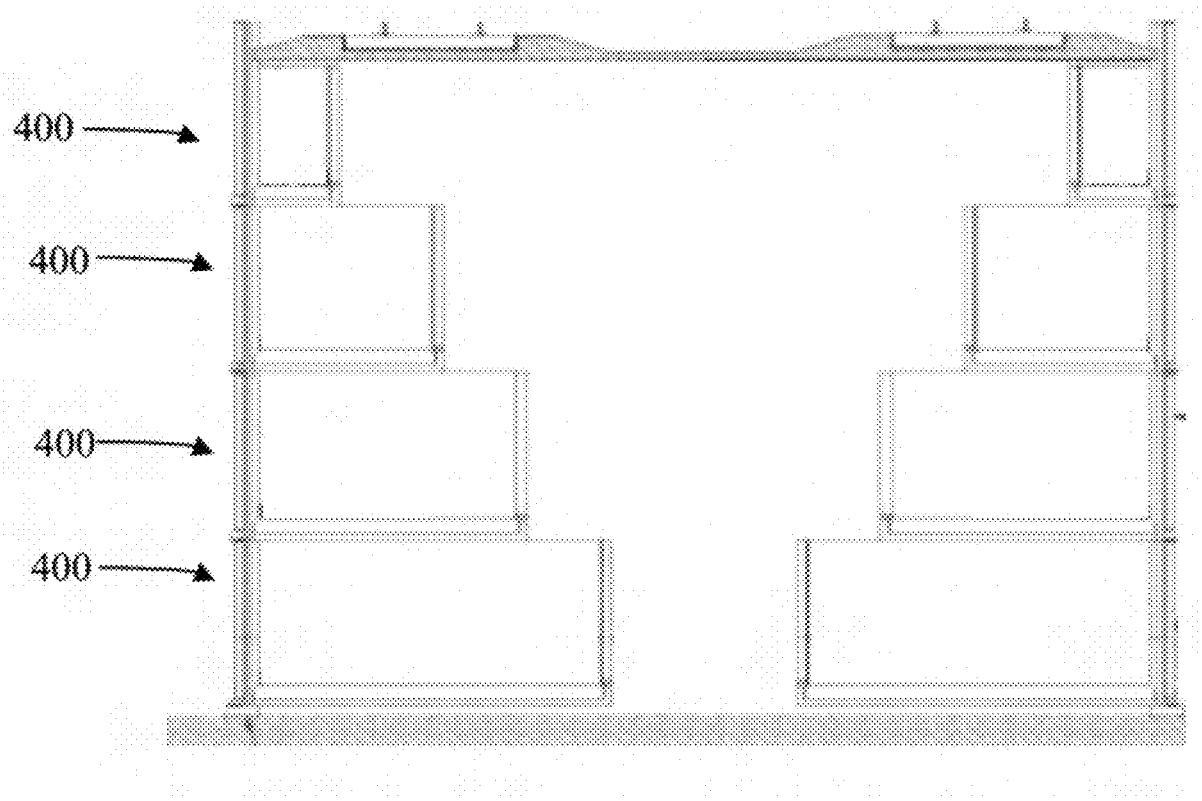

Additionally, or alternatively, as shown in FIG. 24, the building element 400 can further comprise a base projection 465 extending away from a base portion of the rear surface 418 of the front panel 410. Optionally, the base projection 465 can have a bottom surface that is flush with a bottom surface of the face panel 410. As shown, the base projection 465 can have a downward slope moving away from the upper surface of the building element (and toward the bottom surface of the building element) such that the width of the base projection (measured relative to axis 116) increases moving away from the upper surface of the building element. In use, it is contemplated that the base projection can function in a manner similar to the elbows 435, 455. That is, the base projection can be configured to initiate and positively support and create substantial arching of the fill inside the building elements to function as a real container for the fill, thereby allowing for more effective transfer of the weight of the fill onto the building elements to improve stability. In use, it is contemplated that backfill will at least partially "sit" or rest on the base projection, thereby stabilizing the retaining structure against overturning.

Overall, the disclosed elbows 435, 455 and the base projection 465 effectively change and challenge the internal earth pressures to act differently and enhance the wall stability with minimal additional cost.

In exemplary aspects, it is contemplated that the elbows can be formed using the molding process described herein. In these aspects, it is contemplated that the elbows can optionally be formed integrally with the remainder of the beam member as a monolithic structure.

Figure 26A:
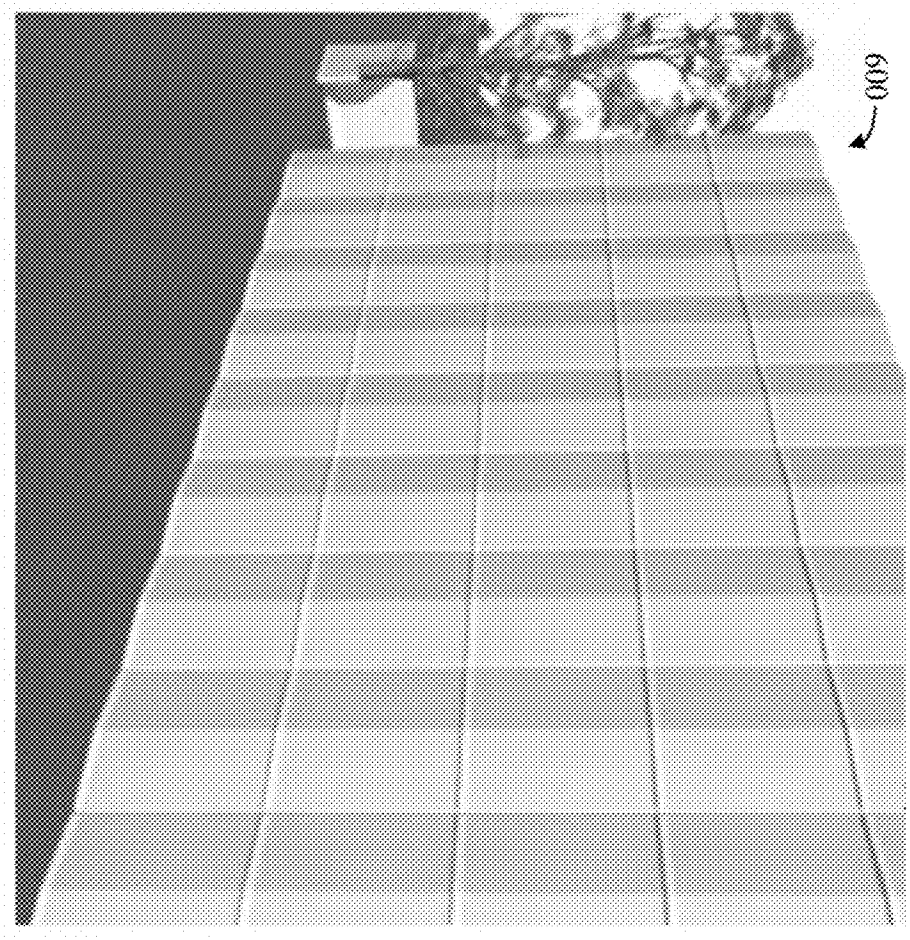
FIGS. 26A and 26B are front perspective and close-up top views of spaced columns of building elements having fill receiving spaces as disclosed herein.
Figure 26B:
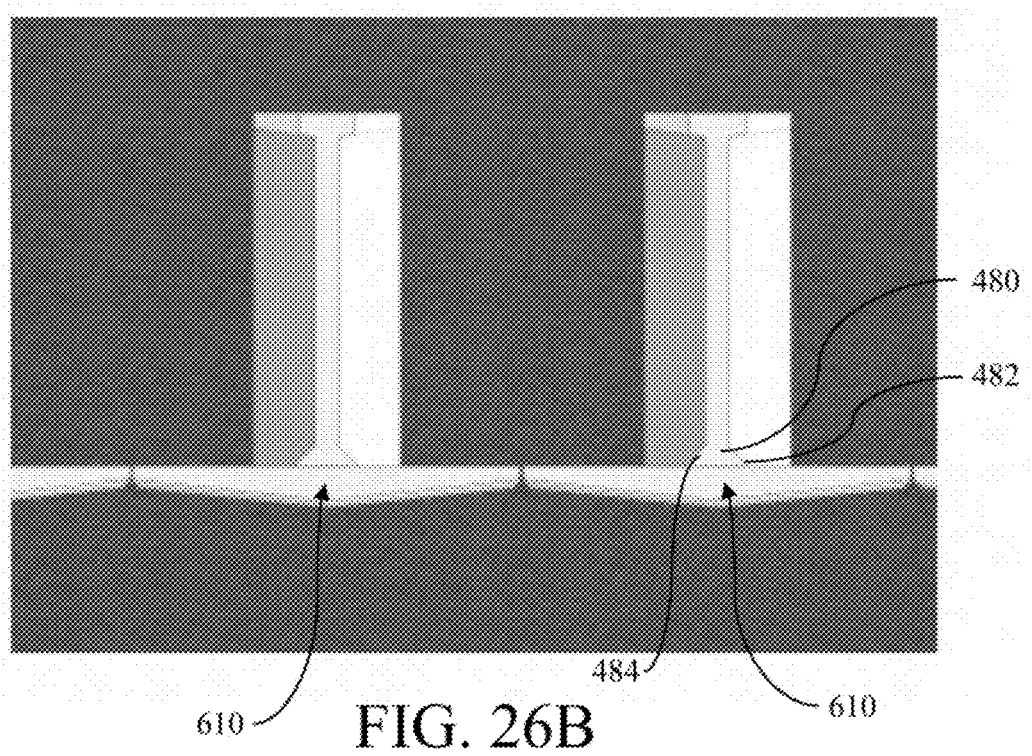

Optionally, in further aspects, and as shown in FIG. 26B, the beam member 420 can have a proximal end portion 480 having first and second portions 482, 484 that extend, respectively, from the first and second side surfaces 430, 432 of the beam member to the rear surface 418 of the front panel 410. In these aspects, each of the first and second portions 482, 484 of the proximal end portion 480 can extend at an obtuse angle relative to adjoining portions of the first and second side surfaces 430, 432 of the beam member. Optionally, in further aspects, the rear surface 418 of the front panel 410 can comprise first and second end sections 490, 492 positioned on opposing sides of the proximal end portion 480 of the beam member 420. In these aspects, the first and second end sections 490, 492 of the rear surface 418 of the front panel 410 can be parallel or substantially parallel to the first axis 402.

In another aspect, the upper surfaces 436 of the first and second foot portions 424, 426 of the beam member 420 can slope downwardly from the respective side surfaces 430, 432 of the main body 422 of the beam member.

In still another aspect, the front surface 416 of the face panel 410 can comprise an upper portion 475 and a base portion 477 that extends between the upper portion and the bottom surface 414 of the face panel relative to the third axis 406. In this aspect, the base portion 477 can be angularly oriented to extend outwardly relative to the upper portion 475 of the front surface 416 of the face panel 410.

Optionally, in exemplary aspects, the base portion 477 of the panel 410 can have an outwardly sloped profile with an increase thickness than the upper portion 475 of the panel. Optionally, the panel can have a continuously sloped profile, with the base portion corresponding to the thickest sections of the panel. Alternatively, the base portion 477 can project from the upper portion 475 and define a visible "nose." Some purposes of such a "nose" along the bottom of the panel include creating a shade along the bottom joint that covers up small imperfections of an underlying panel (resulting from manufacturing or handling) and to emphasize the horizontal joint visually for an additional architectural effect.

Optionally, in further aspects, the face panel 410 can comprise a reinforcing material 500 (e.g., at least one steel bar, a steel plate, or a wire mesh) that is embedded within the face panel and oriented parallel or substantially parallel to the first axis 402. In these aspects, it is contemplated that the parallel or substantially parallel orientation of the rear surface 418 of the face panel 410 can allow for positioning of the reinforcement material 500 without the need for bending, thereby maximizing efficiency in the assembly process.

Figure 27A:
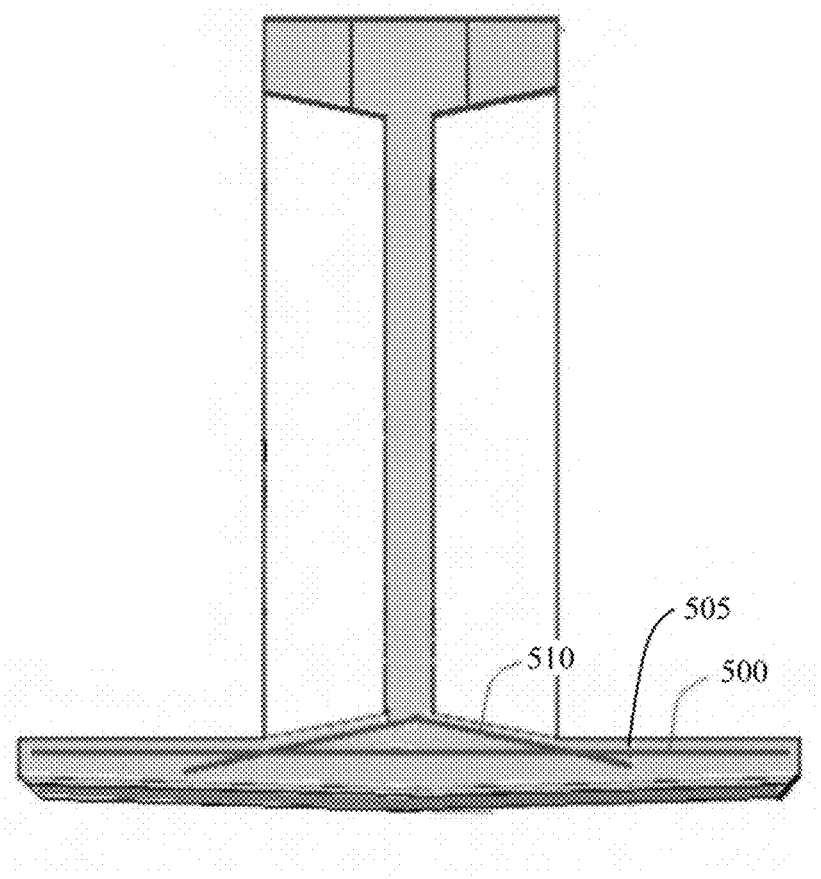
FIGS. 27A and 27B are top plan views of exemplary building elements having fill receiving spaces and reinforcement materials as disclosed herein.
Figure 27B:
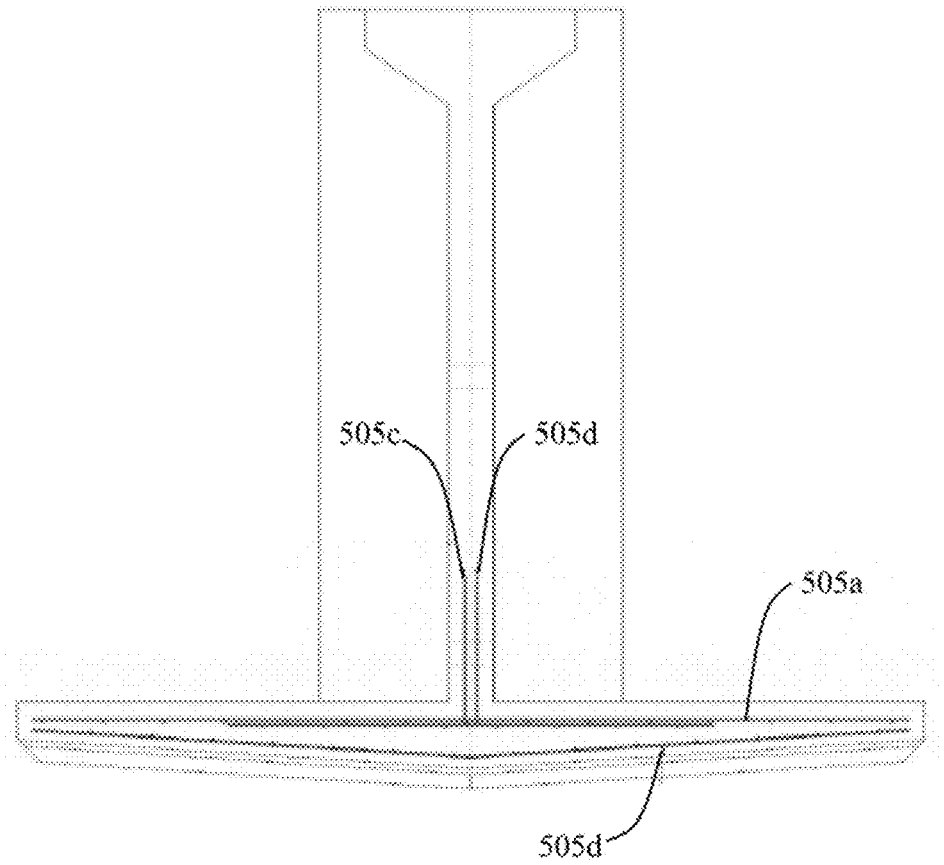

In exemplary aspects, the reinforcement material 500 can be provided as one or more wire mesh sections 405, as shown in FIGS. 27A-27B. Optionally, as shown in FIG. 27A, the face panel 410 can comprise at least a first wire mesh section 405 that extends parallel or substantially parallel to the first axis 114. A corresponding wire mesh section 405*a* is depicted in FIG. 27B. These wire mesh sections extend along the back face of the panel with a straight mesh. As shown in FIG. 27B, it is contemplated that additional wire meshes 405*b*, 405*c*, 405*d* can optionally be positioned within the panel and or beam member. As shown in FIG. 27B, it is contemplated that the provision of wire mesh section 405*b* can be possible due to the increased and variable panel thickness further discussed herein, which leads to efficient reinforcement.

Optionally, in still further aspects, the face panel 410 can comprise a plurality of steel bars 510 that are embedded within the face panel. Optionally, in exemplary aspects, and as shown in FIG. 27A, the face panel 410 can comprise at least first and second steel bodies 510 (e.g., steel bars) that are embedded within the face panel. In these aspects, the first and second steel bodies 510 have respective first and second ends, wherein the first ends of the first and second steel bodies are positioned proximate the center point 478 of the center section of the rear suffice. It is further contemplated that the first steel body can be oriented parallel or substantially parallel to the first portion of the center section of the rear surface of the face panel, and wherein the second steel body is oriented substantially parallel to the second portion of the center section of the rear surface of the face panel.

In further aspects, at least one surface of the top surface 412 and the bottom surface 414 can define an alignment void 495 configured to receive a portion of an adjacent building element during formation of the retaining wall. Optionally, the top surfaces of the front panel and or the beam member can comprise alignment posts 700 (as further described herein) that are configured to permit self-alignment of building elements during installation, by matching the alignment posts with corresponding alignment voids along the bottom of the building elements.

Optionally, in still further aspects, the front surface of the face panel 410 can have a surface area of greater than 40 square feet, such as, for example and without limitation, greater than or equal to 41 square feet, greater than or equal to 42 square feet, greater than or equal to 43 square feet, greater than or equal to 44 square feet, greater than or equal to 45 square feet, or greater than or equal to 50 square feet.

In exemplary aspects, a retaining wall system 600 can comprise a plurality of building elements 400. Optionally, in these aspects, the beam member 420 of each building element 400 can have a length relative to the second axis 404, and at least one beam member can have a length that is less than the length of at least one other beam member. In additional aspects, the plurality of building elements 400 can be arranged in a plurality of columns 600 of vertically secured beam members. In these aspects, a bottom beam member of each column can have a length that is greater than the lengths of the beam members of any other beam member within the column. In further aspects, each column of the plurality of columns can comprise at least three building elements, and the length of the beam member of each building element within each column can be different than the length of each other beam member within the column. It is farther contemplated that the building elements can be arranged such that the length of the beam member of each sequential building element within the column decreases moving upwardly relative to the third axis. Optionally, each front panel can have a V-shape that cooperates with the front panels of surrounding building elements to define a corrugated appearance of the retaining wall. Optionally, the columns of building elements do not contact one another.

Optionally, in exemplary aspects, it is contemplated that an entire retaining wall system can be built from the same types of building elements 400. For example, it is contemplated that each building element of the retaining wall system can have the same front face profile. However, it is contemplated that the length of the beam member of each building element can vary depending upon the level (within the system which the building element is positioned. For example, as further described herein, building elements at the base of the system can have a greater length than building elements toward the top of the system. Exemplary sections of a retaining, wall system can have a height of about 30 feet or about 10 m).

In exemplary aspects, it is contemplated that the retaining wall system 600 can comprise a plurality of stacked groups (pillars) of building elements 400, with each pillar being independent of any other pillar. Thus, on soft ground, each wall pillar can settle independently of any neighboring pillar. Additionally, it is contemplated that it can be impossible to damage laterally spaced panels if the gap to the next pillar is wide enough. During a severe earthquake, it is contemplated that each pillar of wall units must survive from severe horizontal and even vertical shaking; however, because each pillar is independent as disclosed herein, the pillars do not touch each other and cart remain intact. The open gaps between the separate pillars can require the use of small concrete slabs loosely set behind the gaps to avoid loss of fill. It is contemplated that occasional water leaking can be acceptable, yet the concrete slabs can avoid erosion and material loss, thereby protecting against damage.

Figure 29:
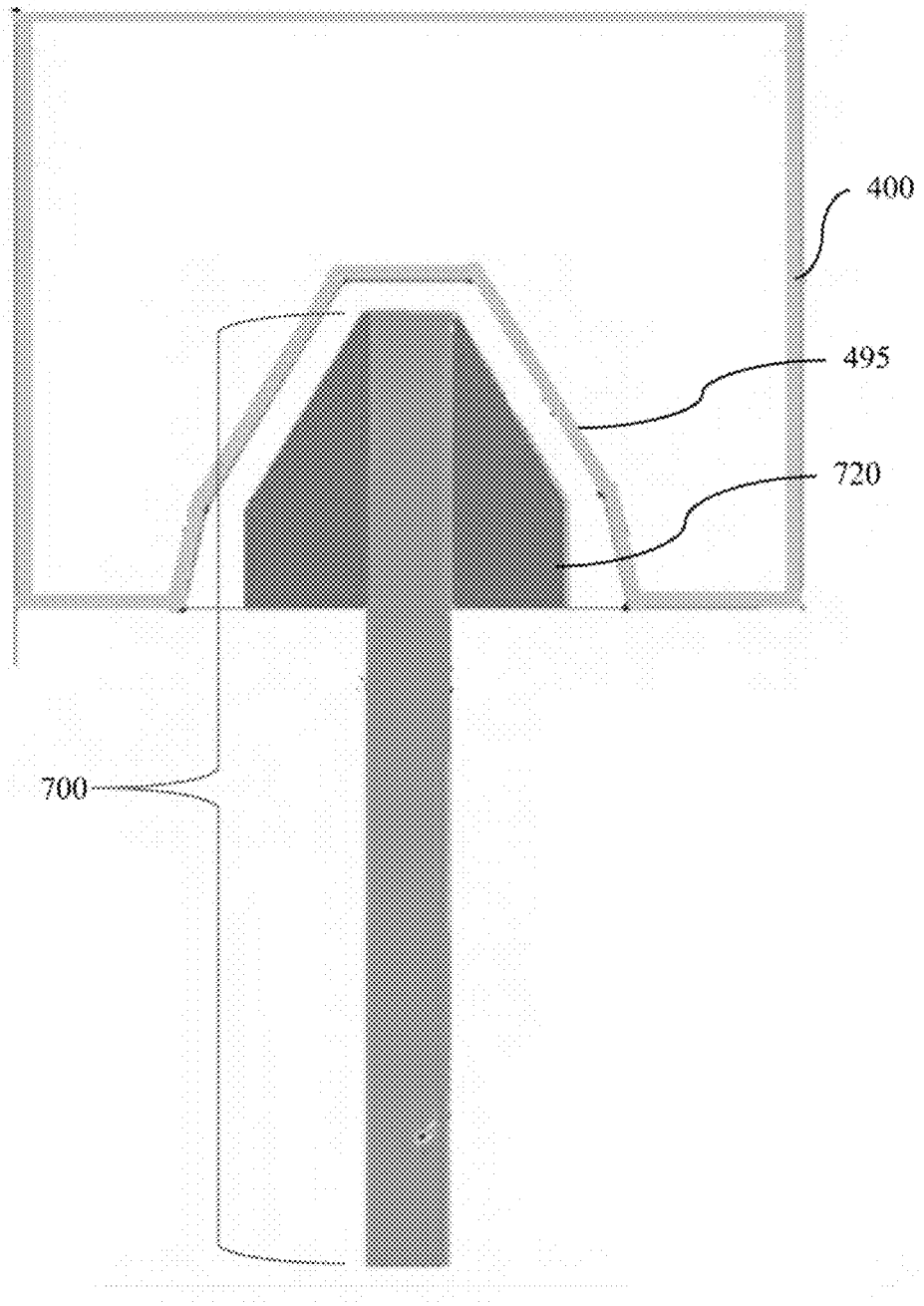
FIG. 29 is a side view of an exemplary alignment post having a cap received within a receptacle of a building element as disclosed herein.
Figure 30:
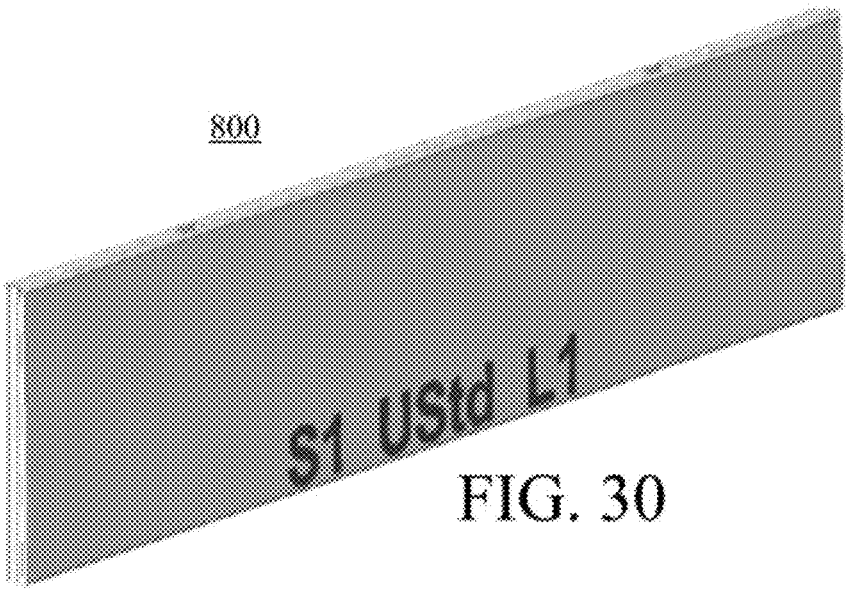
FIGS. 30-31C are various views of an exemplary enlarged panel as disclosed herein.
Figure 31B:
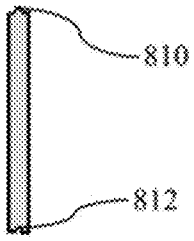
Figure 31A:
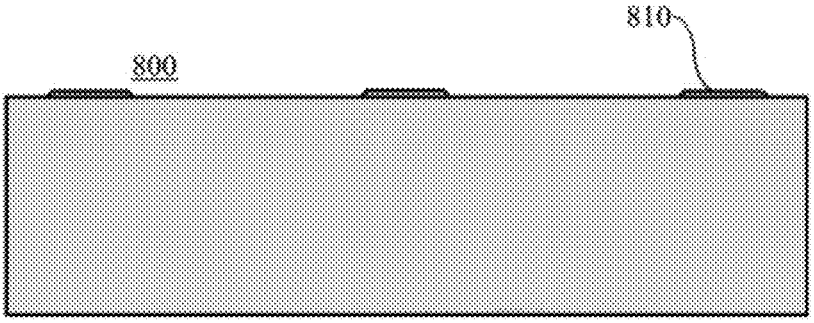
Figure 31C:
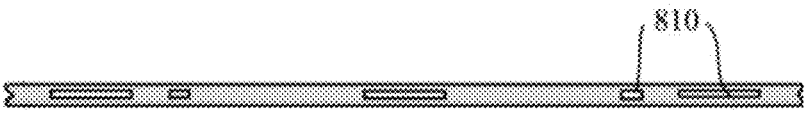

Optionally, in further exemplary aspects and with reference to FIG. 29, the system can further comprise an alignment post 700 having a stem 710 comprising first and second portions that cooperatively define an axial length dimension of the stem. The alignment post 700 can further comprise a cap 720 comprising a top surface and a bottom surface, wherein the top surface comprises a first cross sectional area and the bottom surface comprises a second cross sectional area greater than the first cross sectional area. In further aspects, the first portion of the stem can be embedded within the cap, and the second portion of the stem can extend downwardly from the bottom surface of the cap. In additional aspects, the top surface of the front panel of a first building element of the plurality of building elements can define an alignment void that receives the second portion of the stem of the alignment post, and the bottom surface of the front panel of a second building element of the plurality of building elements can define an alignment void 495 that receives the cap of the alignment post. In this exemplary configuration, the first and second building elements can cooperate to define at least a portion of a column of the retaining wall. In use, it is contemplated that the disclosed alignment posts and alignment voids can be used to assemble a retaining wall as further disclosed herein.

In use, it is contemplated that self-alignment keys (e.g., the alignment posts disclosed herein) can ensure the perfect alignment of precast units onto the wall face. As discussed generally above, the alignment posts 700 can comprise a vertical steel bar and a mushroom-like head on top. It is further contemplated that the alignment posts can be fabricated upside down in cups and inserted into the fresh concrete of the precast units, preferably directly after concrete work is complete. It is contemplated that the self-aligning posts can provide exact guidance for the units to be installed on top of the other while avoiding the need for special molding on the units, which is difficult to adjust precisely. Instead of mounting molds every time before casting, the only required finishing of concrete is the smoothing of the concrete surface with a tool. Then, the alignment posts can be inserted at the precise location.

As further explained herein, the disclosed building elements are capable of providing a number of advantages or improvements in comparison to existing retaining wall systems. Such advantages or improvements can include one or more of the following features.

The retaining walls are easy to cast and to transport by fitting onto a truck bed without creating any oversize issues for the trucker or for other drivers.

The main body portions of the beam members can include horizontal holes for lifting and transporting the units onto a truck and from the truck to an installation. Thus, the retaining walls are easy to pick up and handle using pins through horizontal holes in the stem (beam)—no need to insert costly tools which might be lost.

The retaining walls are easy to install units with self-aligning keys that direct the unit for precise setting automatically.

The pillars (distal end portions of the beam members) along the back enhance horizontal backfill arching for maximum loading of the concrete structure by vertical earth pressure components to help resisting the wall against overturning earth pressure forces.

The pronounced bottom widening of the beam members further enhances the vertical arching of the earth till for maximum weight load onto the structure to further increase the wall resistance against overturning and sliding.

The wide front panels provide an ample distance between stems (beams) of adjacent building elements for easy filling.

The wide spacing between pillars (the distal end portions of the beam members) allows for extra-wide vibratory roller compaction from the back, which is known to be more effective and reliable than small compactors.

The front face of the panels shows a vertical centerline edge required by the earth fill load resulting in a peak moment in the front panels. This peculiar structural function can also achieve a characteristic architectural effect along the front panels.

The vertical centerline edge of the front face further creates and adds an ever-changing sun and shade pattern every day.

As further discussed above, the front panels can further show a distinct 'nose' like ending along the bottom line for directing rain water running down the face away from the joint onto the next lower panel. This nose can also prevent vertical stains as are frequently seen on vertical walls. The nose can further hide or provide shade for a horizontal joint which conceals local irregularities and possible imperfections. In use, the nose can guide rain water to drip off outside of the front panel, and thereby avoid formation of ugly vertical stripes from smoke and dust washed down the front face. It is contemplated that the nose can cantilever out of the front wall face, causing a distinct shadow falling over the horizontal joint. This shadow can automatically cover small imperfections of units caused by loading, transport, or installation handling. In use, this shadow can create a special aesthetic feature that emphasizes the horizontal wall joints.

In combination, the features of the disclosed building elements maximize efficiency in unit production, transport, and installation. This maximum efficiency goes in line with fabrication features that allow up to three units produced per day from each mold for high capacity production on big projects. The systematic product streamlining eases installation by self-aligning keys resulting in high precision setting. The wide access to equipment from behind easily boosts filling and compaction by providing room for efficient wide vibratory rollers.

Methods of Making the Building Elements

Figure 28A:
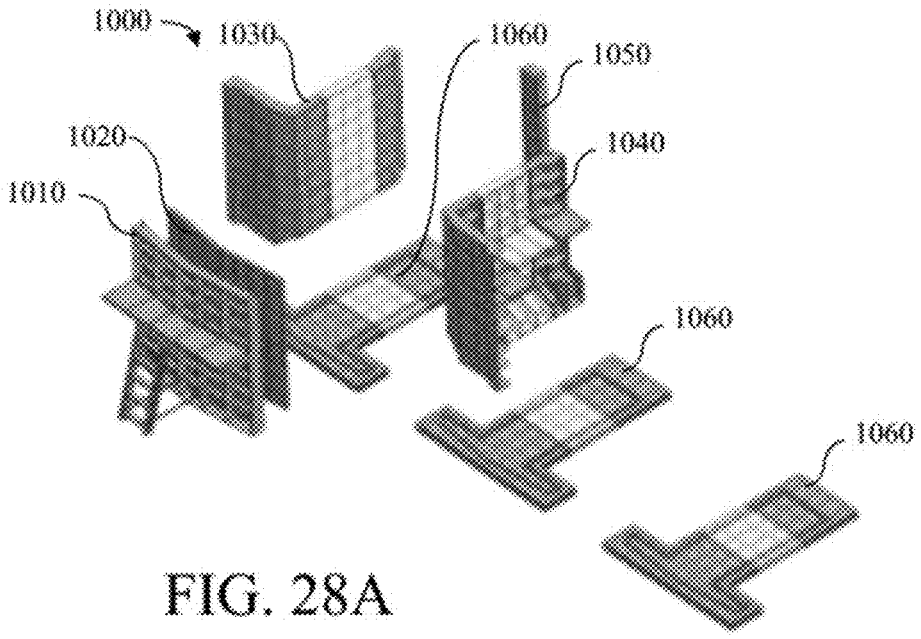
FIGS. 28-28B are schematic depictions of an exemplary process for making a building element having fill receiving spaces as disclosed herein.
Figure 28B:
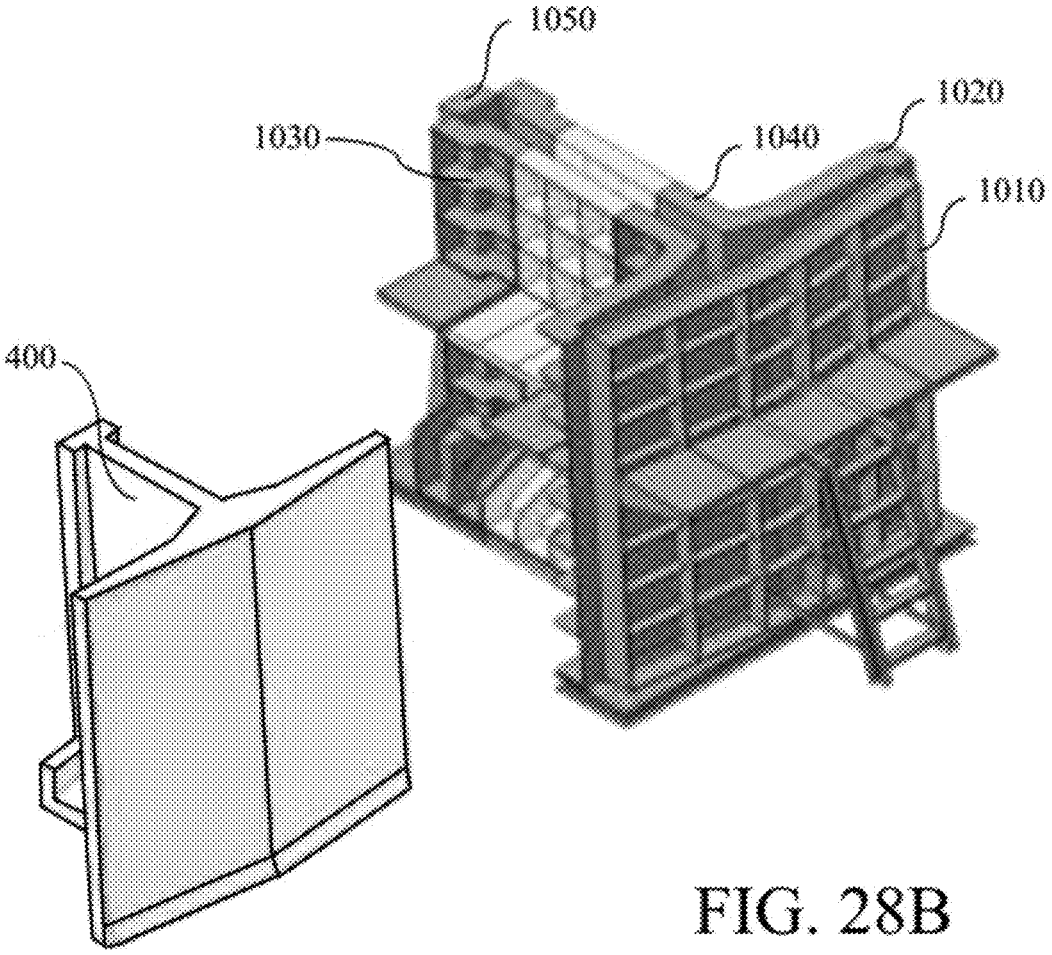

In exemplary aspects, and with reference to FIGS. 28A-28B, it is contemplated that the disclosed building elements can be cast without an expanding mold. In these aspects, it is contemplated that a mold assembly 1000 can comprise a plurality of mold components, including a face mold component 1010, a wire mesh 1020 (or other reinforcement material), first and second side mold components 1030, 1040, a rear mold component 1050, and a support platform 1060. In use, the plurality of mold components can be selectively positioned in a mold-ready position to define a three-dimensional profile of a building element as disclosed herein, with the face mold component defining the shape of the front surface of the building element, the side and rear mold components defining, the shape of the beam member, and the support platform defining, a flat bottom surface of the building element. With the mold components positioned in the mold-ready position, concrete can be received within the receiving space defined by the mold components, thereby encasing the wire mesh 1020 within the panel portion of the building element. Optionally, a plurality of support platforms 1060 (e.g., at least three platforms) can be provided in close proximity to each other. In use, it is contemplated that the plurality of mold components can be disassembled and separated from a first support platform after a few hours without the need for touching the concrete, thereby allowing a first building element to continue to cure on the first support platform. It is further contemplated that the mold components can be reassembled with a second support platform to permit formation of a second building element. After concrete is provided within the mold over the second support platform, the remaining mold components can again be disassembled and the process repeated as needed to form a plurality of building elements. In contrast to conventional molding casting methods which typically produce only a single unit per day, the disclosed methods can allow for production of a plurality of units in a single day, thereby greatly speeding up wall production while avoiding the need for multiple mold assemblies.

The vertical front edge and the horizontal wide 'nose' along the bottom line provide architectural features based on technical functions and a vivid change of shades of the otherwise overly flat front face.

Enlarged Panels

Disclosed herein with reference to FIGS. 30-39 is building element 800 for forming a portion of a retaining wall, the building element comprising: a panel comprising a top surface, a bottom surface, a front surface, and a rear surface positioned on an opposing side of the face panel from the front surface, wherein the face panel comprises a length dimension oriented along a first axis, a width dimension oriented along a second axis that is perpendicular to the first axis, and a height dimension oriented along a third axis that is perpendicular to the first and second axes, wherein the panel has opposed first and second side surfaces extending between the front surface and the rear surface. In exemplary aspects, the panel 800 can comprise a plurality of mortar beds 805 defined within the panel. In these aspects, the plurality of mortar beds 805 can be spaced apart relative to the first axis 402. In further aspects, the panel 800 can comprise a reinforcing material, such as, for example and without limitation, a reinforcing mesh, that is embedded within the panel. In still further aspects, the panel 800 can comprise a plurality or projections 810 extending upwardly from the top surface and a plurality of receptacles 812 defined within the bottom surface, wherein the receptacles are configured to receive the projections of a second building element.

Optionally, the length dimension of the panel can be at least 11 feet, at least 12 feet, at least 13 feet, at least 14 feet, at least 15 feet, at least 16 feet, at least 17 feet, at least 18 feet, at least 19 feet, or at least 20 feet.

Optionally, the height dimension of the panel can be at least 5.5 feet, at least six feet, at least 7 feet, at least 8 feet, at least 9 feet, or at least 10 feet.

In use, it is contemplated that the large panels can allow for the use of a significant reduction in the number of struts required to assemble a wall structure, thereby opening the construction site for big excavators for efficient filling and giving access to big vibratory rollers to eliminate hand compactors, hand-labor, and inefficient "gardener work." As further disclosed herein, it is contemplated that the large panels can comprise alignment posts and corresponding receptacles or openings to permit precise setting of the panels in a desired orientation and location.

Enlarged struts can be designed to hold the enlarged panels disclosed herein. In particular, the strut length must fit the panel size and the topography to anchor the bottom into firm ground. Standard practice is to use helix-type ground anchors screwed in with a small tractor gear connection, and unscrew the ground anchor after use fur the next application. In comparison, it is contemplated that the disclosed enlarged panels can require as few as two struts only, thereby speeding up installation by providing a larger work space and providing improved access for filling and compaction. In exemplary aspects, backfill with crushed rock at a minimum of 2 ft. for verticality can be used, without the need for compaction (it is self-compacting backfill). Self-aligning keys (e.g., alignment posts) as disclosed herein can be used along the top and joints.

Figure 32:
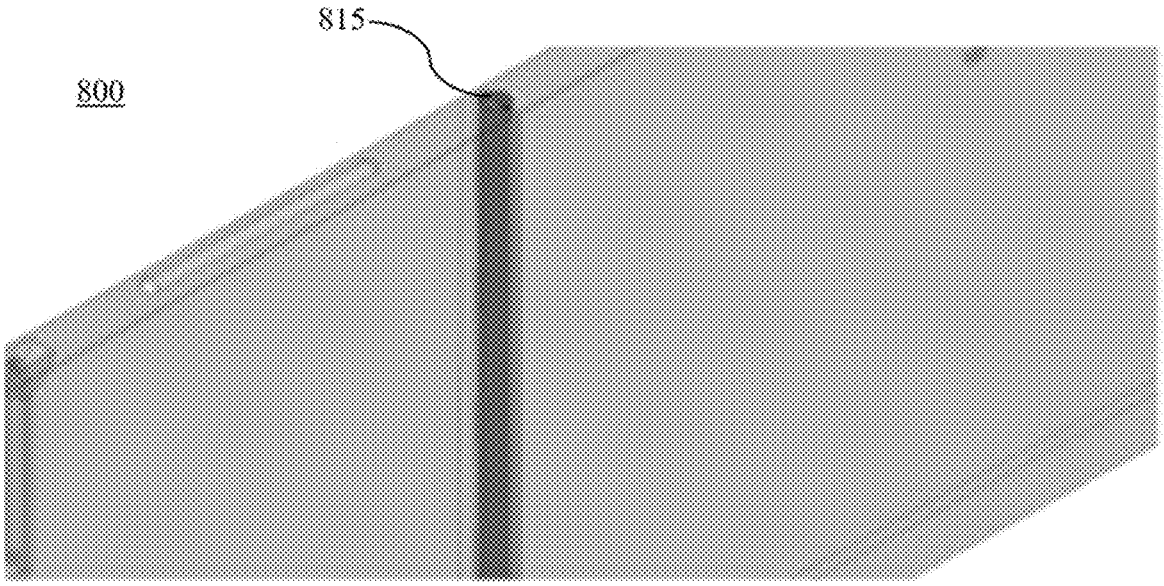
FIG. 32 is a close-up partially transparent view of a building element having a vertical alignment element as further disclosed herein.

In exemplary aspects, and with reference to FIG. 32, simple 'half'-pipe boxouts can be used for casting panels on flat tables. In these aspects, vertical flexible plastic pipes can be used for simplified and 'flexible' tongue and groove connection. Polyethylene(PE) UV-resistant and flexible pipe can be used for vertical alignment control. It is contemplated that flexible pipes can serve as absorbers for irregular settlement and avoid earthquake damages. In settlement-prone and earthquake-prone areas, it is contemplated that the gap between panels can be widened to prevent damage to adjacent panels. In exemplary aspects, small concrete pavers can be placed behind such wide-open gaps to allow for lateral deformations and to avoid fill material erosion or loss.

Figure 33:
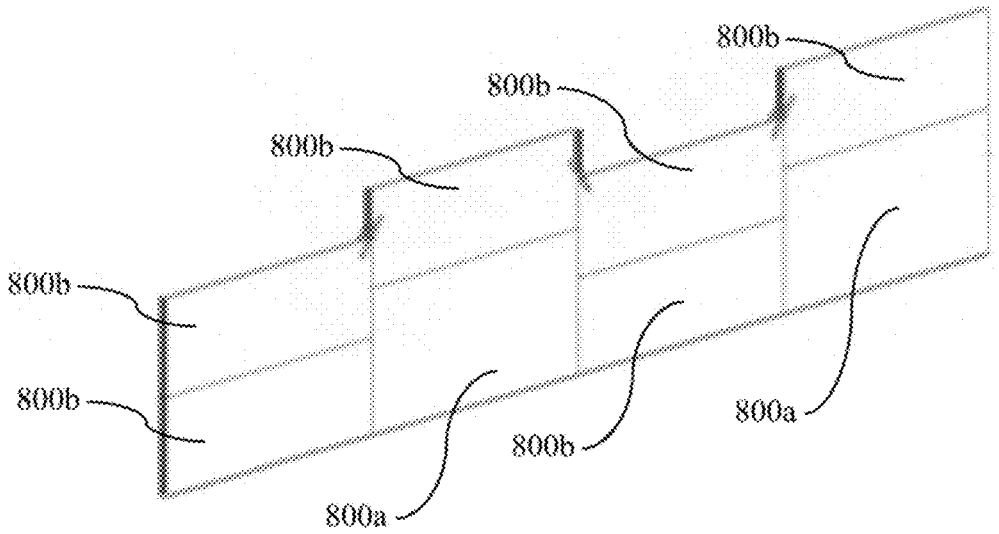
FIG. 33 is a perspective view of an exemplary layout of panels, with some columns of panels having reduced-height panels.

In further exemplary aspects, and with reference to FIG. 33, it is contemplated that a wall face layout using half height (or other reduced height) panels 800*b* along a bottom leveling pad can allow for easier vertical alignment. Optionally, in these aspects, it is contemplated that reduced-height panels 800*b* can cooperate with at least one other reduced-height panel to form a column of panels. It is further contemplated that other columns of panels can be formed by full-height panels 800*a* in combination with reduced-height panels. Optionally, in one example, columns formed from reduced-height panels 800*b* and columns formed from a combination of reduced-height and full-height panels 800*a*, 800*b* can be positioned in an alternating arrangement as shown in FIG. 33. As shown, wooden crosses with tie bars can also be used to straighten verticality of panels the conventional way.

Figure 34:
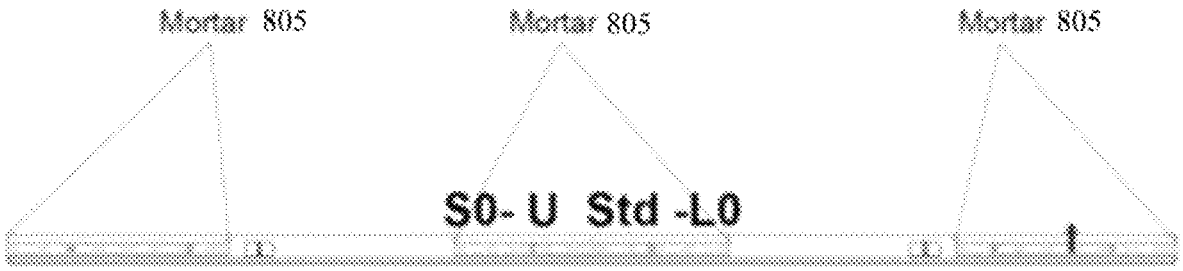
FIG. 34 is a top plan view of an exemplary panel having a plurality of mortar beds as disclosed herein.

As shown in FIG. 34, mortar beds 805 can be positioned at the ends of panels and along a center pan of the panel for avoiding excessive contact pressures and spalling for high walls. Gaps between mortar beds can be kept open to drain excessive water and prevent frost damage in winter.

Figure 39A:
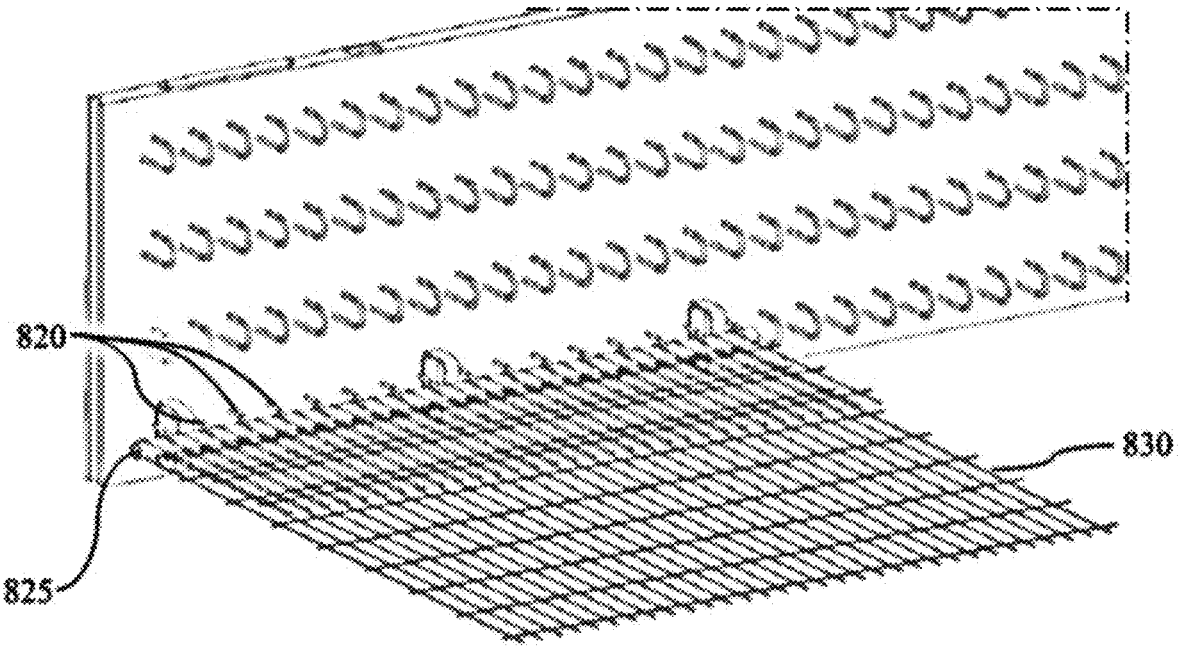
FIG. 39A is a perspective view depicting the connection between hooks and a grid as disclosed herein.
Figure 39B:
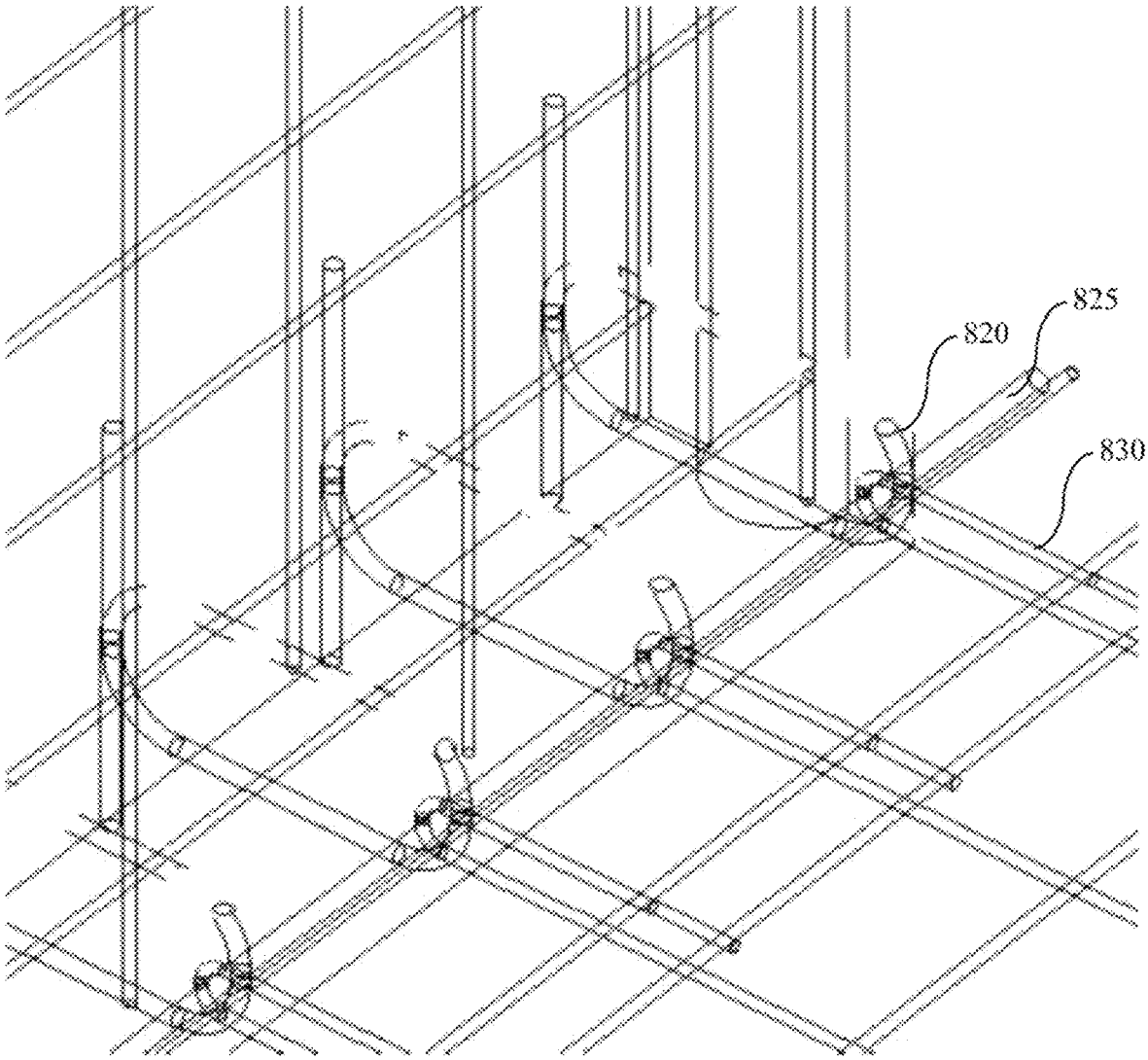
FIG. 39B is a close-tip perspective view depicting the connection between the hooks and the grid.

In additional aspects, and with reference to FIGS. 39A-39B, the building element 800 can further comprise a plurality of hooks 820 that are partially embedded within the panel and that partially extend rearwardly from the rear surface. In these aspects, the building element 800 can further comprise a support grid 830 positioned in secure engagement with the plurality of hooks 820 such that the support grid is parallel or substantially parallel to the rear surface of the panel. Optionally, it is contemplated that the support grid 830 can be secured to the hooks 820 using a bar 825 that is engaged by or coupled to both the hooks and the support grid.

Optionally, the plurality of hooks 820 can comprise galvanized steel. In use, the hooks 820 can extend out of the back of the enlarged panel fur connecting the support grid 830. A galvanized straight bar 825 can be placed onto the support grid next to the panel. The end of the support grid can be positioned over the steel bar, and the bar can be pushed down over and behind the hooks so that the support grid is firmly locked onto the hooks and secured to the frong panel. The support grid can then be stretched from the very end to avoid any slack. A small trench can be dug along and near the back end of the support grid. The support grid can then be stretched, and fill can be placed at the back end of the support grid to lock the support grid in place. Tension to the support grid can be added by placing additional fill along or within the small trench.

Figure 35:
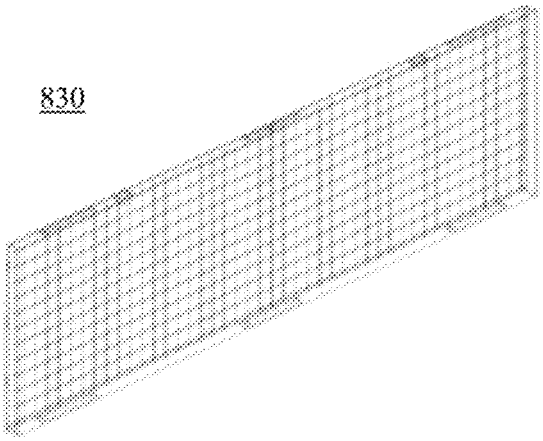
FIG. 35 is a perspective view of a grid as disclosed herein.
Figure 36:
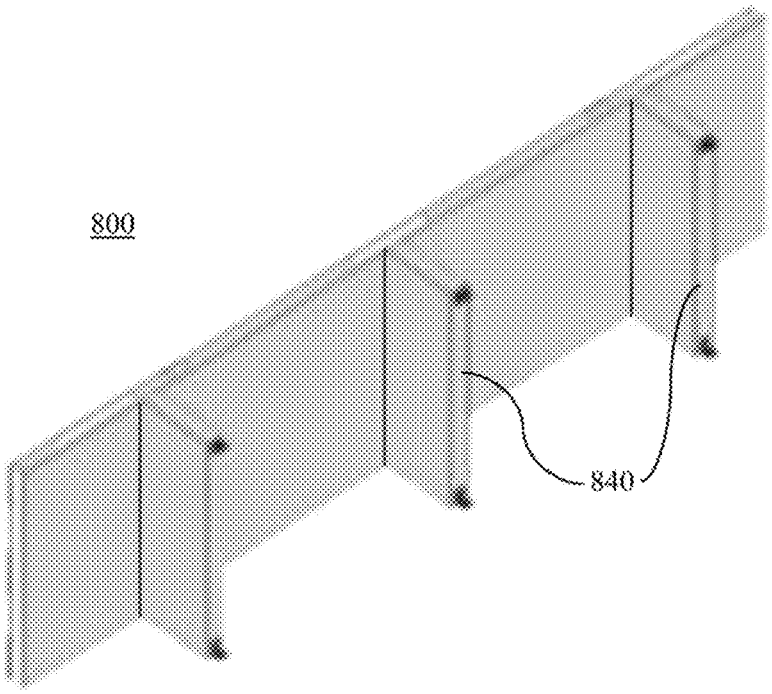
FIG. 36 is a perspective view of a panel having a plurality of reinforcement wings as disclosed herein.
Figure 37:
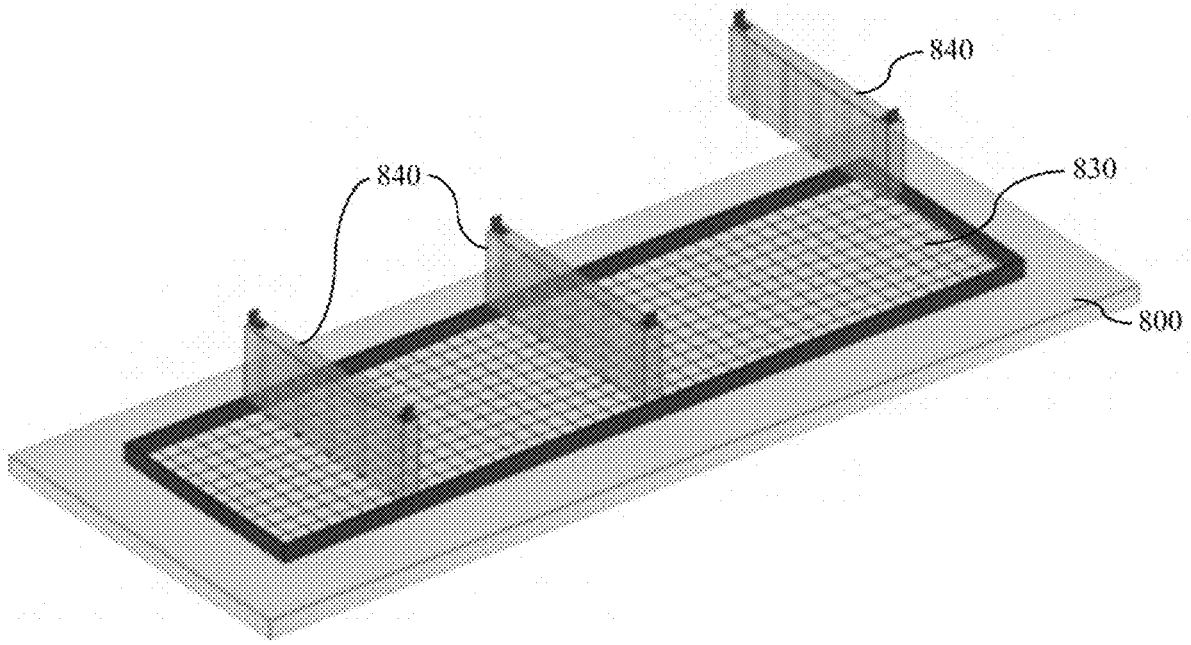
FIG. 37 is a schematic view of an exemplary assembly process for the panel of FIG. 36.
Figure 38A:
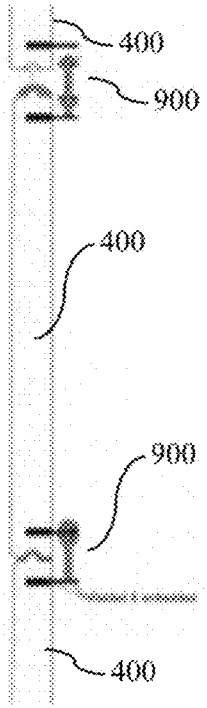
FIGS. 38A-38B are side and perspective views of an exemplary alignment assembly as disclosed herein.
Figure 38B:
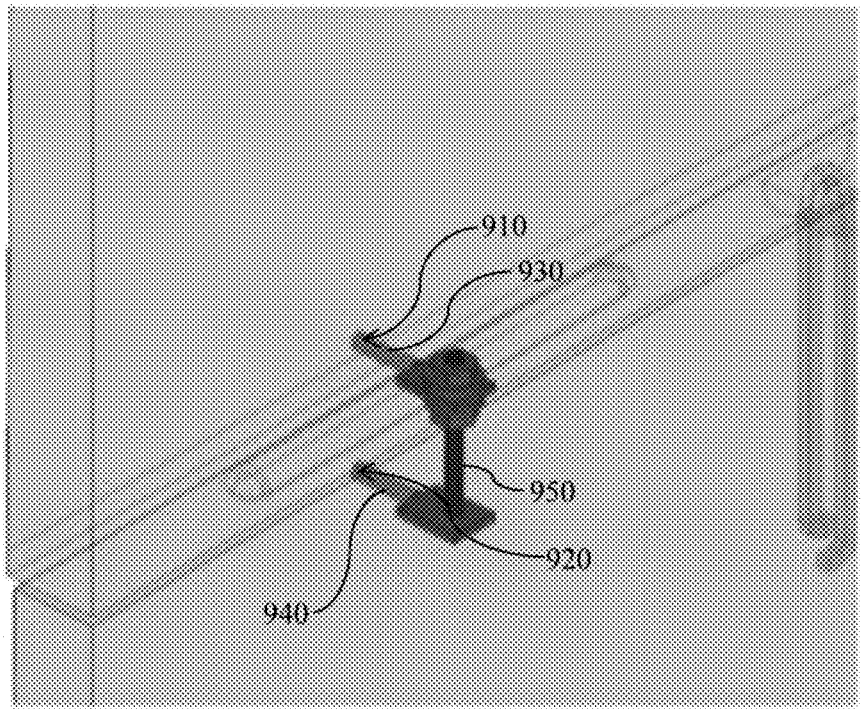

As shown in FIGS. 35-37, panel reinforcement can be achieved using standard flat, reinforcing mesh and a few additional bars along the center area of the panel. A 2 ft. wide volume of crushed pea gravel size crushed rock can be positioned onto a mesh grid 830 next to panel to get started (crushed rock does not need compaction and is self-stabilizing). Filling of the backfill can continue onto the mesh grid all the way to the end. Before starting compaction, the roller must not be in vibration mode. After confirming the roller is not in vibration mode, the front panel can be approached as close as allowed. Rolling can occur moving backward away from the front panel; simultaneously, vibration can begin. The compacted soil can now move slightly away from the front panel by the compaction process, leading to straightening and tensioning of the mesh grid and keeping the connection without any slack. It is contemplated that this process can initiate grid tensioning and avoid fill settlement and related repositioning of front panels in awkward angles.

In still further aspects, and with reference to FIGS. 36-37, the building element 800 can further comprise at least one reinforcement wing 840 secured to the rear surface of the panel. In these aspects, the at least one reinforcement wing 840 can extend outwardly from the rear surface of the panel relative to the second axis 404.

Reinforcement wings 840 along the back of the front panels can help to set the first base unit vertical on the leveling pad Wings along the back of panels provide for an easier start-up on the leveling pad to build stacks of wall elements. First, using separate molds, wings should be prepared for the back of the lowest panels in each stack. These wings should be set onto the panels ready for casting. The connecting reinforcement panels/materials should match with the panel positions. By casting wings separately, the enlarged panels can be cast face down without the need for complicated formwork. These base units can then be set onto widened leveling pads. Mortar beds and wooden wedges can be used to adjust the base units for proper verticality and line-up. In use, it is contemplated that reinforcement wings can be eliminated after a user becomes experienced with the particular setting and installation characteristics of the enlarged panels.

In exemplary aspects, a retaining wall system can comprise a plurality of building elements 800, wherein the plurality of building elements are arranged in a plurality of columns of vertically secured building elements. Optionally, the columns of building elements do not contact one another.

In one exemplary aspect, a first column of building elements comprises a first building element and a second building element, and the projections of the first building element are at least partially received within the receptacles of the second building element.

In a further exemplary aspect, the plurality of building elements can comprise a column of at least first and second vertically secured building elements. In this aspect, and with reference to FIGS. 38A-38B, the system can further comprise an alignment assembly 900 having a first transverse opening 920 extending partially through the width dimension of the first building element; a second transverse opening 910 extending partially through the width dimension of the second building element, wherein the second transverse opening 910 is positioned in alignment with the first transverse opening 920 relative to the third axis. The alignment assembly 900 can further include first and second dowels 940, 930 received within the respective first and second transverse openings 920, 910. It is further contemplated that the alignment assembly 900 can comprise a threaded fastener that is threadingly coupled to the first and second dowels 940, 930 to permit selective adjustment of a distance or orientation between the first and second dowels relative to the third axis.

In exemplary aspects, the alignment assembly 900 can comprise steel or brass aligning screws along the back of the panels for fine tuning of verticality. Optionally, two round dowels can be inserted into holes drilled after one day of concrete curing. It is contemplated that the dowels can have a vertically oriented opening near the outside end. A threaded bar, for tying and adjusting verticality, can be inserted through the opening of the dowels. Nuts at the ends of the threaded bar can allow for adjustment of the relative positioning of the panels. Nuts at the inside of the threaded bar (between the dowels) allow for relative translation of the next panel.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A building element for forming a portion of a retaining wall, the building element comprising: a face panel comprising a top surface, a bottom surface, a front surface, and a rear surface positioned on an opposing side of the face panel from the front surface, wherein the face panel comprises a length dimension oriented along a first axis, a width dimension oriented along a second axis that is perpendicular to the first axis, and a height dimension oriented along a third axis that is perpendicular to the first and second axes; and a beam member coupled to the rear surface of the face panel, the beam member comprising a main body and first and second foot portions, the main body having an upper surface and first and second side surfaces that are substantially parallel to the second axis, wherein the first and second foot portions project, respectively, from the first and second side surfaces relative to the first axis, and wherein the first and second foot portions have respective lower surfaces that are substantially co-planar with the bottom surface of the face panel and respective upper surfaces that are positioned between the bottom and top surfaces of the face panel relative to the third axis, wherein the beam member has a distal end portion spaced from the front panel relative to the second axis, wherein the distal end portion comprises first and second projections that project, respectively, from the first and second side surfaces of the main body of the beam member, and wherein the first and second projections cooperate with respective portions of the first and second foot portions, the first and second side surfaces of the main body, and the rear surface of the face panel to define first and second receiving spaces on opposing sides of the beam member.

Aspect 2: The building element of aspect 1, wherein the beam member is integrally formed with the face panel as a monolithic structure.

Aspect 3: The building element of aspect 1 or aspect 2, wherein the face panel has a variable width relative to the second axis, and wherein the face panel has a maximum width within a vertical reference plane that bisects the length dimension of the face panel.

Aspect 4: The building element of aspect 3, wherein the face panel has opposed first and second side edges that are spaced apart relative to the first axis, wherein the front surface of the face panel comprises first and second portions that extend, respectively, from the first and second side edges to a center point that is intersected by the vertical reference plane, and wherein the first and second portions of the front surface are angularly oriented relative to each other.

Aspect 5: The building element of aspect 4, wherein the first and second portions of the front surface together define a V-shape.

Aspect 6: The building element of aspect 4, wherein the beam member has a proximal end portion having first and second portions that extend, respectively, from the first and second side surfaces of the beam member to the rear surface of the front panel, and wherein each of the first and second portions of the proximal end portion extends at an obtuse angle relative to adjoining portions of the first and second side surfaces of the beam member.

Aspect 7: The building element of aspect 6, wherein the rear surface of the front panel comprises first and second end sections positioned on opposing sides of the proximal end portion of the beam member, wherein the first and second end sections of the rear surface of the front panel are substantially parallel to the first axis.

Aspect 8: The building element of aspect 1 or aspect 2, wherein the upper surfaces of the first and second foot portions of the beam member slope downwardly from the respective side surfaces of the main body of the beam member.

Aspect 9: The building element of aspect 1 or aspect 2, wherein the front surface of face panel comprises an upper portion and a base portion that extends between the upper portion and the bottom surface of the face panel relative to the third axis, wherein the base portion is angularly oriented to extend outwardly relative to the upper portion of the front surface of the face panel.

Aspect 10: The building element of aspect 1 or aspect 2, wherein the face panel comprises a reinforcing material that is embedded within the face panel and oriented substantially parallel to the first axis.

Aspect 11: The building element of aspect 1 or aspect 2, wherein the face panel comprises a plurality of steel bars that are embedded within the face panel.

Aspect 12: The building element of aspect 6, wherein the face panel comprises at least first and second steel bodies that are embedded within the face panel, wherein the first and second steel bodies have respective first and second ends, wherein the first ends of the first and second steel bodies are positioned proximate the center point of the center section of the rear surface, wherein the first steel body is oriented substantially parallel to the first portion of the center section of the rear surface of the face panel, and wherein the second steel body is oriented substantially parallel to the second portion of the center section of the rear surface of the face panel.

Aspect 13: The building element of aspect 1 or aspect 2, wherein at least one surface of the top surface and the bottom surface defines an alignment void configured to receive a portion of an adjacent building element during formation of the retaining wall.

Aspect 14: The building element of aspect 1 or aspect 2, wherein the front surface of the face panel has a surface area of greater than 40 square feet.

Aspect 15: A retaining wall system comprising: a plurality of building elements of any one of aspects 1-14, wherein the beam member of each building element has a length relative to the second axis, and wherein at least one beam member has a length that is less than the length of at least one other beam member.

Aspect 16: The system of aspect 15, wherein the plurality of building elements are arranged in a plurality of columns of vertically secured beam members, wherein a bottom beam member of each column has a length that is greater than the lengths of the beam members of any other beam member within the column.

Aspect 17: The system of aspect 16, wherein each column of the plurality of columns comprises at least three building elements, wherein the length of the beam member of each building element within each column is different than the length of each other beam member within the column, and wherein the building elements are arranged such that the length of the beam member of each sequential building element within the column decreases moving upwardly relative to the third axis.

Aspect 18: The system of aspect 16, wherein each front panel has a V-shape that cooperates with the front panels of surrounding building elements to define a corrugated appearance of the retaining wall.

Aspect 19: The system of aspect 16, wherein the columns of building elements do not contact one another.

Aspect 20: The system of aspect 16, further comprising an alignment post having: a stem comprising first and second portions that cooperatively define an axial length dimension of the stem; and a cap comprising a top surface and a bottom surface, wherein the top surface comprises a first cross sectional area and the bottom surface comprises a second cross sectional area greater than the first cross sectional area, wherein the first portion of the stem is embedded within the cap, and wherein the second portion of the stem extends downwardly front the bottom surface of the cap, wherein the top surface of the front panel of a first building element of the plurality of building elements defines an alignment void that receives the second portion of the stem of the alignment post, and wherein the bottom surface of the front panel of a second building element of the plurality of building elements defines an alignment void that receives the cap of the alignment post, and wherein the first and second building elements cooperate to define at least a portion of a column of the retaining wall.

Aspect 21: A method of assembling a retaining wall using a system of any one of aspects 15-20.

Aspect 22: A method of molding a building element of any one of aspects 1-14.

Aspect 23: A building element for forming a portion of a retaining wall, the building element comprising: a panel comprising a top surface, a bottom surface, a front surface, and a rear surface positioned on an opposing side of the face panel from the front surface, wherein the face panel comprises a length dimension oriented along a first axis, a width dimension oriented along a second axis that is perpendicular to the first axis, and a height dimension oriented along a third axis that is perpendicular to the first and second axes, wherein the panel has opposed first and second side surfaces extending between the front surface and the rear surface, wherein the panel comprises: a plurality of mortar beds defined within the panel, wherein the plurality of mortar beds are spaced apart relative to the first axis; a reinforcing mesh embedded within the panel; and a plurality of projections extending upwardly from the top surface and a plurality of receptacles defined within the bottom surface, wherein the receptacles are configured to receive the projections of a second building element.

Aspect 24: The building element of aspect 23, wherein the length dimension of the panel is at least 11 feet.

Aspect 25: The building element of aspect 24, wherein the height dimension of the panel is at least six feet.

Aspect 26: The building element of aspect 23, further comprising: a plurality of hooks that are partially embedded within the panel and that partially extend rearwardly from the rear surface; and a support grid positioned in secure engagement with the plurality of hooks such that the support grid is substantially parallel to the rear surface of the panel.

Aspect 27: The building element of aspect 23, further comprising at least one reinforcement wing secured to the rear surface of the panel, wherein the at least one reinforcement wing extends outwardly from the rear surface of the panel relative to the second axis.

Aspect 28: A retaining wall system comprising: a plurality of building elements of any one of aspects 23-27, wherein the plurality of building elements are arranged in a plurality of columns of vertically secured building elements.

Aspect 29: The system of aspect 28, wherein the columns of building elements do not contact one another.

Aspect 30: The system of aspect 28, wherein a first column of building elements comprises a first building element and a second building element, wherein the projections of the first building element are at least partially received within the receptacles of the second building element.

Aspect 31: The system of aspect 23, wherein the plurality of building elements comprise a column of at least first and second vertically secured building elements, the system further comprising an alignment assembly having: a first transverse opening extending partially through the width dimension of the first building element; a second transverse opening extending partially through the width dimension of the second building element, wherein the second transverse opening is positioned in alignment with the first transverse opening relative to the third axis; first and second dowels received within the respective first and second transverse openings; and a threaded fastener that is threadingly coupled to the first and second dowels to permit selective adjustment of a distance or orientation between the first and second dowels relative to the third axis.

Aspect 32: A method of assembling a retaining wall using a system of any one of aspects 28-31.

Aspect 33: A method of forming a building element of any one of aspects 23-27.

Aspect 34: The building element of any one of aspects 1-14, further comprising at least one longitudinal elbow that projects outwardly from the main body of the beam member and extends between the face panel and the distal end portion of the beam member.

Aspect 35: The building element of any one of aspects 1-14 or aspect 34, further comprising at least one transverse elbow that projects outwardly from a rear surface of the distal end portion of the beam member.

Aspect 36: The method of aspect 32, wherein at least a first building element comprises: a plurality of hooks that are partially embedded within the panel and that partially extend rearwardly from the rear surface; and a support grid positioned in secure engagement with the plurality of hooks such that the support grid is substantially parallel to the rear surface of the panel, and wherein the method comprises backfilling the support grid with crushed rock.

Several embodiments of the invention have been disclosed in the foregoing specification. It is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A building element for forming a portion of a retaining wall, the building element comprising:

a face panel having a rear surface;

a beam member having a proximal end portion coupled to the rear surface of the face panel and a distal end portion spaced from the proximal end portion, wherein the beam member comprises a main body having first and second side surfaces that extend along a length of the beam member, wherein the beam member has an upper surface and a lower surface, wherein the first and second side surfaces of the main body and the rear surface of the face panel cooperate to define first and second receiving spaces on opposing sides of the beam member, wherein the first and second side surfaces of the main body of the beam member define one or more support structures that are configured to positively support and create substantial arching of fill within the first and second receiving spaces, wherein the one or more support structures comprise at least one longitudinal elbow that projects outwardly from the main body of the beam member and extends along a length of the beam member between the proximal end portion and the distal end portion of the beam member, wherein the at least one longitudinal elbow is spaced from each of the upper surface and the lower surface of the beam member along a vertical axis.

2. The building element of claim 1, wherein the at least one longitudinal elbow that projects outwardly from the main body of the beam member and extends along the length of the beam member between the proximal end portion and the distal end portion of the beam member comprises a plurality of elbows, wherein at least one elbow of the plurality of elbows is positioned on each of the first and second side surfaces of the main body of the beam member.

3. The building element of claim 1, wherein the beam member defines a rear surface having at least one engagement structure that is configured to engage fill adjacent to the rear surface of the beam member to stabilize the beam member against overturning.

4. The building element of claim 3, wherein the length of the beam member extends along a beam axis, wherein the at least one engagement structure comprises at least one rearwardly projecting transverse elbow that projects outwardly along the beam axis, wherein each transverse elbow of the at least one rearwardly projecting transverse elbow is spaced from each of the upper surface and the lower surface of the beam member along the vertical axis.

5. The building element of claim 4, wherein the at least one rearwardly projecting transverse elbow comprises a plurality of rearwardly projecting transverse elbows.

6. The building element of claim 1, wherein the beam member is integrally formed with the face panel as a monolithic structure.

7. The building element of claim 1, wherein the face panel has a top surface and a bottom surface, wherein at least one surface of the top surface or the bottom surface of the face panel defines an alignment void configured to receive a portion of an adjacent building element during formation of the retaining wall.

8. The building element of claim 1, wherein the front surface of the face panel has a surface area of greater than 40 square feet.

9. The building element of claim 1, wherein the face panel comprises a reinforcing material that is embedded within the face panel.

10. The building element of claim 1, wherein the face panel comprises a plurality of steel bars that are embedded within the face panel.

11. A building element for forming a portion of a retaining wall, the building element comprising:

a face panel having a rear surface;

a beam member having a proximal end portion coupled to the rear surface of the face panel and a distal end portion spaced from the proximal end portion, wherein the beam member comprises a main body having first and second side surfaces that extend along a length of the beam member, wherein the beam member has an upper surface and a lower surface, wherein the first and second side surfaces of the main body and the rear surface of the face panel cooperate to define first and second receiving spaces on opposing sides of the beam member, wherein the first and second side surfaces of the main body of the beam member define one or more support structures that are configured to positively support and create substantial arching of fill within the first and second receiving spaces, wherein the beam member defines a rear surface having at least one engagement structure that is configured to engage fill adjacent to the rear surface of the beam member to stabilize the beam member against overturning, wherein the length of the beam member extends along a beam axis, wherein the at least one engagement structure comprises at least one rearwardly projecting transverse elbow that projects outwardly along the beam axis, wherein each transverse elbow of the at least one rearwardly projecting transverse elbow is spaced from each of the upper surface and the lower surface of the beam member along the vertical axis.

12. The building element of claim 11, wherein the at least one rearwardly projecting transverse elbow comprises a plurality of rearwardly projecting transverse elbows.

13. The building element of claim 11, wherein the beam member is integrally formed with the face panel as a monolithic structure.

14. The building element of claim 11, wherein the face panel has a top surface and a bottom surface, wherein at least one surface of the top surface or the bottom surface of the face panel defines an alignment void configured to receive a portion of an adjacent building element during formation of the retaining wall.

15. The building element of claim 11, wherein the front surface of the face panel has a surface area of greater than 40 square feet.

16. The building element of claim 11, wherein the face panel comprises a reinforcing material that is embedded within the face panel.

17. A building element for forming a portion of a retaining wall, the building element comprising:

a face panel having a rear surface;

a beam member having a proximal end portion coupled to the rear surface of the face panel and a distal end portion spaced from the proximal end portion, wherein the beam member comprises a main body having first and second side surfaces that extend along a length of the beam member, wherein the beam member has an upper surface and a lower surface, wherein the first and second side surfaces of the main body and the rear surface of the face panel cooperate to define first and second receiving spaces on opposing sides of the beam member, wherein the first and second side surfaces of the main body of the beam member define one or more support structures that are configured to positively support and create substantial arching of fill within the first and second receiving spaces, wherein the one or more support structures comprise at least one elbow that projects outwardly from the main body of the beam member and is spaced from each of the upper surface and the lower surface of the beam member along a vertical axis.

18. The building element of claim 17, wherein the at least one elbow that projects outwardly from the main body of the beam member comprises a plurality of elbows, wherein at least one elbow of the plurality of elbows is positioned on each of the first and second side surfaces of the main body of the beam member.

19. The building element of claim 17, wherein the beam member defines a rear surface having at least one engagement structure that is configured to engage fill adjacent to the rear surface of the beam member to stabilize the beam member against overturning.

20. The building element of claim 19, wherein the length of the beam member extends along a beam axis, wherein the at least one engagement structure comprises at least one rearwardly projecting elbow that projects outwardly along the beam axis, wherein each rearwardly projecting elbow of the at least one rearwardly projecting elbow is spaced from each of the upper surface and the lower surface of the beam member along the vertical axis.

* * * * *